United States Patent [19]

Hirose et al.

[11] Patent Number: 4,783,394

[45] Date of Patent: Nov. 8, 1988

[54] COLOR IMAGE FORMING PROCESS

[75] Inventors: Takeshi Hirose; Kiyoshi Nakazyo; Hideaki Naruse, all of Kanagawa, Japan

[73] Assignee: Fuji Photo Film Co., Ltd., Kanagawa, Japan

[21] Appl. No.: 37,288

[22] Filed: Apr. 10, 1987

[30] Foreign Application Priority Data

Apr. 10, 1986 [JP] Japan ..... 61-82501

[51] Int. Cl.[4] ..... G03C 7/30; G03C 1/84

[52] U.S. Cl. ..... 430/380; 430/377; 430/464; 430/467; 430/478; 430/505; 430/502; 430/931; 430/512

[58] Field of Search ..... 430/383, 372, 375, 377, 430/380, 464, 467, 484, 485, 478, 502, 505, 512, 931

[56] References Cited

U.S. PATENT DOCUMENTS

| | | | |
|---|---|---|---|
| 3,996,054 | 12/1976 | Santemma et al. | 430/377 |
| 4,456,681 | 6/1984 | Kadowaki et al. | 430/505 |
| 4,518,686 | 5/1985 | Sasaki et al. | 430/512 |
| 4,540,656 | 9/1985 | Nishizima et al. | 430/505 |
| 4,564,590 | 1/1986 | Sasaki et al. | 430/551 |
| 4,622,287 | 11/1986 | Umemoto et al. | 430/505 |
| 4,668,611 | 5/1987 | Nakamura | 430/507 |

FOREIGN PATENT DOCUMENTS 158446 8/1985 Japan .

*Primary Examiner*—Paul R. Michl
*Assistant Examiner*—Patrick A. Doody
*Attorney, Agent, or Firm*—Sughrue, Mion, Zinn, Macpeak, and Seas

[57] ABSTRACT

A color image forming process is described, which comprises developing an imagewise exposed silver halide color photographic material with a color developer containing an aromatic primary amine developing agent and being substantially free of benzyl alcohol for a period of up to about 2 minutes and 30 seconds, wherein the silver halide color photographic material comprises a reflective support having thereon a blue-sensitive silver halide emulsion layer containing a yellow color-forming coupler, a green-sensitive silver halide emulsion layer contaning a magenta color-forming coupler, and a red-sensitive silver halide emulsion layer containing a cyan color-forming coupler in this order, the material further containing light-insensitive hydrophilic colloid layers between the blue-sensitive silver halide emulsion layer and the green-sensitive silver halide emulsion layer and between the green-sensitive silver halide emulsion layer and the red-sensitive silver halide emulsion layer and at least one light-insensitive hydrophilic colloid layer on the red-sensitive silver halide emulsion layer, the volume ratio of the oil component to the hydrophilic colloid in each of the light-insensitive layers is at most about 0.2 and both the light-insensitive layer between the green-sensitive silver halide emulsion layer and the red-sensitive silver halide emulsion layer and the light-insensitive layer on the red-sensitive silver halide emulsion layer each contains at least one ultraviolet absorbent compound represented by formula (F):

(F)

wherein $R_1$, $R_2$, $R_3$, $R_4$ and $R_5$, which may be the same or different, each may represent a hydrogen atom or a substituent, and the $R_4$ and $R_5$ may bond together to form a 5-membered or 6-membered aromatic ring.

22 Claims, No Drawings

COLOR IMAGE FORMING PROCESS

FIELD OF THE INVENTION

This invention relates to a color image forming process for silver halide color photographic materials and, more particularly, to a color image forming process which results in color images having excellent storage stability with a shortened processing time.

BACKGROUND OF THE INVENTION

A silver halide color photographic material, based on the principle of forming the three primary colors by a subtractive color process, is generally composed of a blue-sensitive silver halide emulsion layer containing a coupler which reacts to form a yellow dye by undergoing a coupling reaction with the oxidation product of an aromatic primary amine developing agent, a green-sensitive silver halide emulsion layer containing a coupler similarly forming a magenta dye, and a red-sensitive silver halide emulsion layer containing a coupler similarly forming a cyan dye, and further comprises light-insensitive layers such as an interlayer for preventing the occurrence of color mixing between the emulsion layers, a protective layer for preventing the emulsion layer from direct contact with foreign matter, etc.

These silver halide emulsion layers and light-in-sensitive layers may also contain a color mixing preventing agent, a fading preventing agent, an ultraviolet absorbent, etc., according to their known purposes. These additives are, for the most part, hydrphobic substances and hence they are each dissolved in a high-boiling organic solvent and then added to a silver haldide emulsion or a hydrophilic colloid solution as an emulsified dispersion of the organic solvent solution thereof.

In general, a standard or conventional processing method for silver halide color photographic materials of this nature comprises (1) a color development step for forming color images, (2) a desilvering step for removing developed silver and undeveloped silver, followed by (3) a washing and/or image stabilization step.

Hitherto, it has been desirable to shorten the overall processing time for such color photographic materials, but especially recently, the necessity for shortening the processing time has further been increased, with a view toward shortening the time for delivery, reducing the laboratory work, and desizing and simplifying the processing system for small-scale laboratories (called minilabs).

Heretofore, various kinds of developing agent pentrants have been investigated for increasing coloring properties while reducing the processing time necessary for color development of silver halide color photographic materials using oil protect-type couplers. In particular, a method of adding benzyl alcohol to a color developer has been widely used for processing color photographic papers, color reversal papers, and color positive films for display.

However, since benzyl alcohol is only slightly soluble in water, solvents such as diethylene glycol, triethylene glycol, alkanolamine, etc., are required to be added to the developer solution to increase the solubility of benzyl alcohol. These solvents, and also benzyl alcohol, however, show high BOD (biological oxygen demand) and COD (chemical oxygen demand) and thus are considered pollutants in terms of disposing of used developers. Thus, it is preferred to avoid the use of these compounds from the viewpoint of protecting the environment from pollution.

Furthermore, when using benzyl alcohol, it takes a long period of time to dissolve benzyl alcohol even when one of the above-described solvents is used; hence, avoiding the use of benzyl alcohol altogether will aid in reducing the time required to prepare the developer solution.

Still further, if benzyl alcohol is present in the color developer, some of the developing agent is liable to remain in the photographic materials after processing, which results in a reduction of the image stability over time, and particularly undesirably increases the amounts of color image fading and color stains in the background portions under light exposure. In particular, in the above-described processing method, where the step (particularly, washing step) subsequent to the development step is shortened, the developing agent is even more likely to remain in the photographic materials processed and hence the above-described problems due to an excess of leftover developing agent in the materials become more serious.

Also, when the photographic material has a reflective support, such as a color photographic paper, such stains are visually amplified as compared with a photographic material having a transparent support, which is also highly undesirable.

It is known to form a layer containing one or more ultraviolet absorbents in a photographic material for improving the storage stability of images under light exposure, but the effects as to improving stability by incorporating ultraviolet absorbents is insufficient from a practical standpoint in processing system using benzyl alcohol in the developer.

Thus, to eliminate the various problems described above, it has been desired to avoid the use of benzyl alcohol altogether and to shorten the overall processing time. However, this goal has not yet been achieved for multilayer color photographic materials having silver halide emulsion layers containing color-forming couplers together with interlayers and one or more protective layers since in such materials, the color density of the resulting formed images is reduced.

SUMMARY OF THE INVENTION

An object of this invention is, therefore, to provide a color image forming process wherein the color developer contains substantially no benzyl alcohol and exhibits a sufficient coloring property even when relatively short processing times, e.g., 2 minutes and 30 seconds or less, are used and also results in color images which are excellent in storage stability.

As the result of various investigations, the present inventors have discovered that the above-described objects can be attained by the following color image forming process.

That is, the present invention is directed to a color image forming process which comprises developing an imagewise exposed a silver halide color photographic material with a color developer containing an aromatic primary amine developing agent and being substantially free of benzyl alcohol for a period of up to about 2 minutes and 30 seconds. The silver halide color photographic material to be used in this process comprises a reflective support having thereon a blue-sensitive silver halide emulsion layer containing a yellow color-forming coupler, a green-sensitive silver halide emulsion layer containing a magenta color-forming coupler, and a red-sensitive silver halide emulsion layer containing a cyan color-forming coupler in this order, the material further containing light-insensitive hydrophilic colloid layers between the blue-sensitive silver halide emulsion layer and the green-sensitive silver halide emulsion layer and between the green-sensitive silver halide emulsion layer and the red-sensitive silver halide emulsion layer and at least one light-insensitive hydrophilic colloid layer on the red-sensitive silver halide emulsion layer, wherein the volume ratio of the oil component to the hydrophilic colloid in each of the light-insensitive layers is at most about 0.2, and both the light-insensitive layer between the green-sensitive silver halide emulsion layer and the red-sensitive silver halide emulsion layer and the light-insensitive layer on the red-sensitive silver halide emulsion layer each contains at least one ultraviolet absorbent compound represented by formula (F):

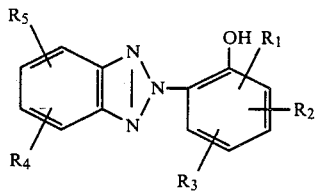

(F)

wherein $R_1$, $R_2$, $R_3$, $R_4$, and $R_5$, which may be same or different, each may represent a hydrogen atom or a substituent and $R_4$ and $R_5$ may bond together to form a 5-membered or 6-membered aromatic ring.

DETAILED DESCRIPTION OF THE INVENTION

The present invention is based on the unexpected discovery that when a multilayer color photographic material is processed by a color developer substantially free of benzyl alcohol, the presence of interlayers and protective layers are important to the coloring ability of the color photographic material. In particular, the volume ratio of the oil component and the hydrophilic colloid in each of a light-insensitive layer has an impact upon the coloring ability. In other words, the coloring ability of these types of photographic materials has hitherto been considered to be the exclusive domain of the emulsion layers containing color-forming couplers, and it has never been known that light-insensitive layers (such as interlayers or protective layers) take part in the color-forming reactions in the color photographic material. The reason why the oil component ratio of the light-insensitive layer(s) has an effect on the coloring ability has not yet been fully determined, but it is considered that when a color developing agent passes through a light-insensitive layer, the developing agent may be "trapped" by the oil component in the layer, thus preventing its permeation to emulsion layers located closer to the support.

Also, the present invention is partly based on the discovery that when a color photographic material containing an ultraviolet absorptive layer is processed by a color developer substantially free of benzyl alcohol, the storage stability of color images of the photographic material thus processed under light exposure is unexpectedly improved and, in particular, the formation of stains at the background portion can be greatly reduced. The color developer substantially free of benzyl alcohol means a color developer containing benzyl alcohol in an amount of 0.5 ml/l or less, and preferably a color developer completely free of benzyl alcohol. The stains at the background portions are visually amplified when using a reflective support and thus are a serious problem as described above, but it is assumed that the above-described effect of the ultraviolet absorbent has not hiterto been known since color photographic papers containing couplers which are dispersed in silver halide emulsions using a high-boiling organic solvent (so-called oil-soluble couplers) are conventionally processed by a color developer containing benzyl alcohol.

The light-insensitive layers as used to construct the color photographic materials to be developed in accordance with the present invention are layers containing a hydrophilic colloid such as gelatin, etc., and further containing additives such as color mixing preventing agents, ultraviolet absorbents, matting agents, dyes, brightening agents, etc., according to their known functions. The oil component of the light-insensitive layers of the present invention is a high-boiling organic solvent which allows the above-reacted additives to endure a stable co-presence in the hydrophilic colloid of the layer.

The volume ratio of the oil component to the hydrophilic colloid in at least one of the light-insensitive layers is preferably at most about 0.1.

Whether or not any of the light-insensitive layers in the color photographic material meet the above volume ratio can be determined by separating each of the light-insensitive layers, quantitatively analyzing the high-boiling organic solvent and the hydrophilic colloid in each layer, and determining the volume ratio from the analyzed values obtained and the density. Such quantitative analysis may be performed by using gas chromatography, liquid chromatography, etc., according to the chemical structures of the compounds.

The high-boiling organic solvent (constituting the oil component of the interlayers and/or protective layers of the present invention) is preferably selected from the organic solvents represented by following formulae (A), (B), (C), (D), and (E), each having a boiling point of at least about 175° C. under normal (atmospheric) pressure, but where a light-insensitive layer contains no high-boiling organic solvent (i.e., the volume ratio is 0), such asn embodiment is also included in the scope of this invention. Also, the high-boiling organic solvents may be used alone or in combination. When using two or more kinds of organic solvents, the volume ratio is calculated by using the total volume of the organic solvents in combination.

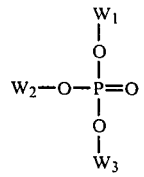

(A)

$$W_1—COO—W_2 \quad (B)$$

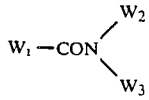

(C)

-continued

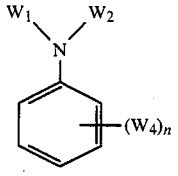

(D)

$W_1—O—W_2$ (E)

In the above formulae, $W_1$, $W_2$, and $W_3$, which may be the same or different, each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ has the same definition as $W_1$, but may also be O-$W_1$ or S-$W_1$; n represents an integer of from 1 to 5; when n is from 2 to 5, $W_4$ may be the same or different, and in formula (E), $W_1$ and $W_2$ may bond together to form a condensed ring.

It is preferred that the total sum of the carbon atoms of $W_1$, $W_2$, $W_3$ and $W_4$ is at least about 8 in the high-boiling organic solvents represented by formulae (A), (B), (C), (D) and (D) above.

When $W_1$, $W_2$ or $W_3$ in formula (A), (B), (C), (D), or (E) is an alkyl group, a cycloalkyl group, an alkenyl group, an aryl group, or a heterocyclic group each of which may be substituted, suitable substituents include a group having one or two linkage groups selected from

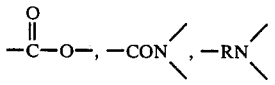

(wherein R represents a substituted or unsubstituted phenylene group) and —O—.

The alkyl group represented by $W_1$, $W_2$, $W_3$, or $W_4$ in formulae (A), (B), (C), (D), and (E) described above may be a straight chain or branched alkyl group, and examples thereof include a methyl group, an ethyl group, a propyl group, a butyl group, a pentyl group, a hexyl group, a heptyl group, an octyl group, a nonyl group, a decyl group, a undecyl group, a dodecyl group, a tridecyl group, a tetradecyl group, a pentadecyl group, a hexadecyl group, a heptadecyl group, an octadecyl group, a nondecyl group, an eicosyl group, etc.

Hereafter, suitable substituents for the alkyl group are described using formula (A) as an example. Specific examples of such a substituent are a halogen atom, a cycloalkyl group, an aryl group, and an ester group. Examples of the substituted alkyl groups are: $—C_2H_4Cl$, $—C_3H_6Cl$, $—C_3H_5Cl_2$, $—C_3H_5Br_2$, $—C_2HF_4$, $—C_5H_3F_8$, $—C_3H_5ClBr$, etc., for the halogen (F, Cl or Br)-substituted alkyl groups;

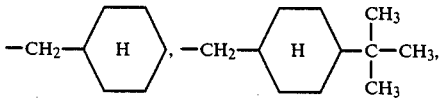

etc., for the cycloalkyl group-substituted alkyl groups; and

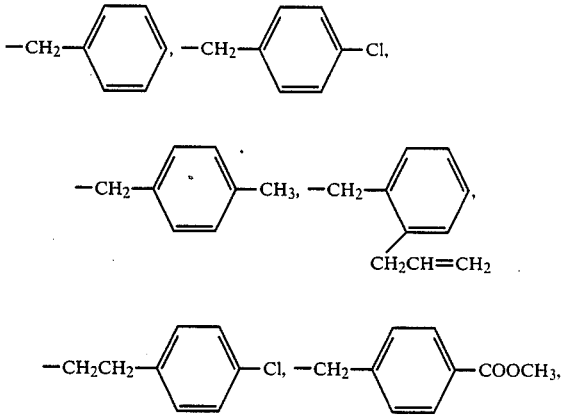

etc.; for the aryl group-substituted alkyl groups.

Furthermore, suitable substitutents for the alkyl group are described above using formula (B) as an example. Examples of such substituents are a halogen atom, a cycloalkyl group, an aryl group, and an ester group. Examples of the substituted alkyl groups are: $—C_2HF_4$, $—C_5H_3F_8$, $—C_9H_3F_{16}$, $—C_2H_4Cl$, $—C_3H_6Cl$, $—C_3H_5Cl_2$, $—C_3H_5ClBr$, $—C_3H_5Br_2$, etc.; for halogen atom (F, Cl or Br)-substituted alkyl groups;

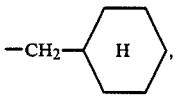

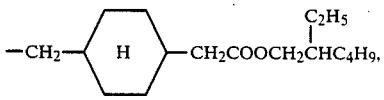

etc.; for the cycloalkyl-substituted alkyl groups;

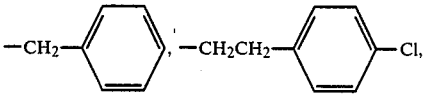

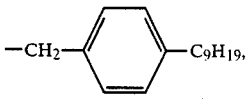

etc.; for the aryl group-substituted alkyl groups;

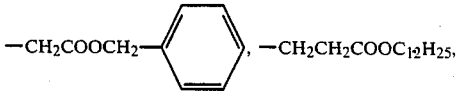

$—(CH_2)_4COOCH_2—(CF_2)_7H$, $—(CH_2)_7COOC_4H_9$,

-continued

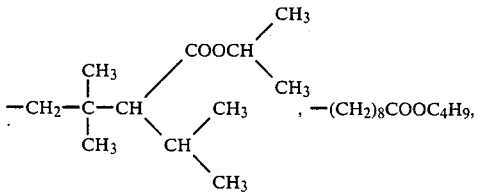

etc.; for the substituents resulting in esters of a dibasic acid;

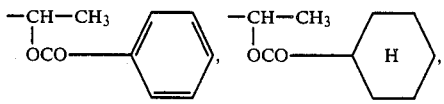

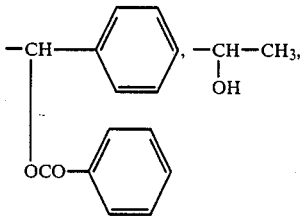

etc., for the substituents resulting in lactic acid esters, etc.;

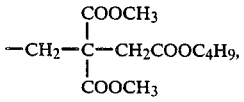

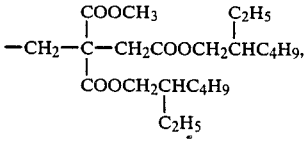

etc; for the substituents resulting in citric acid esters, etc.; $-CH_2CH(OH)-COOC_6H_{13}$, etc.; for the substituents resulting in malic acid esters, etc.; and

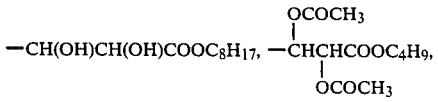

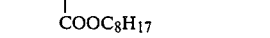

etc., for the substituents resulting in tartaric acid esters, etc.

In formulae (C) to (E) shown above, the alkyl group may be substituted by the substituents described as suitable for the alkyl group in formula (A).

Specific examples of the condensed ring which is formed by $W_1$ and $W_2$ in formula (E) are an oxirane ring, an oxorane ring, an oxane ring.

Examples of the cycloalkyl group respresented by $W_1$, $W_2$, $W_3$ or $W_4$ include:

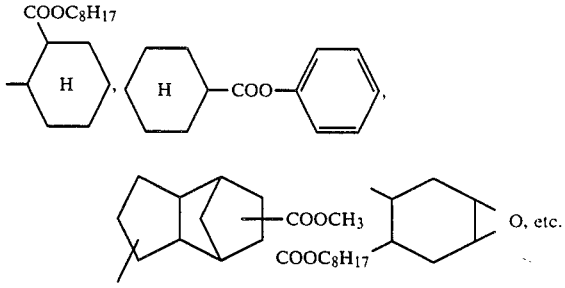

Examples of the aryl group represented by $W_1$, $W_2$, $W_3$ or $W_4$ include:

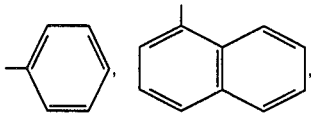

etc., and

Examples of the substituted aryl group are:

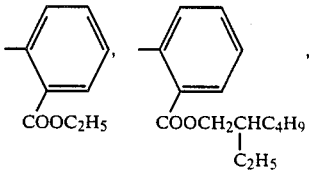

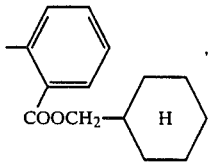

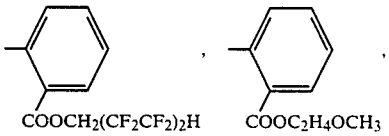

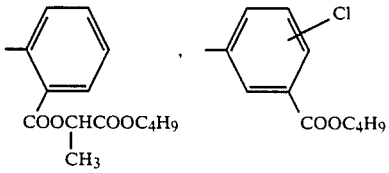

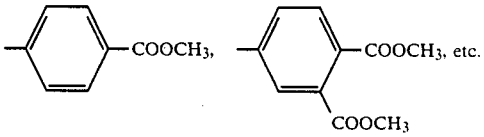

When $W_1$ of formula (B) described above in one of the substituted aryl groups shown immediately above, the compound represented by formula (B) becomes the ester of phthalic acid, iso-phthalic acid, terephthalic acid or trimellitic acid as described above.

When $W_1$ of formula (B) is a substituted aryl group such as

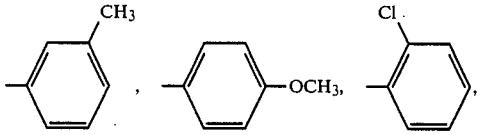

etc., the compound represented by formula (B) becomes a substituted benzoic acid ester.

Examples of the alkenyl group are $-C_4H_7$, $-C_5H_9$, $-C_6H_{11}$, $-C_7H_{13}$, $-C_8H_{15}$, $-C_{10}H_{19}$, $-C_{12}H_{23}$, $-C_{18}H_{35}$, etc.

Also, examples of suitable substituents when the alkenyl group is substituted are a halogen atom (e.g., fluorine, chlorine, and bromine),

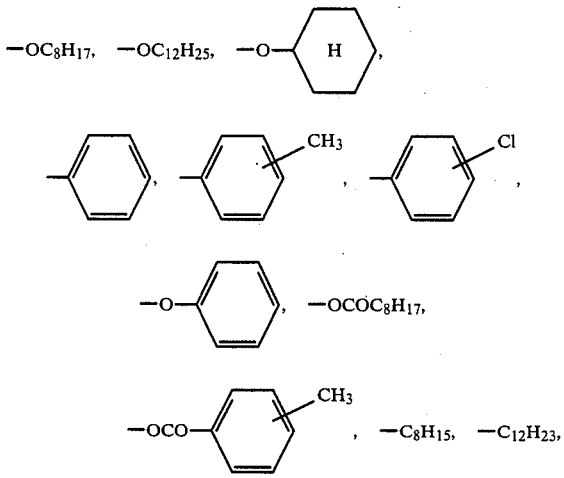

etc.

Specific examples of the substituted alkenyl group are

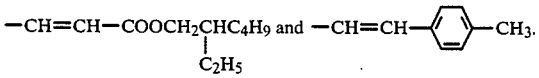

Examples of the heterocyclic group represented by $W_1$, $W_2$, $W_3$ or $W_4$ include:

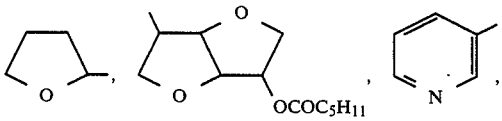

etc.

Of the high-boiling organic solvents shown by formulae (A), (B), (C), (D) and (E) described above, the high-boiling organic solvent shown by formula (A) is preferred.

The high-boiling organic solvents shown by formulae (A), (B), (C), (D), and (E) described above can be used alone or in admixture, or may also be used in combination with one or more other high-boiling organic solvents in amounts sufficient to attain the purposes of the present invention.

Examples of the high-boiling organic solvents which can be used in the high-boiling organic solvents shown by the above-described formulae (A) through (E) are phenol series solvents such as 2,5-di-tert-amylphenol, 2,5-di-secamylphenol, p-octylphenol,

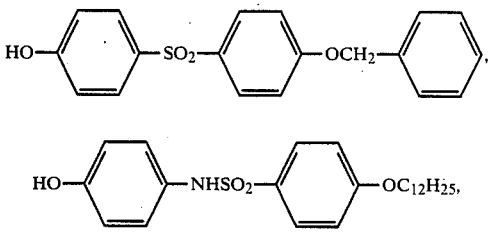

etc.; carbonic acid ester series solvents such as

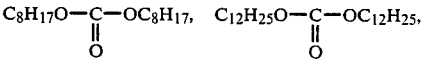

etc.; phosphorous acid ester series solvents such as

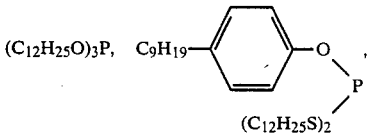

etc.; phosphorous-containing series solvents such as

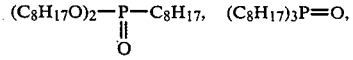

etc.; paraffinic solvents such as chlorinated paraffin, etc.; alcohol series solvents such as

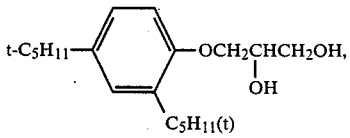

etc.; and nitrogen-containing solvents such as

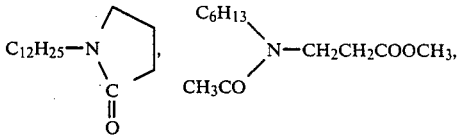

etc.

Specific examples of the high-boiling organic solvents shown by formulae (A), (B), (C), (D), and (E) described above are illustrated below, but the present invention is not to be construed as being limited to these compounds.

$$O{=}P(OC_4H_9(n))_3 \qquad \text{(P-1)}$$

-continued
(P-2)
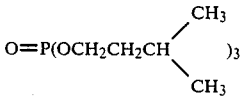
(P-3)
$O{=}P(OC_6H_{13}(n))_3$
(P-4)
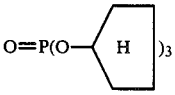
(P-5)
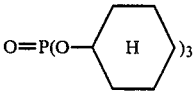
(P-6)
$O{=}P(OC_8H_{17}(n))_3$
(P-7)
$O{=}P(OCH_2CHC_4H_9(n))_3$ ($C_2H_5$)
(P-8)
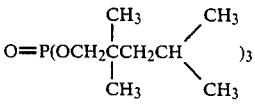
(P-9)
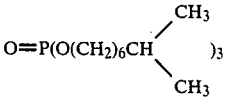
(P-10)
$O{=}P(OC_9H_{19}(n))_3$
(P-11)
$O{=}P(OCH(CH_2)_6CH_3)_3$ ($CH_3$)
(P-12)
$O{=}P(OC_{10}H_{21}(n))_3$
(P-13)
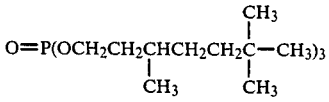
(P-14)
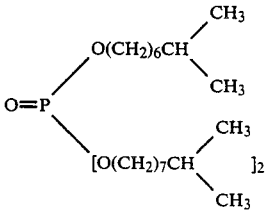
(P-15)
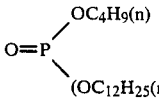
(P-16)
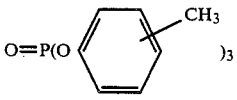
(P-17)
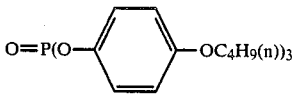
-continued
(P-18)
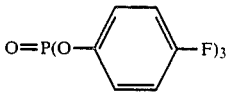
(P-19)
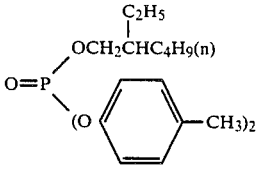
(P-20)
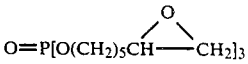
(P-21)
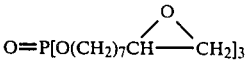
(P-22)
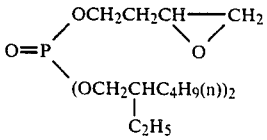
(P-23)
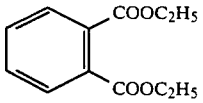
(P-24)
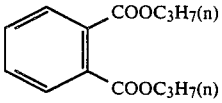
(P-25)
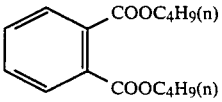
(P-26)
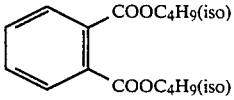
(P-27)
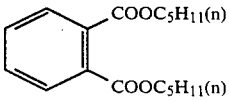
(P-28)
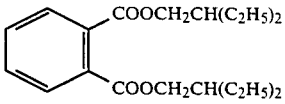
(P-29)
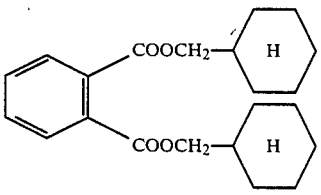

-continued
(P-30)
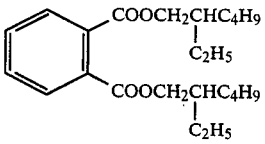
(P-31)
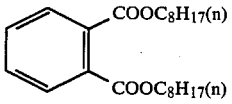
(P-32)
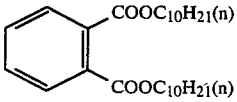
(P-33)
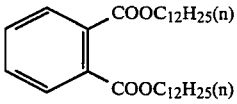
(P-34)
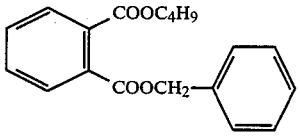
(P-35)
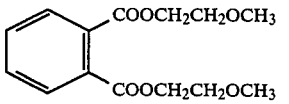
(P-36)
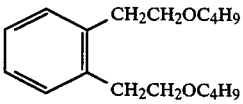
(P-37)
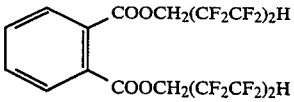
(P-38)
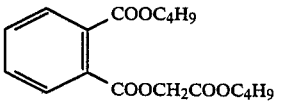
(P-39)
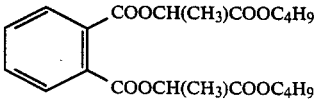
(P-40)
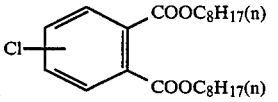
(P-41)
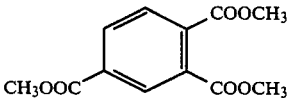
(P-42)
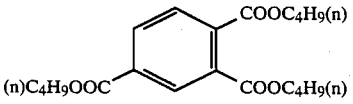
-continued
(P-43)
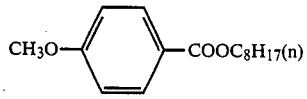
(P-44)
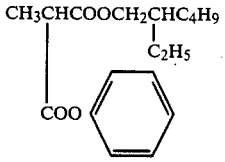
(P-45)
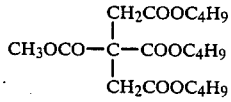
(P-46)
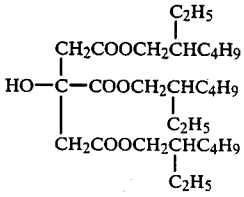
(P-47)
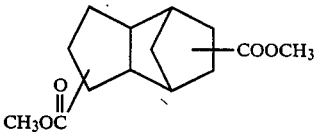
(P-48)
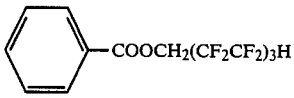
(P-49)
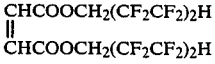
(P-50)
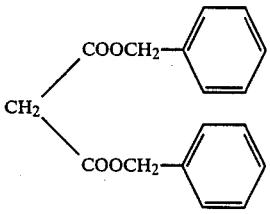
(P-51)
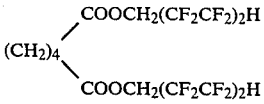
(P-52)
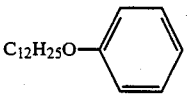
(P-53)
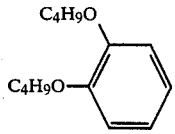

-continued
(P-54)
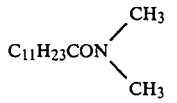
(P-55)
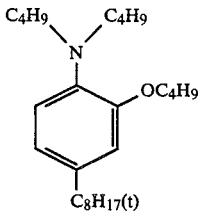
(P-56)
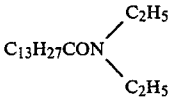
(P-57)
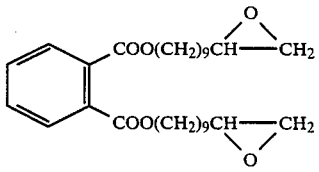
(P-58)
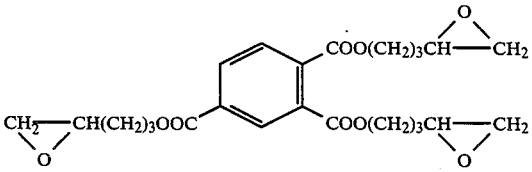
(P-59)
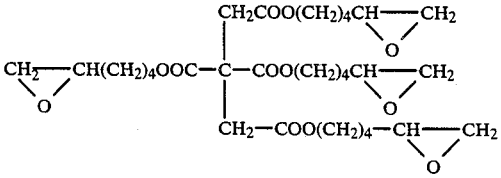
(P-60)
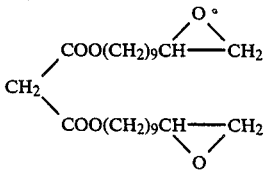
(P-61)
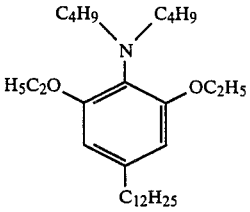
(P-62)
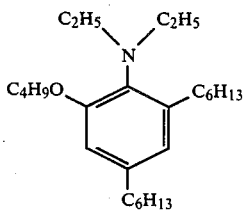
-continued
(P-63)
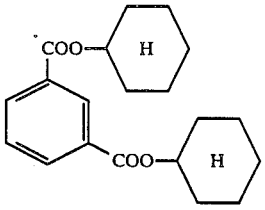
(P-64)
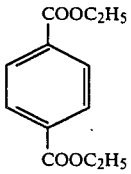
(P-65)
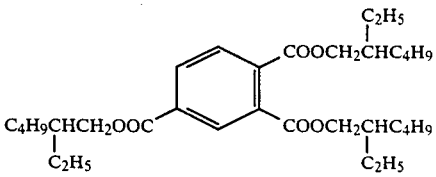
(P-66)
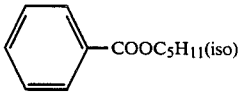
(P-67)
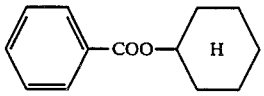
(P-68)
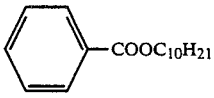
(P-69)
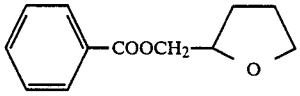
(P-70)
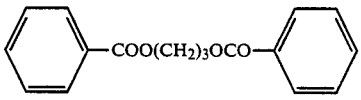
(P-71)
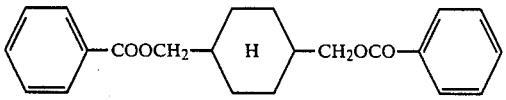
(P-72)
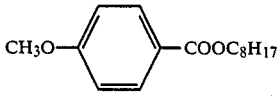
(P-73)
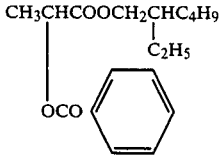

-continued

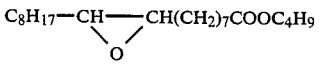

(P-74)

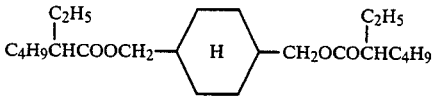

(P-75)

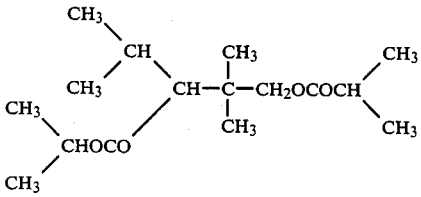

(P-76)

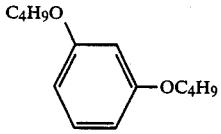

(P-77)

$C_{12}H_{25}OC_{12}H_{25}$ (P-78)

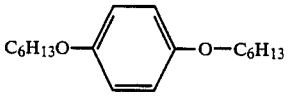

(P-79)

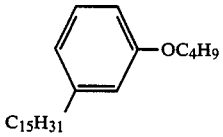

(P-80)

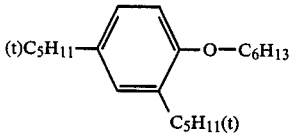

(P-81)

$C_{16}H_{33}OC_{16}H_{33}$ (P-82)

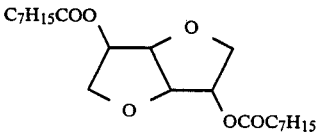

(P-83)

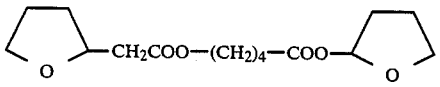

(P-84)

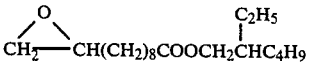

(P-85)

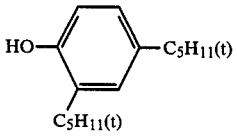

(P-86)

-continued

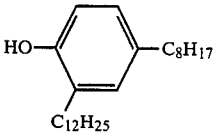

(P-87)

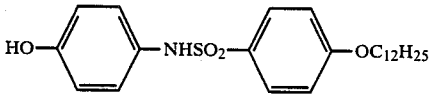

(P-88)

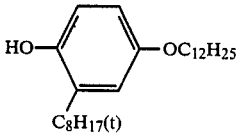

(P-89)

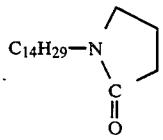

(P-90)

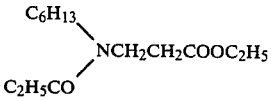

(P-91)

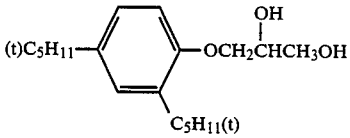

(P-92)

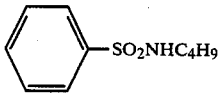

(P-93)

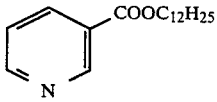

(P-94)

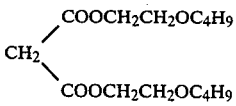

(P-95)

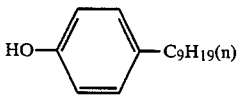

(P-96)

Gelatin is most suitably used as the hydrophilic colloid which is used as the binder for the color photographic materials in this invention. Suitable types of gelatin include so-called alkali-processed gelatin which undergoes treatment with lime, etc., during the step of being induced from collagen; so-called acid-processed gelatin which undergoes treatment with hydrochloric acid, etc.; so-called enzyme-processed gelatin which undergoes treatment with a hydrolase, etc.; so-called gelatin derivatives and modified gelatin formed by treating or modifying the amino group, imino group, hydroxy group or carboxy group contained in the gelatin molecule as a functional group with a reagent having one group capable of reacting with the functional group; etc. Also, gelatin having specific molecular weight distribution as described in Japanese Patent Application (OPI) No. 80838/85 (the term "OPI" as used herein means an "unexamined published patent application") can be used as the binder.

In above-described formula (F) representing the ultraviolet absorbents for use in the present invention, $R_1$, $R_2$, $R_3$, $R_4$ and $R_5$, which may be the same or different, each represents a hydrogen atom or a substituent such as, specifically, an alkyl group (e.g., a methyl group, an ethyl group, a propyl group, an isopropyl group, a butyl group, a sec-butyl group, a tert-butyl group, a pentyl group, a sec-butyl group, a tert-pentyl group, a hexyl group, a sec-hexyl group, a tert-hexyl group, a heptyl group, a sec-heptyl group, a tert-heptyl group, an octyl group, a sec-octyl group, a tert-octyl group, a decyl group, etc.), an aromatic group (e.g., a phenyl group, a naphthyl group, etc), a cyclic alkyl group (e.g., a cyclopentyl group, a cyclohexyl group, an adamantan group, etc.), a halogen atom (e.g., chlorine, bromine, iodine, fluorine, etc.), a nitro group, an amino group, a cyano group, an alkoxy group (e.g., a methoxy group, an ethoxy group, a propoxy group, an octyloxy group, etc.), a heterocyclic group (e.g., a pyridyl group, furanyl group, an imidazolyl group, a pyrazolyl group, a thiazolyl group, etc.), etc., and these groups each may have a further substituent.

The compounds represented by formula (F) may form a polymer through $R_1$, $R_2$, $R_3$, $R_4$ or $R_5$ and in this case, the polymer may contain a suitable polymerizing unit as a comonomer.

The compounds represented by formula (F) may be used alone or in admixture.

The compounds represented by formula (F) can be produced according to the methods described in Japanese Patent Publication No. 29620/75, Japanese Patent Application (OPI) Nos. 151149/65 and 95233/79, U.S. Pat. No. 3,766,205, European Pat. No. 0057,160, *Research Disclosure,* Vol. 225, No. 22519 (1983), etc.

Specific examples of the compounds represented by formula (F) described above are illustrated below; however, the present invention should not be construed as being limited to these compounds.

The residue

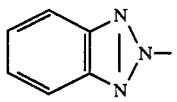

shown in the following specific compounds can take a residue

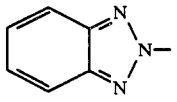

as a resonance structure.

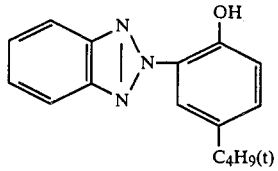
(UV-1)

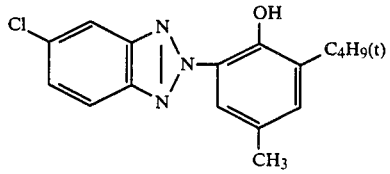
(UV-2)

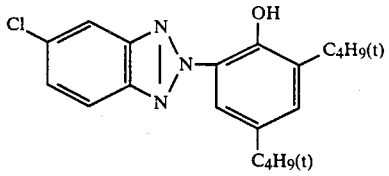
(UV-3)

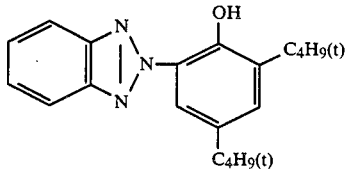
(UV-4)

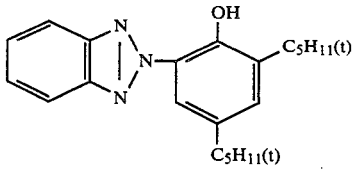
(UV-5)

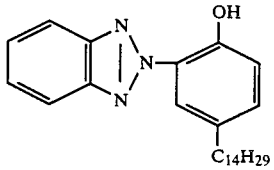
(UV-6)

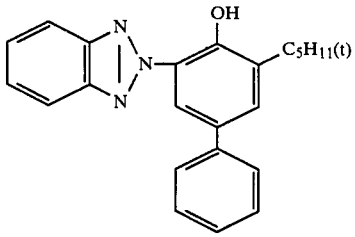
(UV-7)

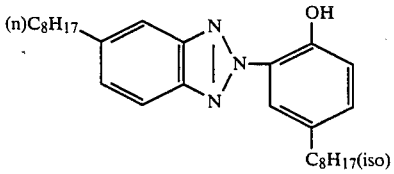
(UV-8)

-continued

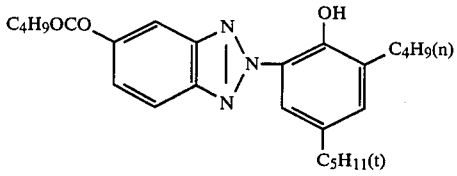

(UV-9)

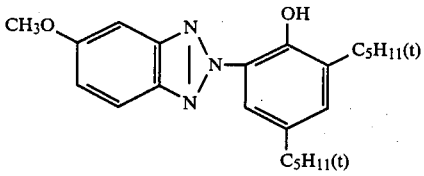

(UV-10)

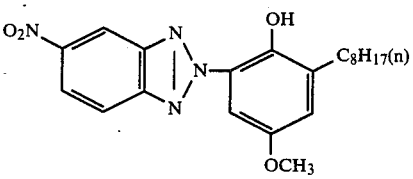

(UV-11)

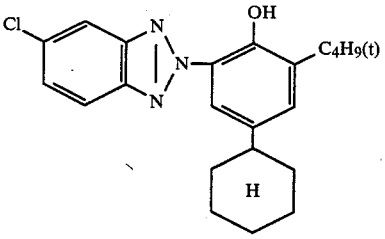

(UV-12)

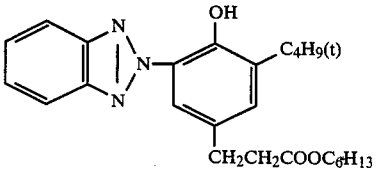

(UV-13)

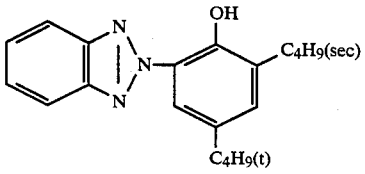

(UV-14)

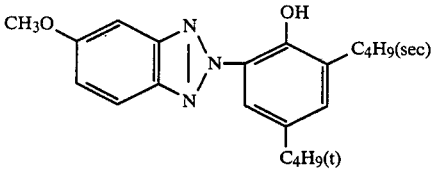

(UV-15)

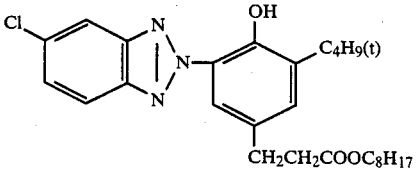

(UV-16)

-continued

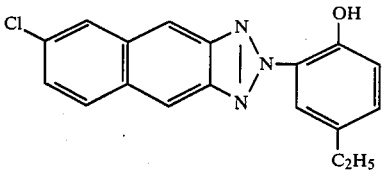

(UV-17)

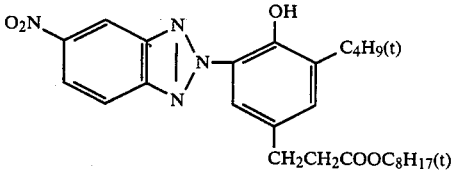

(UV-18)

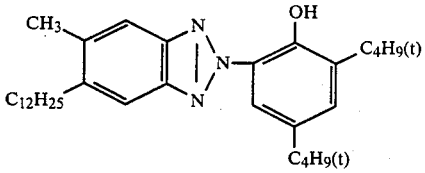

(UV-19)

The couplers for use in the present invention are oil-soluble hydrophobic couplers, and any couplers which are of an oil-soluble hydrophobic nature and can provide the desired effects of the present invention can be used.

For example, cyan couplers include phenols and naphthols; magenta couplers include 5-pyrazolones, pyrazoloazoles such as pyrazolotriazoles etc., pyrazolobenzimidazoles, and cyanoacetyles; and yellow couplers include pivaloylacetanilides and benzylacetanilides. Among these couplers, phenols are preferred as cyan couplers, 3-anilino-5-pyrazolones and pyrazolotriazoles are preferred as magenta couplers, and α-pivaloylacetanilides are preferred as yellow couplers. In particular, the couplers represented by following formulae (I) to (V) are preferably used in this invention:

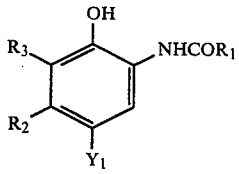

(I)

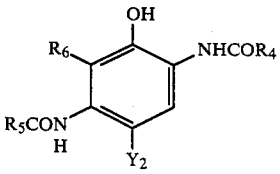

(II)

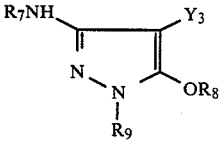

(III)

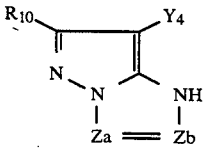

(IV)

-continued

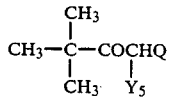

(V)

In the formulae, $R_1$, $R_4$, and $R_5$, which may be the same or different, each represents an aliphatic group, an aromatic group, a hetercyclic group, an aromatic amino group or a heterocylic amino group; $R_2$ represents an aliphatic group; $R_3$ and $R_6$, which may be the same or different, each represents a hydrogen atom, a halogen atom, an aliphatic group, an aliphatic oxy group, or an acylamino group; $R_7$ and $R_9$, which may be the same or different, each represents a substituted or unsubstituted phenyl group; $R_8$ represents a hydrogen atom, an aliphatic acyl group, an aromatic acyl group, an aliphatic sulfonyl group, or an aromatic sulfonyl group; $R_{10}$ represents a hydrogen atom or a substituent; Q represents a substituted or unsubstituted N-phenylcarbamoyl group; Za and Zb, which may be the same or different, each represents a methine group, a substituted methine group, or =N—; and $Y_1$, $Y_2$, $Y_3$, $Y_4$, and $Y_5$, which may be the same or different, each represents a hydrogen atom or a group releasable upon undergoing a coupling reaction with the oxidation product of a developing agent (hereinafter, the group is referred to as releasing group).

In formulae (I) and (II) described above, $R_2$ and $R_3$, or $R_5$ and $R_6$ may bond together to form a 5-, 6- or 7-membered ring.

Furthermore, the compounds represented by general formulae (I) to (V) described above may form a dimer or a polymer at $R_1$, $R_2$, $R_3$, or $Y_1$ of formula (I), $R_4$, $R_5$, $R_6$, or $Y_2$ of formula (II), $R_7$, $R_8$, $R_9$, or $Y_3$ of formula (III), $R_{10}$, Za, Zb, or $Y_4$ of formula (IV), or Q or $Y_5$ of formula (V).

The aliphatic group mentioned above is a straight chain, branched, or cyclic alkyl, alkenyl or alkinyl group.

$R_1$ to $R_{10}$, $Y_1$ to $Y_5$, Za, Zb, and Q in formulae (I), (II), (III), (IV) and (V) are described below in further detail.

When $Y_1$, $Y_2$, $Y_3$, $Y_4$, or $Y_5$ in formula (I), (II), (III), (IV) or (V) represents a releasing group, examples of the releasing group include a group bonding an aliphatic group, an aromatic group, a heterocylic group, an aliphatic sulfonyl group, an aromatic sulfonyl group, a heterocyclic sulfonyl group, an aliphatic carbonyl group, an aromatic carbonyl group, or a heterocyclic group to the coupling active carbon atom through an oxygen atom, a nitrogen atom, a sulfur atom, or a carbon atom; a halogen atom; an aromatic azo group, etc. The aliphatic, aromatic, or heterocylic group included within the scope of the releasing groups may be substituted by a substituent suitable for $R_1$ (described hereinafter). When the releasing group comprises two or more substituents, these substituents may be the same or different, and further, these substituents may also have a substituent suitable for $R_1$ (described hereinafter).

Specific examples of the releasing group include a halogen atom (e.g., a fluorine atom, a chlorine atom, a bromine atom, etc.), an alkoxy group (e.g., an ethoxy group, a dodecyloxy group, a methoxyethylcarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), an aliphatic or aromatic sulfonyloxy group (e.g., a methanesulfonyloxy group, a toluene-sulfonyloxy group, etc.), an acylamino group (e.g., a dichloroacetylamino group, a heptafluorobutyrylamino group, etc.), an aliphatic or aromatic sulfonamido group (e.g., a methanesulfonamido group, p-toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic, aromatic, or heterocyclic thio group (e.g., an ethylthio group, a phenylthio group, a tetrazolylthio group, etc.), a carbamoylamino group (e.g. an N-methylcarbamoylamino group, an N-phenylcarbamoylamino group, etc.), a 5-membered or 6-membered nitrogen-containing heterocyclic group (e.g., an imidazolyl group, a pyrazolyl group, a triazolyl group, a tetrazolyl group, a 1,2-dihydro-2-oxo-1-pyridyl group, etc.), an imido group (e.g., a succinimido group, a hydantoinyl group, etc.), an aromatic azo group (e.g., a phenylazo group, etc.), etc. These groups may be further substituted by a substituent suitable as a substituent for $R_1$ (described hereinafter). Also, the releasing group bonded through a carbon atom includes bis-type couplers obtained by condensing a 4-equivalent coupler with aldehydes or ketones. The releasing group of the present invention may contain a photographically useful group such as development inhibitor, development accelerator, etc. Preferred combinations of the releasing groups represented in each of the formulae described above will be described hereinafter.

Examples of the releasing groups other than halogen atoms are described in Japanese Patent Application (OPI) Nos. 26133/72, 58922/77, 90932/77, 161239/80, Japanese Patent Publication No. 45135/81, Japanese Patent Application (OPI) Nos. 174839/84, 178459/84, 288649/84, 69653/85, U.S. Pat. Nos. 3,408,194, 3,447,928, 3,542,840, 3,894,875, 3,994,967, 4,401,752, Japanese Patent Publication Nos. 25933/73, 12660/74, 13576/74, 33410/76, 5988/81, 7222/81, 37859/82, U.S. Pat. No. 4,133,958, Japanese Patent Application (OPI) Nos. 159336/85, 3232/76, 20826/76, 62454/80, 35858/82, 23855/85, 118034/80, 129035/78, 32071/80, 214854/84, 231538/84, 35730/85, 49336/85, 1938/81, 91355/85, U.S. Pat. Nos. 3,311,476, 3,227,554, 3,476,563, 3,758,308, 3,458,315, 3,839,044, 3,737,316, Japanese Patent Application (OPI) Nos. 95346/83, 10135/75, 117442/75, Japanese Patent Publication Nos. 37822/79, 6539/81, 21257/79, Japanese Patent Application (OPI) No. 20023/77, etc.

In formulae (I) and (II) described above, $R_1$, $R_4$ and $R_5$, which may be the same or different, each represents an aliphatic group preferably containing 1 to 36 carbon atoms, an aromatic group preferably containing 6 to 36 carbon atoms (e.g., a phenyl group, a naphthyl group, etc.), a heterocyclic group (e.g., a 3-pyridyl group, a 2-furyl group, etc.), or an aromatic or heterocyclic amino group (e.g., an anilino group, a naphthylamino group, a 2-benzothiazolylamino group, a 2-pyridylamino group, etc.) and these groups may be further substituted by an alkyl group, an aryl group, a heterocyclic group, an alkoxy group (e.g., a methoxy group, a 2-methoxyethoxy group, etc.), an aryloxy group (e.g., a 2,4-di-tert-amylphenoxy group, a 2-chlorophenoxy group, a 4-cyanophenoxy group, etc.), an alkenyloxy group (e.g., a 2-propenyloxy group, etc.), an acyl group (e.g., an acetyl group, a benzoyl group, etc.), an ester group (e.g., a butoxycarbonyl group, a phenoxycarbonyl group, an acetoxy group, a benzoyloxy group, a butoxysulfonyl group, a toluenesulfonyloxy group, etc.), an amido group (e.g., an acetylamino group, an ethylcarbamoyl group, a dimethylcarbamoyl group, a methanesulfonamido group, a butylsulfamoyl group, etc.), a sulfamido group (e.g., a dipropylsulfamoylamino group, etc.), an imido group (e.g., a succinimido group, a hydantoinyl group, etc.), a ureido group (e.g., a phenylureido group, a dimethylureido group, etc.), an aliphatic or aromatic sulfonyl group (e.g., a methanesulfonyl group, a phenylsulfonyl group, etc.), an aliphatic or aromatic thio group (e.g., an ethylthio group, a phenylthio group, etc.), a hydroxy group, a cyano group, a carboxy group, a nitro group, a sulfo group, a halogen atom, etc.

The term "aliphatic group" as used herein means a straight chain, branched or cyclic aliphatic hydrocarbon group including saturated or unsaturated alkyl, alkenyl, alkinyl groups, etc. Specific examples thereof include a methyl group, an ethyl group, a butyl group, a dodecyl group, an octadecyl group, an eicosenyl group, an iso-propyl group, a tert-butyl group, a tert-octyl group, a tert-dodecyl group, a cyclohexyl group, a cyclopentyl group, an allyl group, a vinyl group, a 2-hexadecenyl group, a propagyl group, etc.

In formula (I) described above, $R_2$ represents an aliphatic group having preferably from 1 to 20, more preferably from 2 to 15, carbon atoms and may be substituted by a substituent suitable for $R_1$ in formula (I).

In formulae (I) and (II), $R_3$ and $R_6$, which may be the same or different, each represents a hydrogen atom, a halogen atom (e.g., a fluorine atom, a chlorine atom, a bromine atom, etc.), an aliphatic group preferably having from 1 to 20 carbon atoms, an aliphatic oxy group preferably having from 1 to 20 carbon atoms, or an acylamino group having from 1 to 20 carbon atoms (e.g., an acetamido group, a benzamido group, a tetradecanamido group, etc.). These aliphatic groups, aliphatic oxy groups, and acylamino groups may also have a further substituent suitable for $R_1$ in formula (I).

In formula (I), $R_2$ and $R_3$ may bond together to form a 5- to 7-membered ring such as

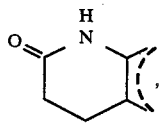

etc., wherein a hydrogen atom linking to a nitrogen atom may be substituted with a substituent such as an alkyl group, etc.

In formula (II), $R_5$ and $R_6$ may bond together to form a 5-membered to 7-membered ring such as

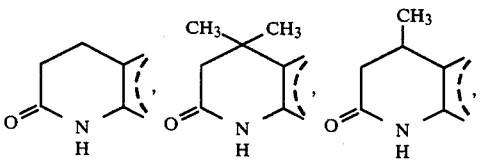

-continued

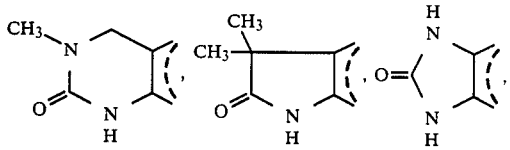

etc., wherein a hydrogen atom linking to a nitrogen atom may be substituted with a substituent such as an alkyl group, etc.

The couplers represented by formula (I) or formula (II) may form a dimer or a polymer coupler alone or together at one of $R_1$, $R_2$, $R_3$, and $Y_1$ or at one of $R_4$, $R_5$, $R_6$, or $Y_2$, respectively.

When the coupler forms a dimer, each of the aforesaid groups is a bond or a divalent linkage group (e.g., divalent groups such as an alkylene group, an arylene group, an ether group, an ester group, an amido group, etc., a combination thereof, etc.) and when the coupler forms a higher oligomer or a polymer, each of the groups is the main chain of the polymer. In a coupler polymer, it is preferred that the coupler is bonded to the main chain of a polymer through the divalent group as described above with respect to the dimer. When the coupler forms a polymer, the polymer may be a homopolymer of a coupler derivative or a copolymer of a coupler derivative and one or more non-coloring ethylenically unsaturated monomers (e.g., acrylic acid, methacrylic acid, methyl acrylate, n-butylacrylamide, β-hydroxy methacrylate, vinyl acetate, acrylonitrile, styrene, crotonic acid, maleic anhydride, N-vinylpyrrolidone, etc.).

$R_1$ in formula (I) and $R_5$ in formula (II) are preferably a substituted or unsubstituted alkyl group or a substituted or unsubstituted aryl group. Particularly preferred substituents for the alkyl group are a phenoxy group which may be substituted (by a substituent such as an alkyl group, an alkoxy group, a halogen atom, a sulfonamido group, a sulfamido group, etc.) and a halogen atom. Also, as the substituted aryl group, a phenyl group substituted by at least one halogen atom, alkyl group, sulfonamido group, or acylamino group serve as examples thereof.

$R_4$ in formula (II) is preferably a substituted alkyl group or a substituted or unsubstituted aryl group. A particularly preferred substituent for the alkyl group is a halogen atom. As the aryl group, a phenyl group is particularly preferred, and as the substituted aryl group, a phenyl group substituted by at least one halogen atom or sulfonamido group is particularly preferred.

$R_2$ in formula (I) is preferably an alkyl group having 2 to 15 carbon atoms, which may be substituted. Preferred substituents for the alkyl group include an alkyloxy group, an aryloxy group, an acylamino group, an alkylthio group, an arylthio group, an imido group, a ureido group, an alkylsulfonyl group, and an arylsulfonyl group.

$R_3$ in formula (I) is preferably a hydrogen atom, a halogen atom (particularly, a fluorine atom and a chlorine atom), or an acylamino group, and is particularly preferably a halogen atom.

$R_6$ in formula (II) is preferably a hydrogen atom, an alkyl group having 1 to 20 carbon atoms or an alkenyl group, and is particularly preferably a hydrogen atom.

$R_5$ and $R_6$ in general formula (II) preferably form a 5-membered or 6-membered nitrogen-containing heterocyclic ring.

It is more preferred that $R_2$ in formula (I) described above is an alkyl group having 2 to 4 carbon atoms.

$Y_1$ and $Y_2$ in formulae (I) and (II) each is preferably a halogen atom, more preferably a chlorine atom.

The couplers represented by formulae (I) and (II) described above may be used alone or in combination.

As is known in this field of the art, the magenta coupler represented by formula (III) has the keto-enol type of tautomerism described below when $R_8$ is a hydrogen atom. Thus, the structure of the left side in the following equation is equivalent to the structure of the right side:

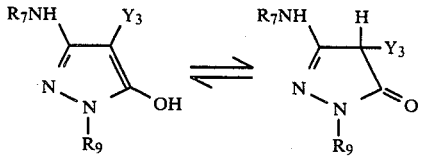

In formula (III) described above, the substituents suitable for $R_9$ and $R_7$ are same as the substituents suitable for the aromatic group represented by $R_1$ described above, and when $R_9$ and $R_7$ each has two or more substituents, the substituents may be the same or different.

$R_8$ in formula (III) is preferably a hydrogen atom, an aliphatic acyl group, or an aliphatic sulfonyl group, and is particularly preferably a hydrogen atom. Also, $Y_3$ in formula (III) is preferably a group of a type releasing by a sulfur atom, an oxygen atom or a nitrogen atom and is particularly preferably a sulfur atom-linked releasing group.

The couplers represented by formula (IV) described above is a 5-membered-5-membered condensed nitrogen-containing heterocyclic type coupler (hereinafter, is referred to as 5,5-N-heterocyclic coupler) and the coloring mother nucleus has an aromaticity isoelectric to naphthalene and has a chemical structure usually referred to as azepenthalene.

Preferred examples of the couplers represented by formula (IV) are 1H-imidazo[1,2-b]pyrazoles, 1H-pyrazo[5,1-c][1,2,4]triazoles, 1H-pyrazolo[1,5-b][1,2,4]triazoles, and 1H-pyrazolo[1,5-d]tetrazoles, which are represented by the following formulae (IV-1), (IV-2), (IV-3) and (IV-4), respectively. Of these magenta couplers, the couplers by formula (IV-2) or (IV-3) are preferred, and the couplers represented by formula (IV-3) are particularly preferred:

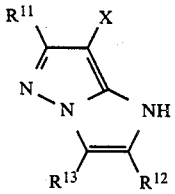

(IV-1)

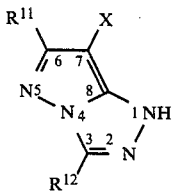

(IV-2)

-continued

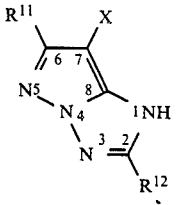

(IV-3)

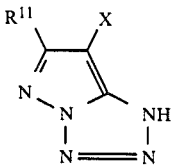

(IV-4)

The couplers represented by formulae (IV-1) to (IV-4) are explained in detail hereinbelow.

$R^{11}$, $R^{12}$ and $R^{13}$, which may be the same or different, each represents a hydrogen atom, a halogen atom, a cyano group, the same groups as defined above for $R_1$ in formula (I),

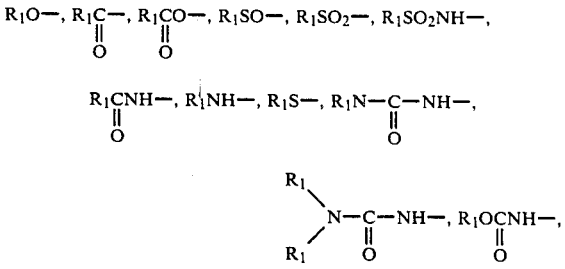

a silyl group, a silyloxy group, a silylamino group or an imido group, $R^{11}$, $R^{12}$ and $R^{13}$ each may further represent a carbamoyl group, a sulfamoyl group, a ureido group, or a sulfamoylamino group, and the nitrogen atom of the aforesaid groups may be substituted by the substituents suitable for $R_1$ as described hereinbefore. X in the above formulae (IV-1) to (IV-4) has the same definition as set forth above for $Y_4$. Also, $R^{11}$, $R^{12}$, $R^{13}$ or X may become a divalent group to form a dimer or may become a group linking the coupler mother nucleus to the main chain of a polymer.

$R^{11}$, $R^{12}$, and $R^{13}$ each preferably represents a hydrogen atom, a halogen atom, the substituents as defined above for $R_1$ in formula (I), $R_1O$—, $R_1CONH$—, $R_1SO_2NH$—, $R_1NH$—, $R_1S$—, $R_1NHCONH$—,

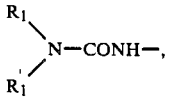

or $R_1OCONH$—.

Also, X is preferably a halogen atom, an acylamino group, an imido group, an aliphatic sulfonamido group, an aromatic sulfonamido group, a 5-membered or 6-membered nitrogen-containing heterocyclic group bonded to the coupling active position by the nitrogen atom, an aryloxy group, an alkoxy group, an arylthio group or an alkylthio group. Furthermore, X particularly preferably represents an arylthio group or an alkylthio group.

$R^{11}$ for formula (IV-2) or (IV-3) described above preferably represents a substituted or unsubstituted alkoxy group, a substituted or unsubstituted aryloxy group, or a substituted or unsubstituted heterocyclic ring oxy group, X for formula (IV-2) or (IV-3) described above preferably represents a sulfer atom-linked releasing group and, $R^{12}$ for formula (IV-2) described above preferably represents a substituted or unsubstituted arylthio group, a substituted or unsubstituted arylthio group, a substituted or unsubstituted alkyl group, or a substituted or unsubstituted aryl group and $R^{12}$ for formula (IV-3) described above preferably represents a substituted or unsubstituted alkyl group, or a substituted or unsubstituted aryl group.

In formula (IV) described above, the substituent for the phenyl moiety of the N-phenylcarbamoyl group represented by Q may be optionally selected from the substituents described above as suitable substituents for the aromatic group defined by $R_1$ and when the phenyl moiety has two or more substituents, each may be the same or different.

Preferred groups for Q in formula (V) are represented by following formula (VA):

(VA)

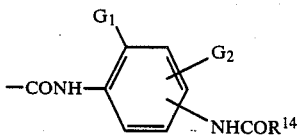

wherein $G_1$ represents a halogen atom or an alkoxy group; $G_2$ represents a hydrogen atom, a halogen atom or an alkoxy group which may have a substituent; and $R^{14}$ represents an alkyl group which may have a substituent.

Substituents for $G_2$ and $R^{14}$ in formula (VA) described above include, for example, an alkyl group, an alkoxy group, an aryl group, an aryloxy group, an amino group, a dialkylamino group, a heterocyclic group (e.g., an N-morpholino group, an N-piperidino group, a 2-furyl group, etc.), a halogen atom, a nitro group, a hydroxy group, a carboxy group, a sulfo group, and an alkoxycarbonyl group.

The preferred releasing groups represented by $Y_5$ in formula (V) described above include the groups shown by formulae (X) to (XVI) described below:

(X)

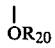

wherein $R_{20}$ represents an aryl group or a heterocyclic group each of which may be substituted;

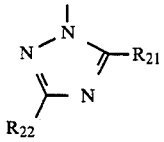

(XI)

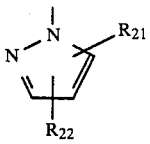

(XII)

wherein $R_{21}$ and $R_{22}$ each may represent a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, a substituted or unsubstituted phenyl group, or a substituted or unsubstituted heterocyclic group, and $R_{21}$ and $R_{22}$ may be the same or different;

(XIII)

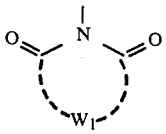

wherein $W_1$ represents a non-metallic atomic group necessary for forming a 4-membered, 5-membered or 6-membered ring together with

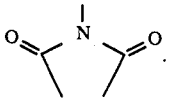

Of the groups represented by formula (XIII) described above, the groups represented by following formulae (XIV) to (XVI) are preferred:

(XIV)

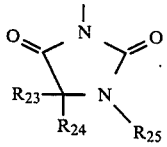

(XV)

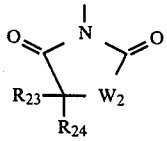

(XVI)

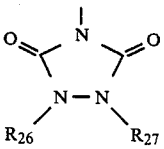

wherein $R_{23}$ and $R_{24}$, which may be the same or different, each represents a hydrogen atom, an alkyl group, an aryl group, an alkoxy group, an aryloxy group or a hydroxy group; $R_{25}$, $R_{26}$, and $R_{27}$, which may be the same or different, each represents a hydrogen atom, an alkyl group, an aryl group, an aralkyl group, or an acyl group; and $W_2$ represents an oxygen atom or a sulfur atom.

The substituents for $Y_5$ in formula (V) described above (preferably, the group represented by $R_{20}$ to $R_{27}$ in formulae (X) to (XVI) described above) or the substituents for Q in formula (V) (preferably, the group represented by $R^{14}$ in formula (VA)) may become a di-valent group to form a dimer or may become a group linking the coupler mother nucleus to the main chain of a polymer.

It is preferred that each of the couplers represented by formulae (I), (II), (III), (IV) and (V) described above contains at least one so-called ballast group for importing diffusion resistance or non-diffusibility thereto. The ballast group would be present at $R_1$, $R_2$, $R_3$ or $Y_1$ in formula (I), $R_4$, $R_5$, $R_6$ or $Y_2$ in formula (II), $R_3$, $R_7$, $R_9$ or $Y_3$ in formula (III), $R_{10}$ or $Y_4$ in formula (IV), or Q or $Y_5$ in formula (V) or could be the substituent for any of these groups in formulae (I) to (V), or be the substituent for Za or Zb in formula (IV).

Specific examples of these ballast groups are described in Japanese Patent Publication Nos. 23902/67, 3660/69, 46384/84, Japanese Patent Application (OPI) Nos. 19435/85, 45442/84, 174836/84, 177553/84, 177554/84, 177555/84, 177556/84, 177557/84, 41042/85, 55340/85, 185951/85, U.S. Pat. Nos. 2,688,544, 2,698,795, 2,772,161; 2,908,573, 2,895,826, 2,920,961, 3,519,429, 4,124,396, 4,443,536, Japanese Patent Publication Nos. 22900/68, 29417/68, 6992/69, 41474/70, 19026/71, 19032/71, 25932/73, 16056/74, Japanese Patent Application (OPI) Nos. 37636/72, 29639/74, 53437/74, 134644/75, 76834/78, 82411/78, 141622/78, 7702/80, 93153/80, 30126/81, 124341/84, U.S. Pat. Nos. 2,186,719, 3,488,193, Japanese Patent Application (OPI) Nos. 4481/72, 8228/74, 110344/74, 20723/75, West German Patent Application (OLS) No. 2,707,488, U.S. Pat. No. 4,458,011, French Pat. No. 1,202,940, U.S. Pat. Nos. 3,133,815, 3,161,512, 3,183,095, 3,547,944, 3,295,747, British Pat. No. 1,128,037, Japanese Patent Publication Nos. 16190/78, 9314/72, Japanese Patent Application (OPI) Nos. 71640/73, 48922/75, 126831/76, 47728/77, 119323/77, 38599/80, etc.

The couplers represented by formulae (I) to (V) described above and the methods for synthesizing the same are described in the following literature.

The cyan couplers represented by formula (I) or (II) can be produced by conventional methods. The cyan couplers represented by formula (I) can be produced by the methods described, for example, in U.S. Pat. Nos. 2,423,730, 3,772,002, etc. Also, the cyan couplers represented by formula (II) can be further produced by the methods described in U.S. Pat. Nos. 2,895,826, 4,333,999, 4,327,173, etc.

The magenta couplers represented by formula (III) can be produced by the methods described, for example, in Japanese Patent Application (OPI) Nos. 74027/74, 74028/74, Japanese Patent Publication Nos. 27930/73, 33846/78, U.S. Pat. No. 3,519,429, etc. Furthermore, the magenta couplers represented by formulae (IV-1), (IV-2), (IV-3) and (IV-4) described above can be produced by the methods described, for example, in Japanese Patent Application (OPI) Nos. 162548/84, 171956/84, 33552/85, U.S. Pat. No. 3,725,067, etc.

The yellow couplers represented by formula (V) can be produced by the methods described, for example, in Japanese Patent Application (OPI) No. 48541/79, Japanese Patent Publication No. 10739/83, U.S. Pat. No. 4,326,024, and *Research Disclosure,* No. 18053 (April 1979), etc.

Specific examples of the cyan couplers represented by formulae (I) and (II) are described in U.S. Pat. Nos. 2,772,162, 2,895,826, 3,772,002, 3,779,763, 3,864,366, 3,998,642, 4,126,396, Japanese Patent Publication No. 38695/85, Japanese Patent Application (OPI) Nos. 20723/75, 10433/81, 105229/83, 166956/84, 24547/85, 159851/85, 9658/84, 139352/84, 9653/86, U.S. Pat. Nos. 4,333,999, 4,427,767, etc.

Specific examples of the magenta couplers represented by formulae (III) and (IV) are described in Japanese Patent Publication Nos. 7039/58, 12836/66, 5747/67, 13215/67, 16110/69, 20637/70, 27930/73, 16058/74, 37746/78, 10492/79, 10063/80, 30615/80, 27896/84, 13730/84, 38696/85, Japanese Patent Application (OPI) Nos. 96335/82, 146251/82, 83044/80, 85724/79, 48539/79, 44927/76, 123033/74, 98025/76, 118034/80, 40825/81, 85749/81, British Pat. No. 2,071,647, U.S. Pat. Nos. 4,310,623, 2,600,788, 3,615,506, 4,283,472, 4,310,618, 3,468,666, 4,336,325, 4,522,915, 4,514,490, 4,513,082, 4,503,141, 3,888,680, 3,441,414, 3,393,071, 4,080,504, 4,230,870, 3,973,979, 4,061,498, 4,062,683, British Patent No. 1,337,456, Japanese Patent Publication Nos. 20636/70, 41473/70, 31460/80, 2942/80, 33846/78, 44421/81, 14741/84, 6100/82, 43738/84, 4898/82, 13730/84, 30265/84, 12169/84, 33905/84, Japanese Patent Application (OPI) Nos. 9122/78, 177555/84, 177556/84, 177557/84, 178460/84, 97354/85, 26541/76, 130339/83, Japanese Patent Publication Nos. 10479/71, 9353/76, U.S. Pat. Nos. 3,199,983, 3,770,447, British Pat. Nos. 1,335,603, 1,247,493, 1,334,515, 1,398,979, U.S. Pat. No. 4,338,393, Japanese Patent Application (OPI) Nos. 3031/72, 42045/83, 107537/83, 115437/83, 134633/83, 57838/85, 55343/85, 98434/85, 107032/85, 168143/85, 168847/85, 99437/84, 125732/84, 162548/84, 171956/84, 178460/84, 22852/84, 33552/85, 35732/85, 43659/85, 140241/85, 262159/85, 38948/86, U.S. Pat. No. 3,725,067, etc.

Specific examples of the yellow couplers represented by formula (V) are described in Japanese Patent Publication Nos. 19955/70, 19956/70, 15873/73, Japanese Patent Application (OPI) Nos. 130442/75, 139738/75, 21827/76, 23933/77, 115219/77, 48541/79, 38576/80, 87041/81, 45442/84, 222837/84, 24547/85, 69653/85, U.S. Pat. Nos. 2,298,443, 2,407,210, 2,710,802, 3,384,657, British Pat. No. 980,507, French Pat. No. 1,558,452, U.S. Pat. Nos. 3,265,506, 3,841,880, 3,894,875, 3,874,948, 4,157,919, 3,664,841, Japanese Patent Publication Nos. 17372/74, 17373/74, U.S. Pat. No. 3,770,446, Japanese Patent Application (OPI) Nos. 99433/79, 7702/80, 30127/81, 74250/81, British Pat. No. 1,434,472, Japanese Patent Application (OPI) Nos. 82332/78, 2300/80, 36900/80, 26133/72, 598/80, 73147/73, 102636/76, 20023/77, 58922/77, 90932/77, 115219/77, 161239/80, 174839/84, British Pat. No. 1,040,710, U.S. Pat. Nos. 3,277,155, 3,277,554, 3,408,194, 3,415,652, 3,447,928, British Pat. No. 1,204,680, Japanese Patent Publication Nos. 8750/72, 25933/73, 13576/74, 10728/75, 10783/76, 7579/80, Japanese Patent Application (OPI) Nos. 53825/76, 127330/77, U.S. Pat. No. 4,182,630, etc.

In a preferred embodiment of the color image forming process of the present invention, the magenta color-forming coupler is a pyrazolotriazole type or 3-amino-5-pyrazolone type 2-equivalent coupler having a coupling releasing group containing a sulfur atom as the releasing atom.

Specific examples of the magenta couplers represented by formula (III) or (IV) described above are illustrated below.

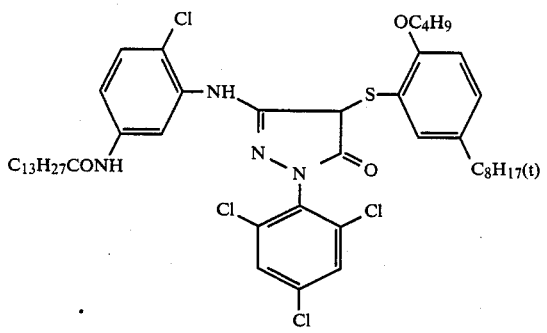
(I-1)
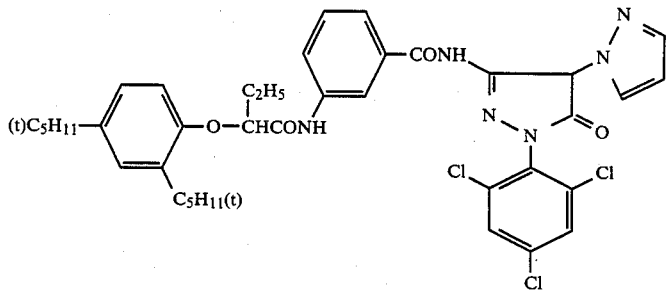
(I-2)
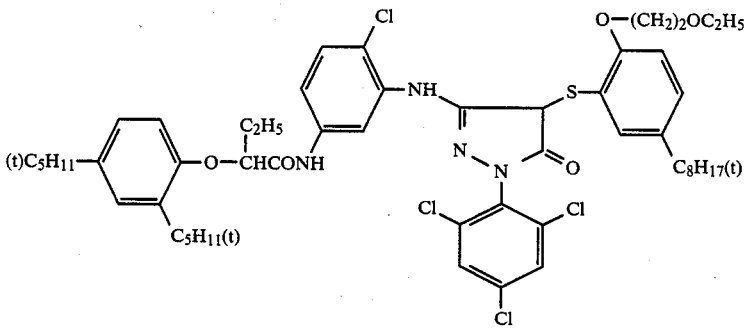
(I-3)
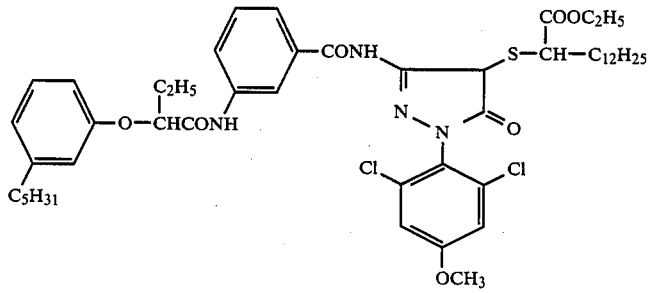
(I-4)
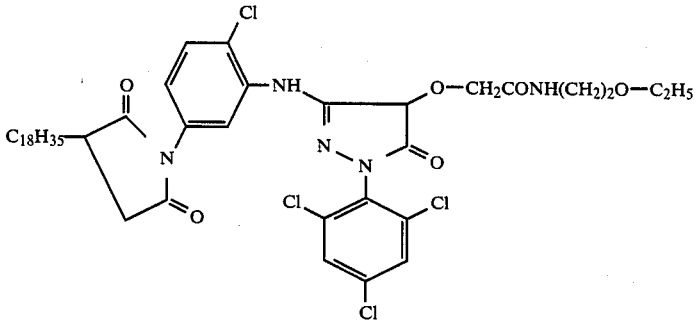
(I-5)

-continued
(I-6)
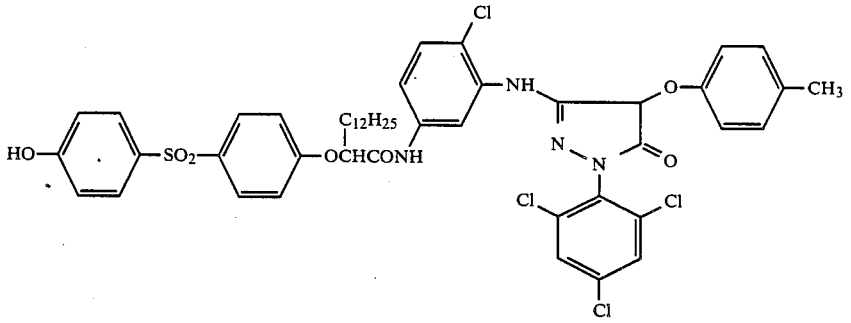
(I-7)
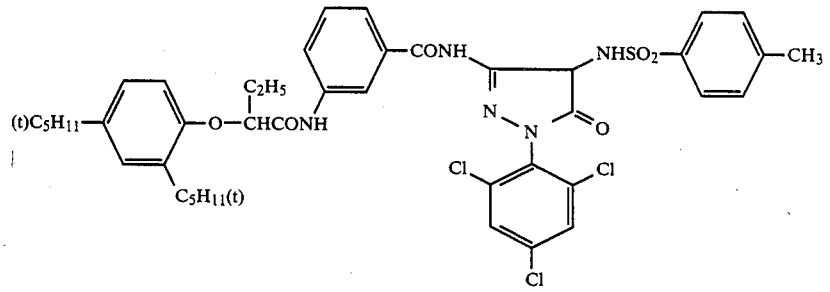
(I-8)
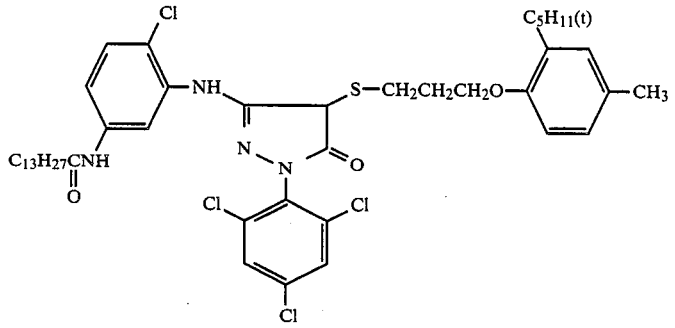
(I-9)
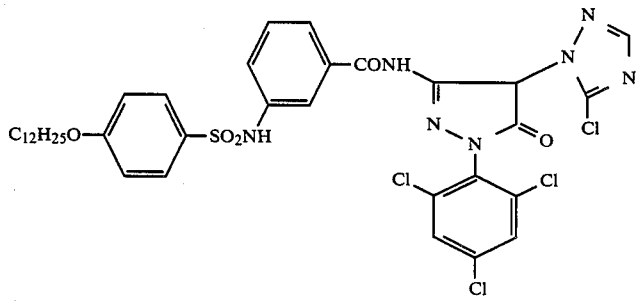
(I-10)
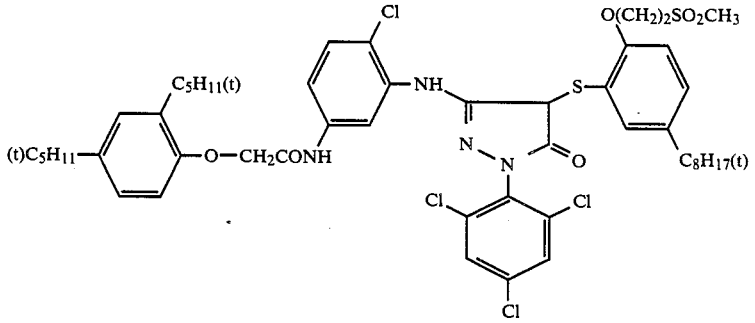

-continued
(I-11)
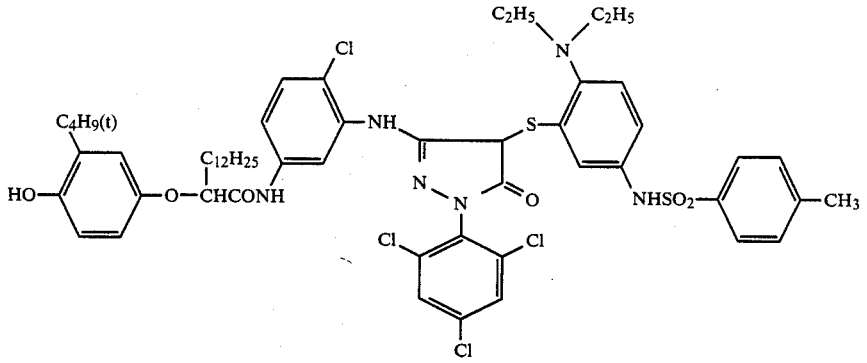
(I-12)
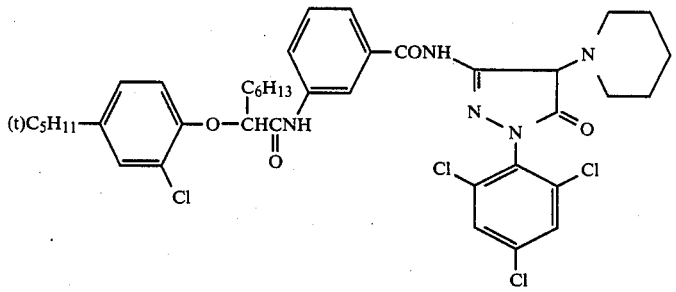
(I-13)
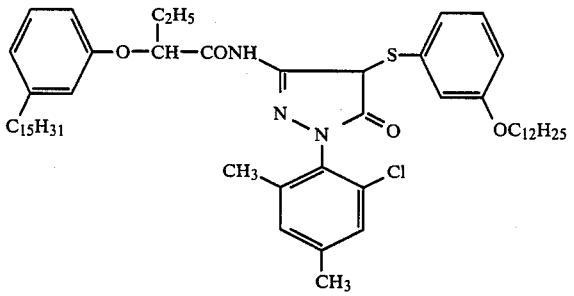
(I-14)
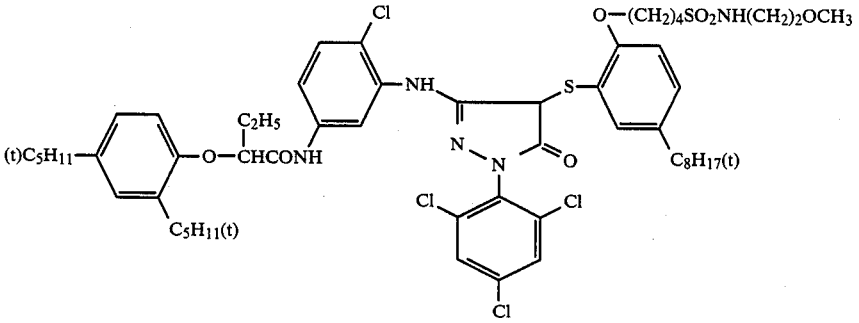
(I-15)
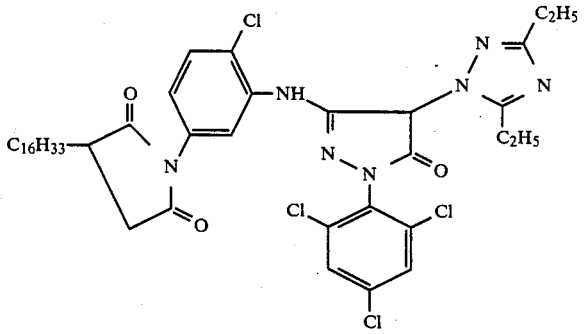

-continued
(I-16)
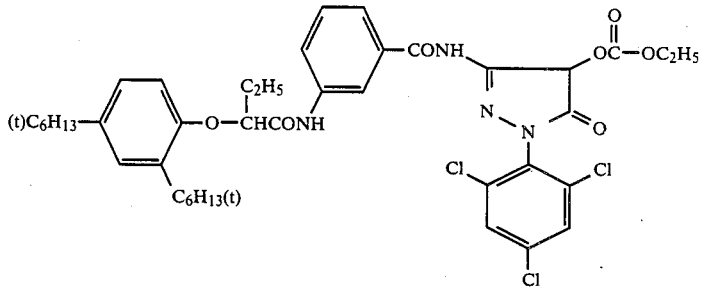
(I-17)
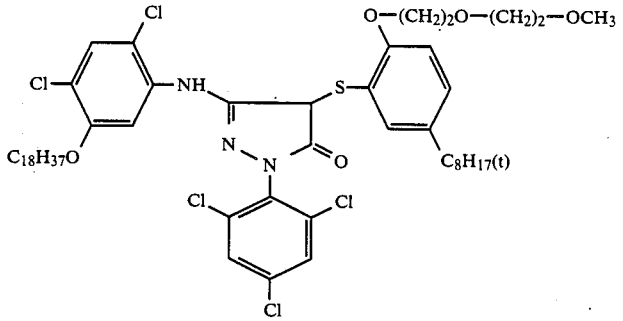
(I-18)
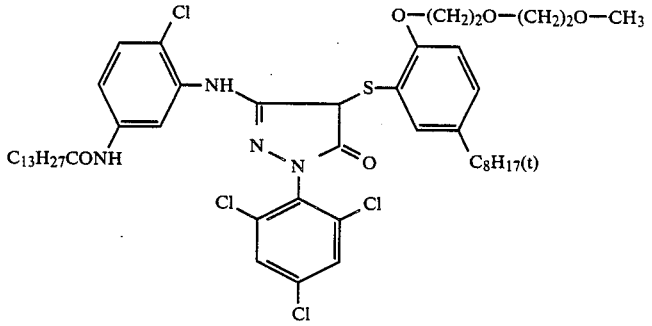
(I-19)
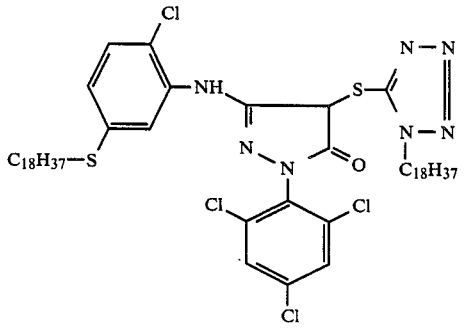
(I-20)
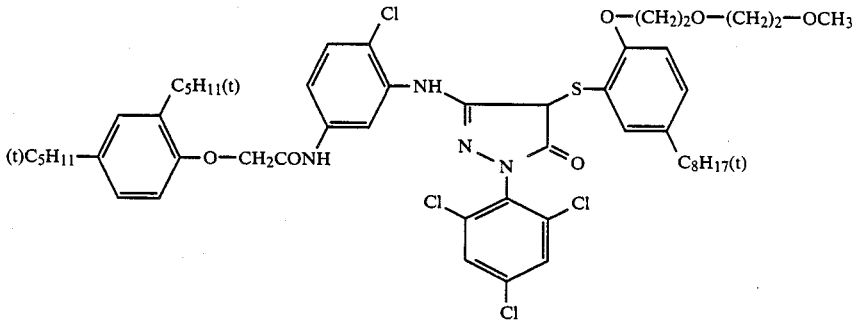

-continued
(II-1)
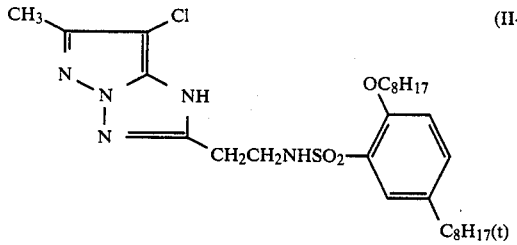
(II-2)
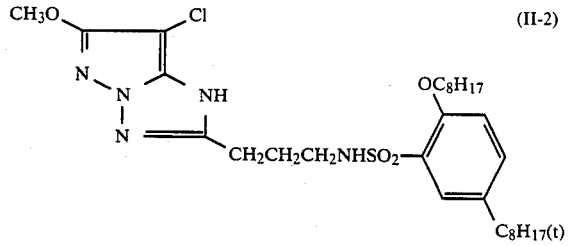
(II-3)
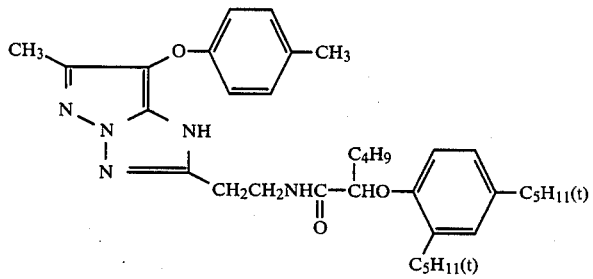
(II-4)
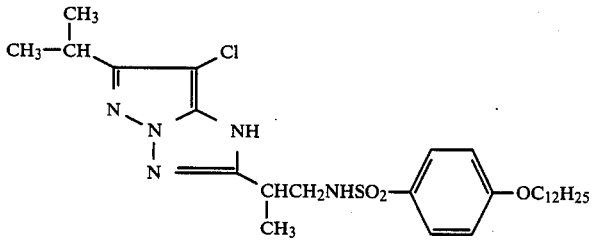
(II-5)
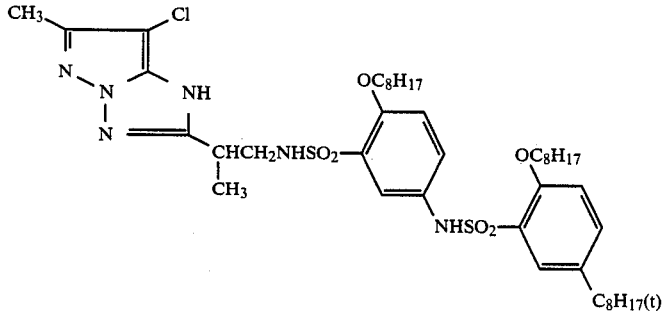
(II-6)
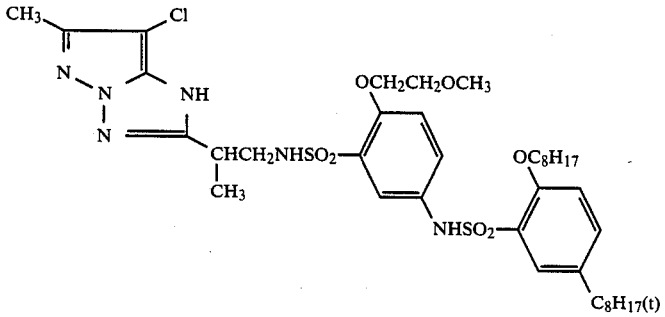

-continued
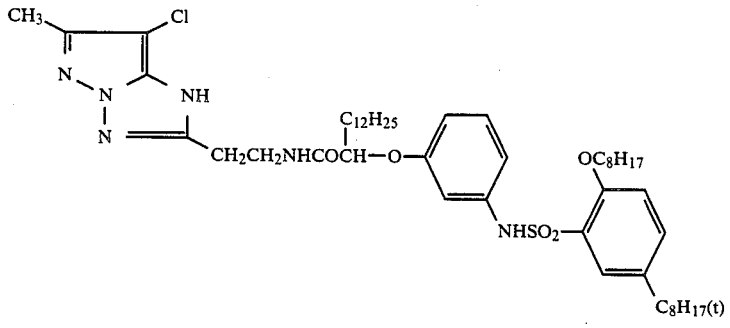
(II-7)
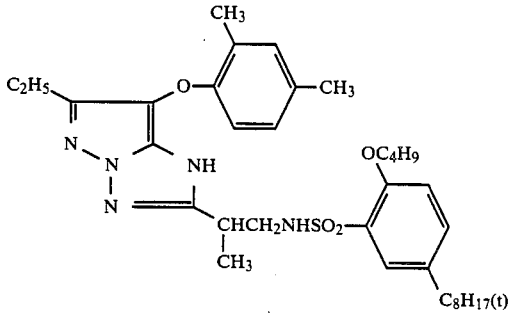
(II-8)
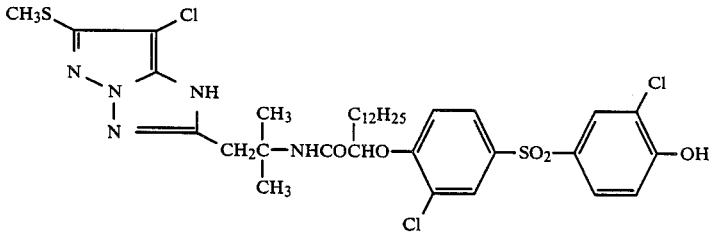
(II-9)
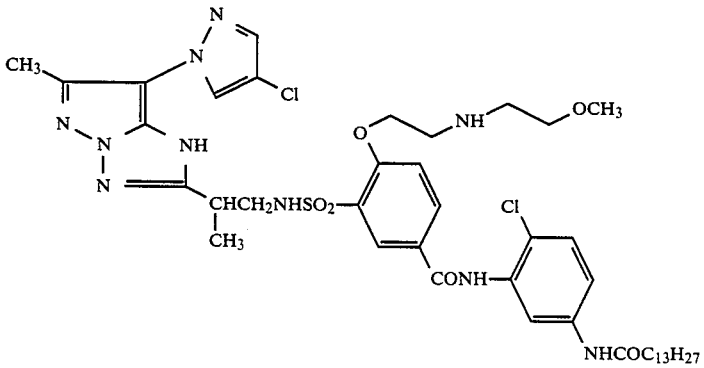
(II-10)
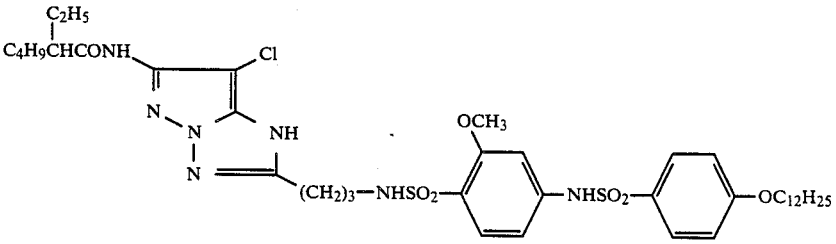
(II-11)

-continued
(II-12)
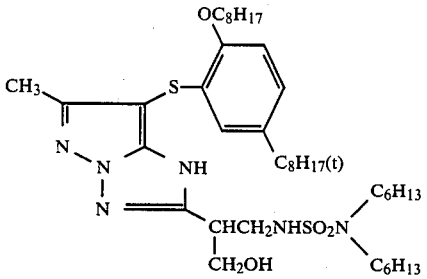
(II-13)
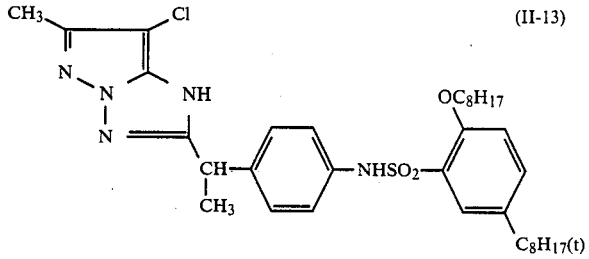
(II-14)
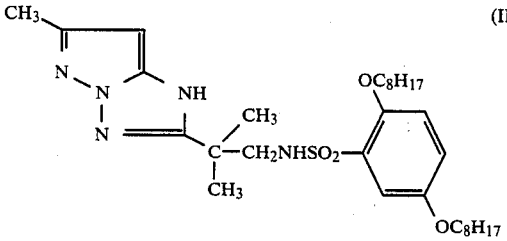
(II-15)
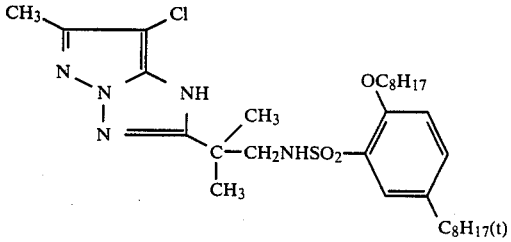
(II-16)
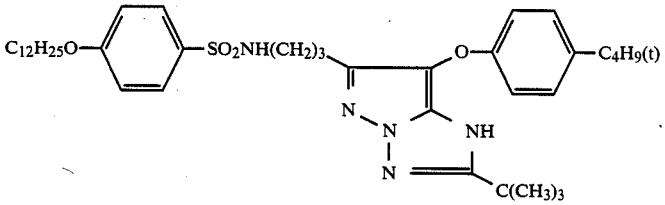
(II-17)
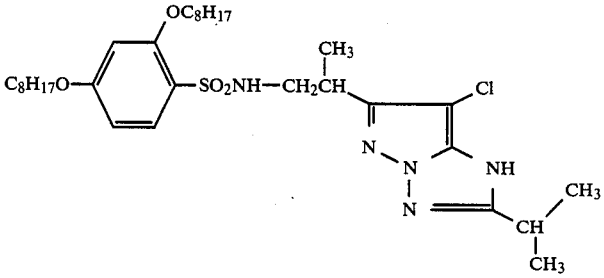
(II-18)
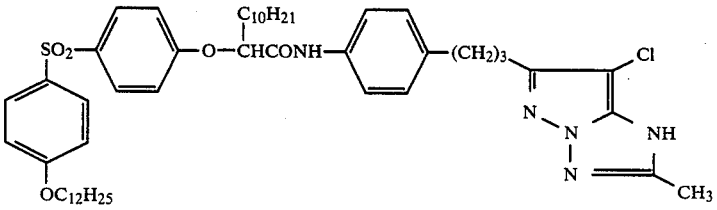
(II-19)
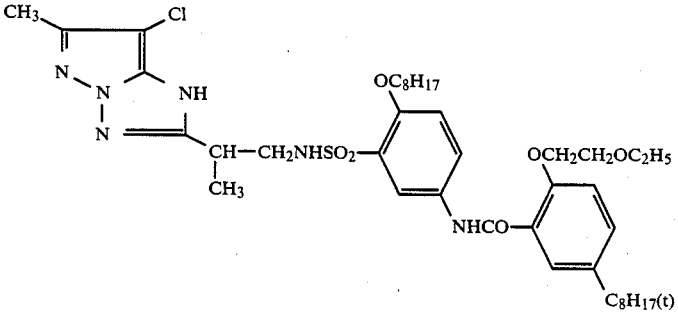

-continued
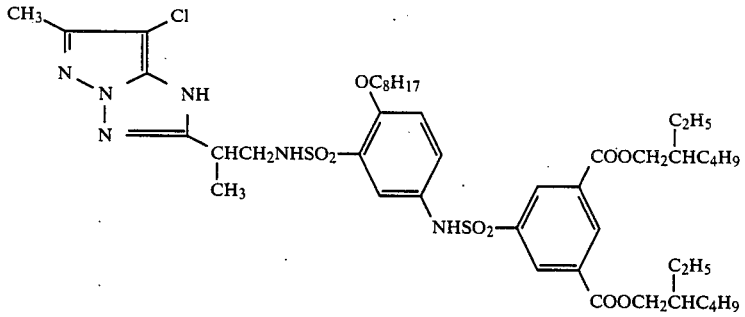
(II-20)
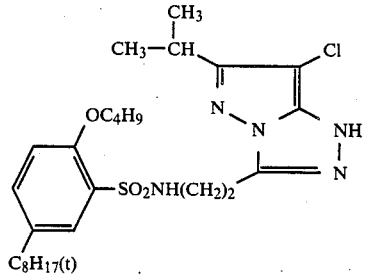
(II-21)
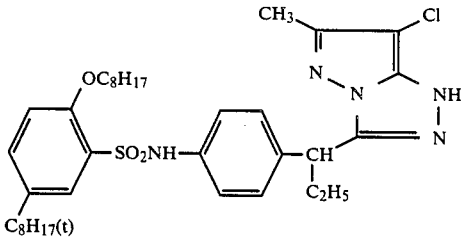
(II-22)
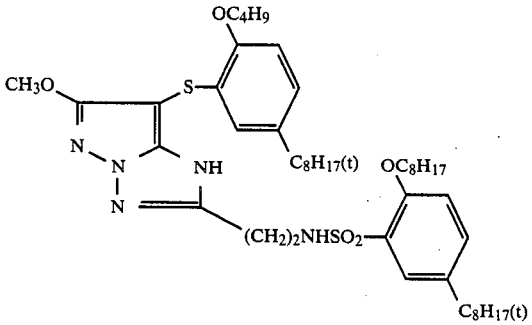
(II-23)
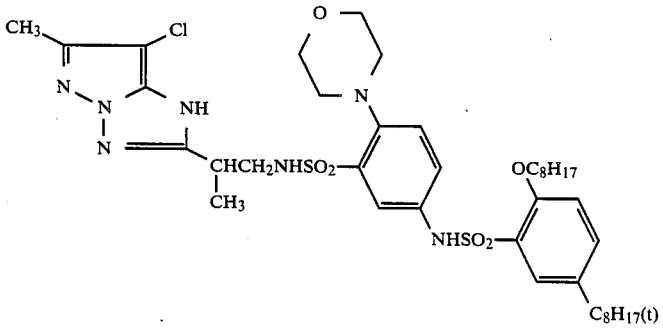
(II-24)
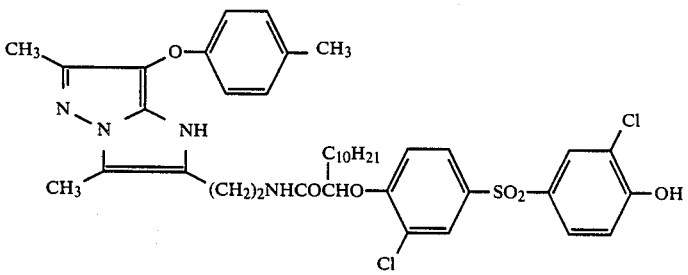
(II-25)

-continued
(II-26)
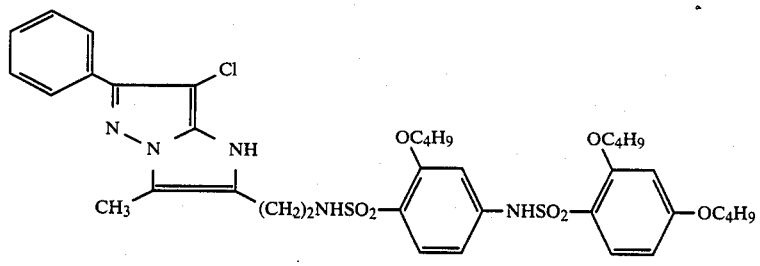
(II-27)
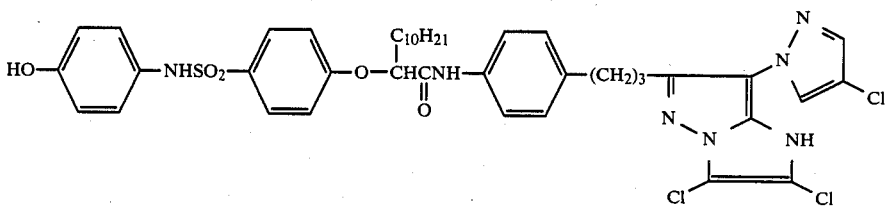
(II-28)
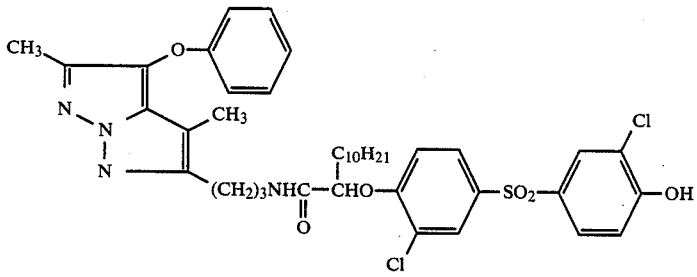
(II-29)
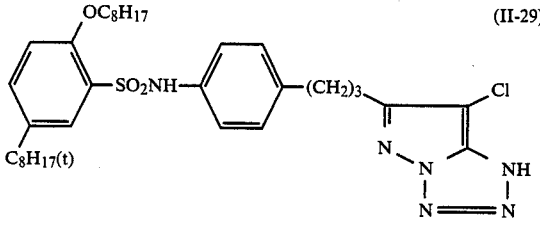
(II-30)
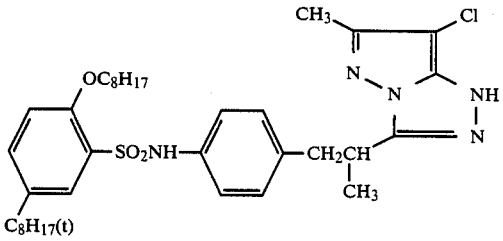
(II-31)
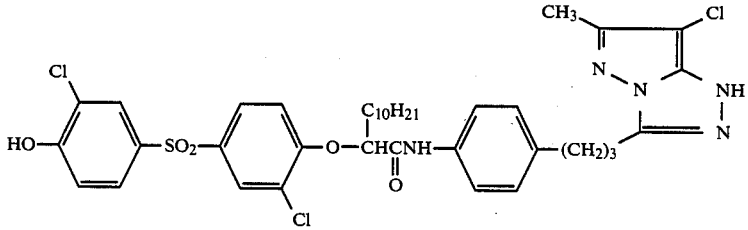
(II-32)
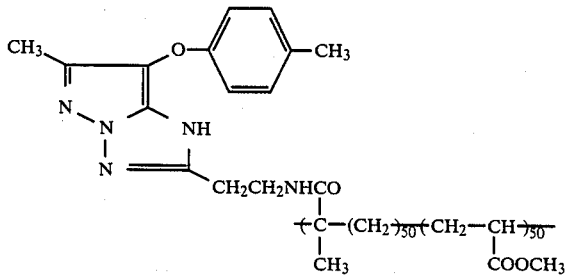

-continued
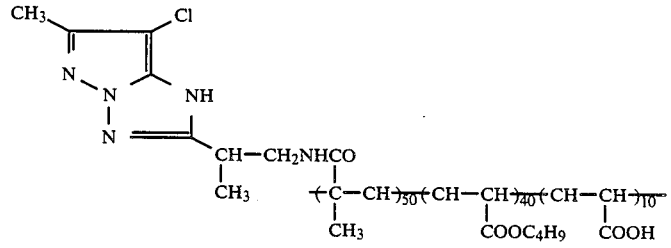
(II-33)
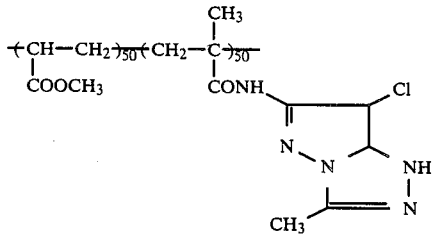
(II-34)
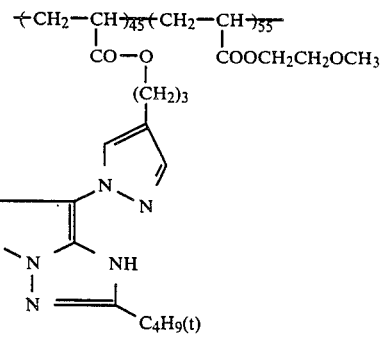
(II-35)
II-36
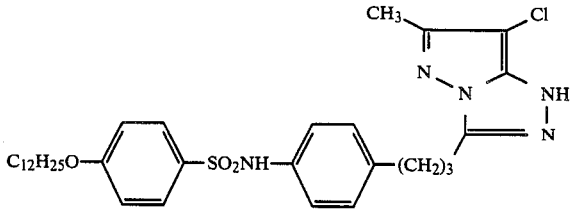
II-37
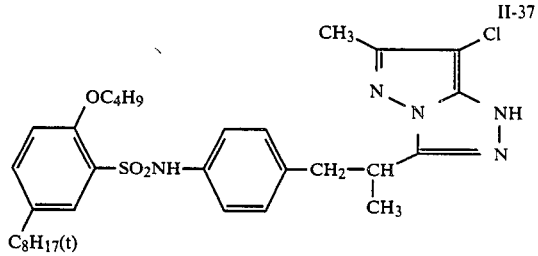
II-38
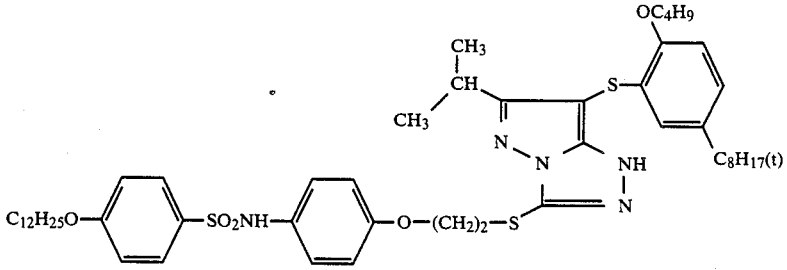
II-39
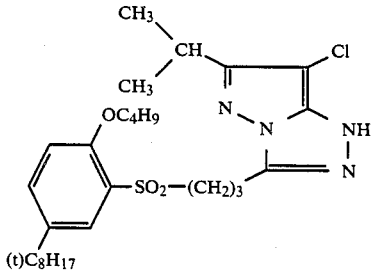

-continued
II-40
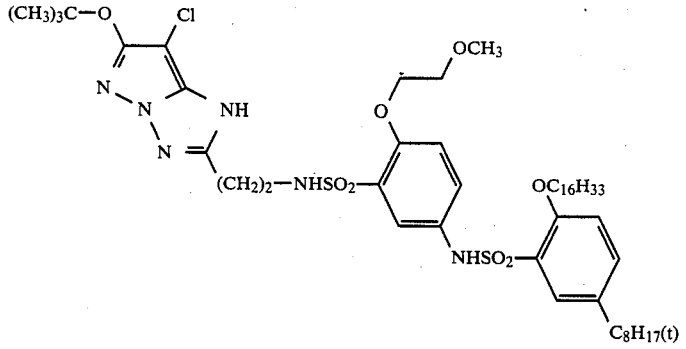
II-41
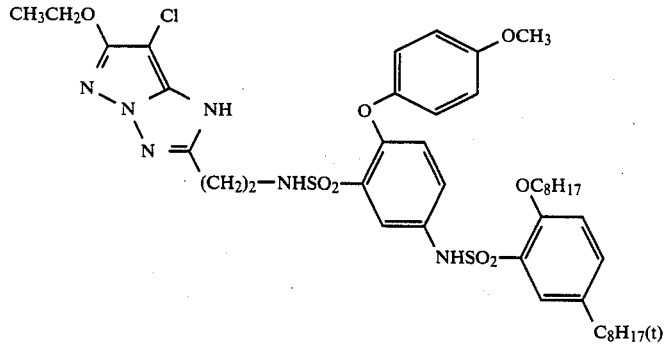
II-42
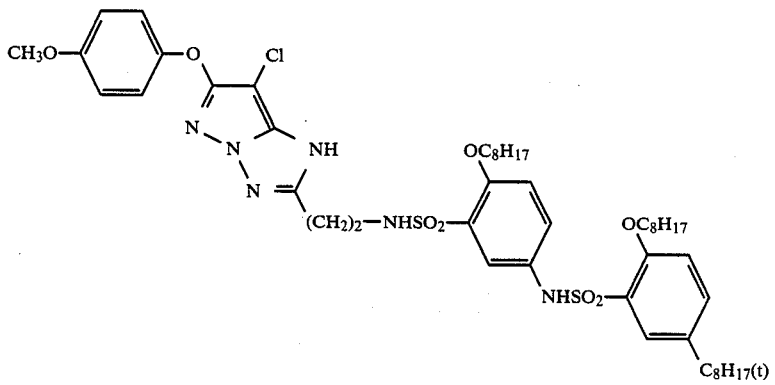
II-43
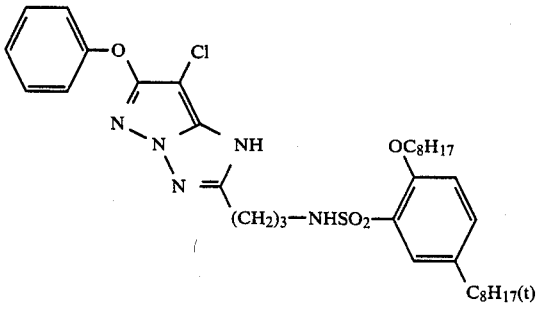
II-44
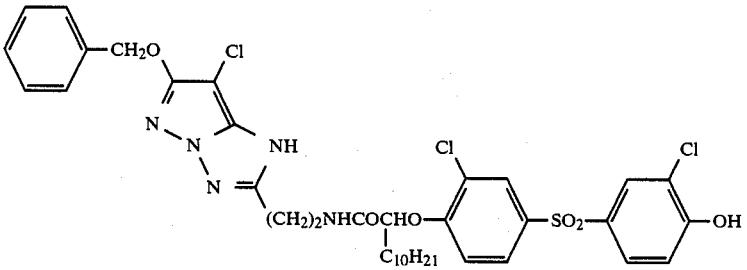

-continued
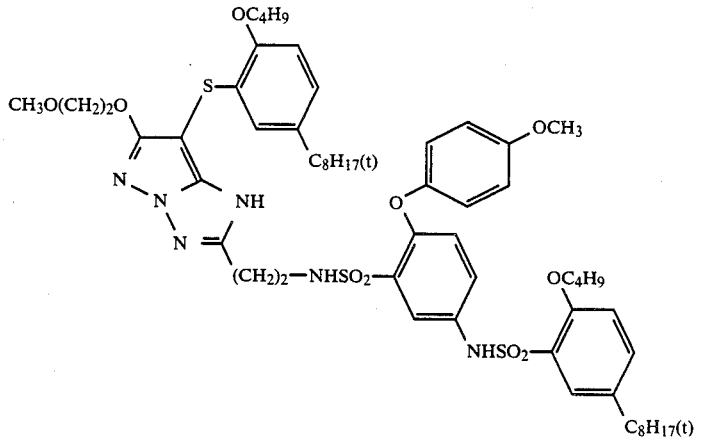
II-45
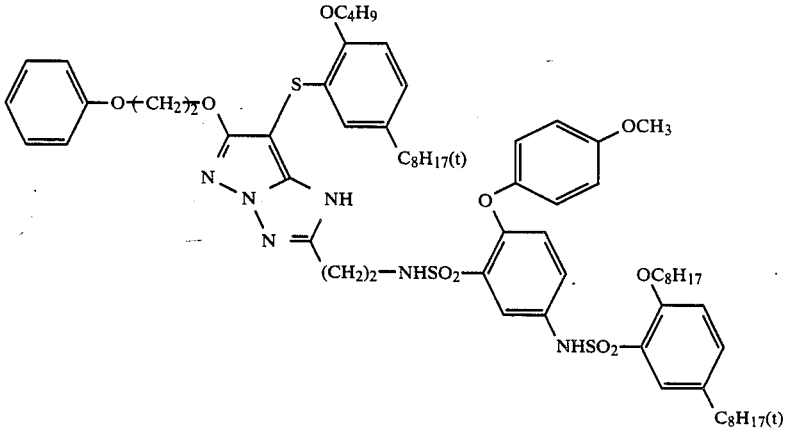
II-46
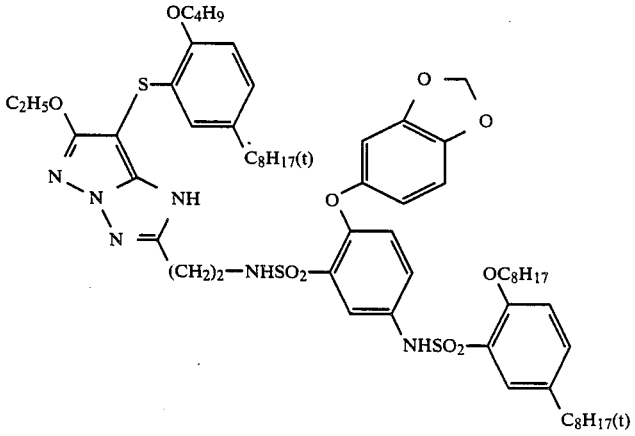
II-47
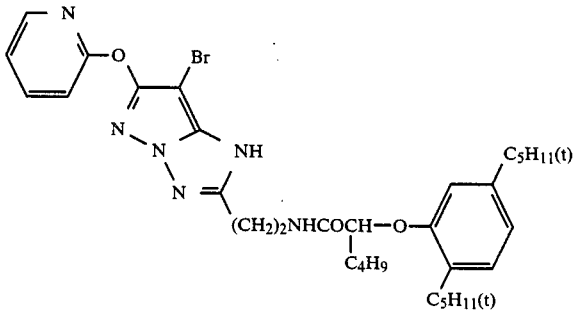
II-48

-continued
II-49
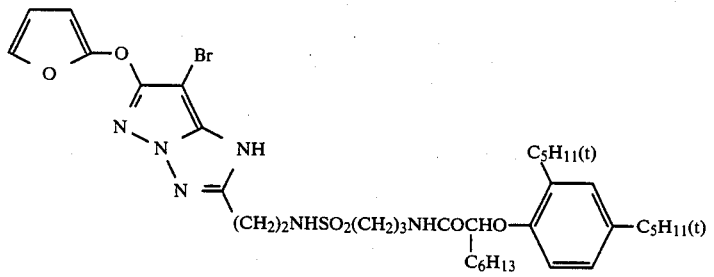
II-50
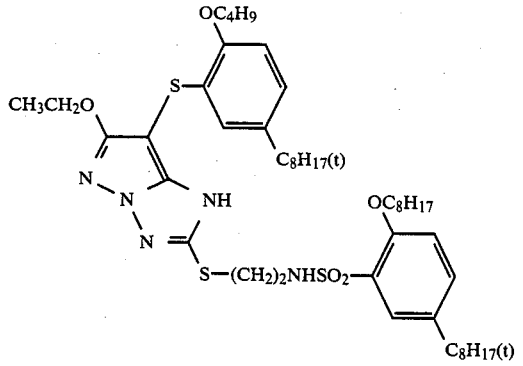
II-51
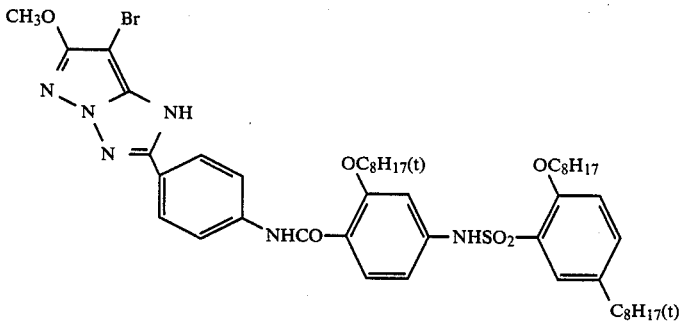
II-52
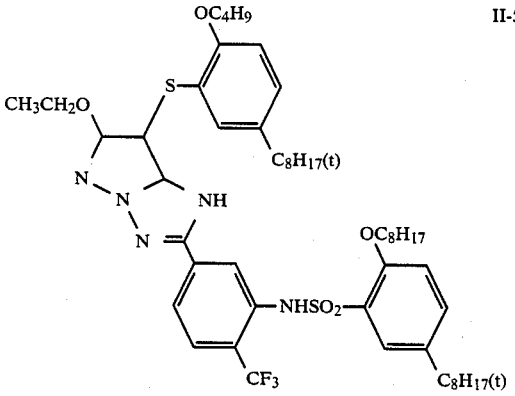
II-53
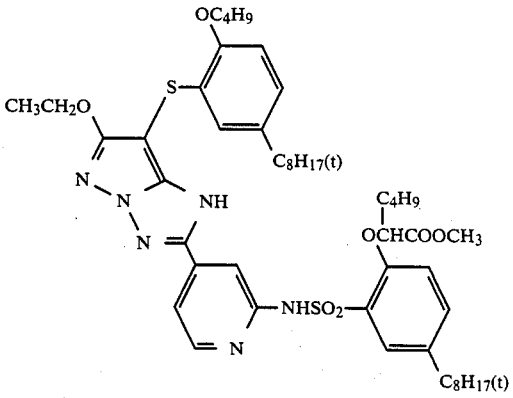

-continued
II-54
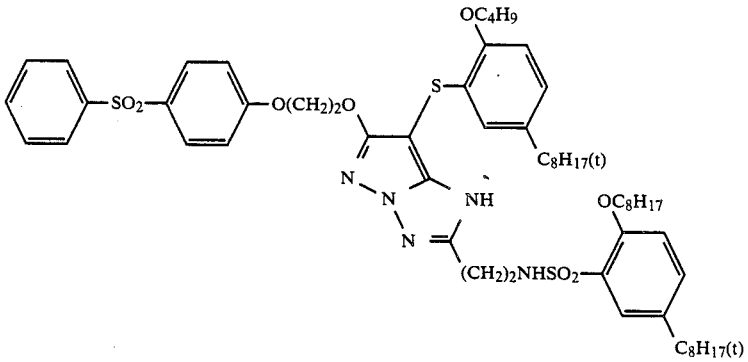
II-55
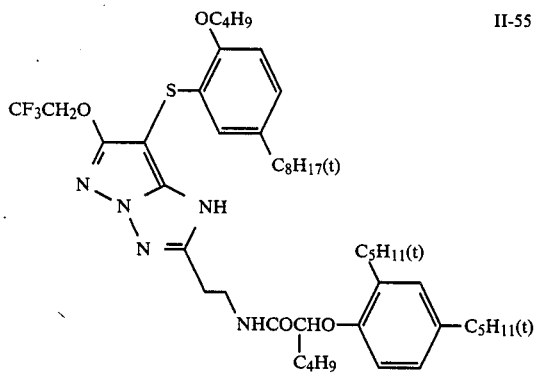
II-56
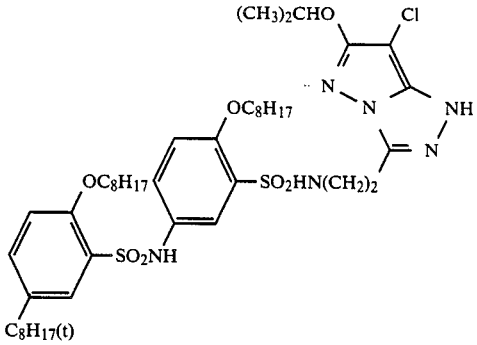
II-57
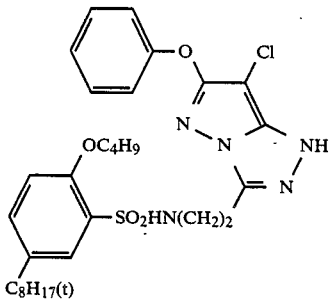
II-58
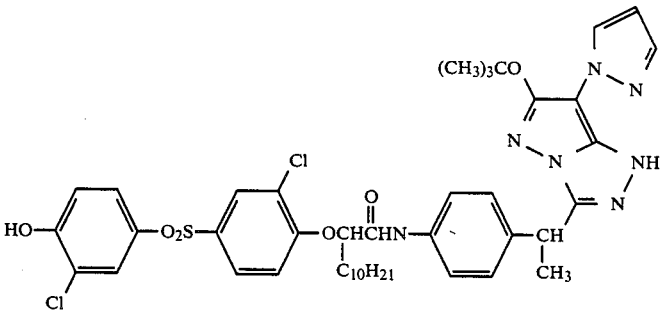

-continued
II-59
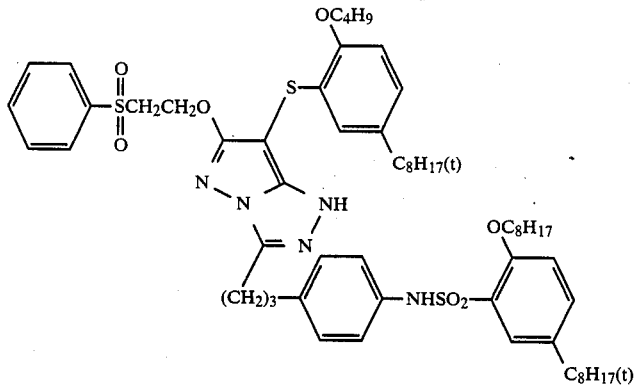
II-60
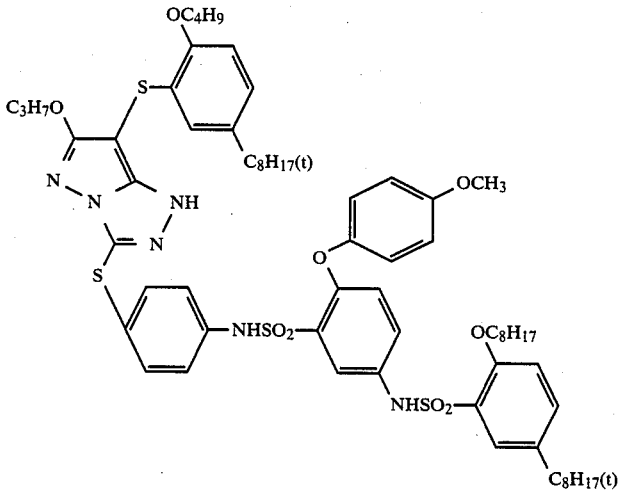
II-61
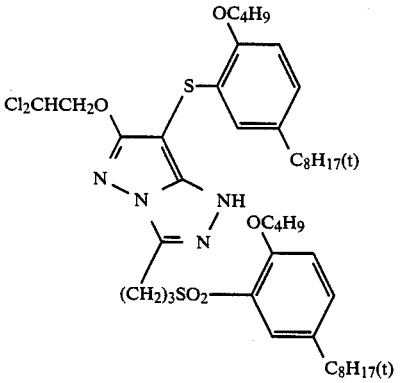
II-62
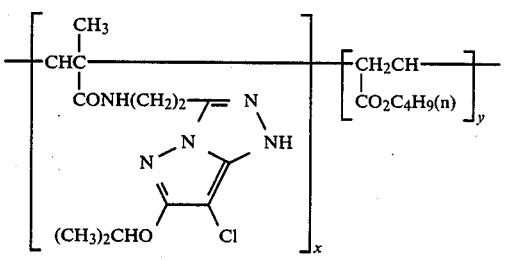
x:y = 50:50
II-63
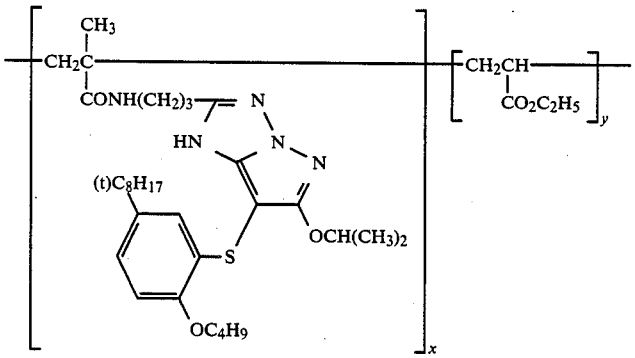
x:y = 50:50

-continued

II-64

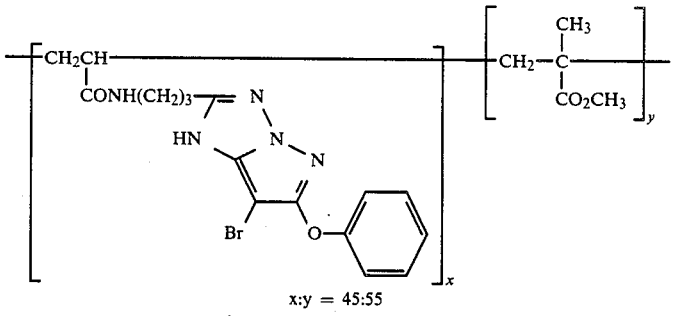

x:y = 45:55

The "reflective" support used for the color photographic material processed in accordance with the process of the present invention is a support having an increased reflectivity and is able to clearly show dye images formed in the silver halide emulsion layers on the support. Such a reflective support as may be used herein includes a support coated with a hydrophobic resin containing a light-reflective substance such as titanium oxide, zinc oxide, calcium carbonate, calcium sulfate, etc., as well as a support composed of a hydrophobic resin containing the above-noted light-reflective substance. For example, suitable supports include baryta-coated papers, polyethylene-coated papers, polypropylene series synthetic papers, and transparent supports composed of glass plates, polyester films such as polyethylene terephthalate films, cellulose triacetate films, cellulose nitrate films, etc., polyamide films, polycarbonate films, polystyrene films, etc., coated with a reflective layer or internally containing the reflective substance. The specific type of support can be properly selected according to the desired purpose.

The processing method (image forming process) of the present invention is described in detail hereinafter.

The processing time for the color development step is relatively short, i.e., not longer than about 2 minutes and 30 seconds, and the preferred processing time is from 0.5 minute to 2 minutes. The processing time is defined as the time from when a light-sensitive material is first placed in contact with a color developer up until its subsequent first contact with the bath, including the time necessary to transfer the material from the developer to the bath.

A color developer which is advantageously used for the development step of the presently described method is an alkaline aqueous solution preferably containing an aromatic primary amine color developing agent as the main component. Preferred color developing agents include a p-phenylenediamine series compound, the typical examples thereof as the color developing agent are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides, phosphates, p-toluenesulfonates, tetraphenylborates, and p-(t-octyl)benzenesulfonates and these compounds. Of these compounds, 3-methyl-4-amino-N-ethyl-N-β-methanesulfonamidoethylaniline is more preferred. Of these compounds, 3-methyl-4-amino-N-ethyl-α,β-methanesulfonamidoethylaniline and the salts thereof are particularly preferred with respect to the resulting hue and the fastness of dyes formed.

Furthermore, aminophenol series derivatives can be also used as the color developing agent in this invention, and examples of such aminophenol series derivatives are o-aminophenol, p-aminophenol, 4-amino-2-methylphenol, 2-amino-3-methylphenol, 2-oxy-3-amino-1,4-dimethylbenzene, etc.

Other color developing agents such as those described in L.F.A. Mason, *Photographic Processing Chemistry*, pages 226 to 229, published by Focal Press, U.S. Pat. Nos. 2,193,015, 2,592,364, Japanese Patent Application (OPI) No. 64933/73, etc., can also be used in the process of this invention.

If necessary, a combination of two or more kinds of the color developing agents described above can be used in the present invention.

The processing temperature of the color developer is preferably from about 30° C. to about 50° C., more preferably from 35° C. to 45° C.

The color developer may further contain a conventional development accelerator (with the exception of benzyl alcohol). Examples of the development accelerator which may be used herein include the pyrymidium compounds described in U.S. Pat. No. 2,648,604, Japanese Patent Publication No. 9503/69, and U.S. Pat. No. 3,171,247, and other cationic compounds; cationic dyes such as phenosafranine, etc.; neutral salts such as thallium nitrate, potassium nitrate, etc.; polyethylene glycol and the derivatives thereof described in Japanese Patent Publication Nos. 9304/69, U.S. Pat. Nos. 2,533,990, 2,531,832, 2,950,970, 2,577,127, etc.; nonionic compounds such as polythioether, etc.; the thioether series compounds described in U.S. Pat. No. 3,201,242, and also the compounds described in Japanese Patent Application (OPI) Nos. 156934/83, 220344/85.

Due to the short development time used in the present invention, not only are means for accelerating development important, but also are techniques for preventing the formation of development fog important.

As to the latter technique, an antifoggant can be used. Preferred antifoggants include alkali metal halides such as potassium bromide, sodium bromide, potassium iodide, etc., and organic antifoggants. Examples of organic antifoggants are nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolidine, etc., mercapto-substituted heterocyclic compounds such as 1-phenyl-5-mercaptotetrazole, 2-mercaptobenzimidazole, 2-mercaptobenzothiazole, etc., and aromatic compounds such as thiosalicylic acid, etc. Particularly preferred antifoggants are alkali metal halides as described above. The antifoggant may be used in such a manner that it is dissolved out from color photographic materials during development and accumulated in the color developer.

The color developers for use in this invention may further contain pH buffers such as the carbonates, borates, or phosphates of an alkali metal; preservatives such as hydroxylamine, triethanolamine, the compounds described in West German Patent Application (OLS) No. 2,622,950, sulfites, and hydrogensulfites, etc.; organic solvents such as diethylene glycol, etc.; dye-forming couplers; competing couplers; nucleating agents such as sodium bromohydride, etc.; auxiliary developing agents such as 1-phenyl-3-pyrazolidone, etc.; tackifiers; and chelating agents such as aminopolycarboxylic acids (e.g., ethylenediaminetetraacetic acid, nitrilotriacetic acid, cyclohexanediaminetetraacetic acid, iminodiacetic acid, N-hydroxymethylethylenediaminetetraacetic acid, diethylenetriaminepentaacetic acid, triethylenetetraaminehexaacetic acid, and the compounds described in Japanese Patent Application (OPI) No. 195845/83), organic phosphonic acids (e.g., 1-hydroxyethylidene-1,1'-diphosphonic acid and the compounds described in *Research Disclosure,* No. 18170 (May, 1979)), aminophosphonic acids (e.g., aminotris(methylenephosphonic acid), ethylenediamine-N,N,N',N'-tetramethylenephosphonic acid, etc.), and the phosphonocarboxylic acids described in Japanese Patent Application (OPI) Nos. 102726/77, 42730/78, 121127/79, 4025/80, 126241/80, 65955/80, 65956/80, and *Research Disclosure,* No. 18170 (May, 1979).

Also, the development time may be shortened and the amount of a replenisher for the color developer may be reduced by employing two or more tanks for color development and supplying the replenisher for the color developer from either the foremost tank or the last tank.

After color development, the silver halide color photographic material is usually bleached. The bleach process may be performed simultaneously with a fix process (referred to bleach-fix or blix) or separately from a fix process.

Bleaching agents which can be used for the bleach or blix process include compounds of a multivalent metal such as iron(III), cobalt(III), chromium(VI), copper(II), etc., peracids, quinones, nitroso compounds, etc. Examples of the bleaching agent are ferricyanides, bichromates, organic complex salts of iron(III) or cobalt(III), complex salts of aminopolycarboxylic acids such as ethylenediaminetetraacetic acid, diethylenetriaminepentaacetic acid, nitrilotriacetic acid, 1,3-diamino-2-propanoltetraacetic acid, etc., or organic acids such as citric acid, tartaric acid malic acid, etc., persulfates, manganates, nitrosophenol, etc. Of these compounds, potassium ferricyanide, sodium ethylenediaminetetraacetato ferrate, ammonium ethylenediaminetetraacetato ferrate, ammonium triethylenetetraminepentaacetato ferrate, and persulfates are particularly useful. The ethylenediaminetetraacetic acid iron(III) complex salt can be advantageously used for both the independent bleach solution and the blix solution.

Also, the bleach solution or the blix solution may, if necessary, contain various accelerators. Examples of these accelerators are bromine ions, iodine ions, the thiourea series compounds as described in U.S. Pat. No. 3,706,561, Japanese Patent Publication Nos. 8506/70, 26586/74, Japanese Patent Application (OPI) Nos. 32735/78, 36233/78 and 37016/78, the thiol series compounds as described in Japanese Patent Application (OPI) Nos. 124424/78, 95631/78, 57831/78, 32736/78, 65732/78, 52534/79 and U.S. Pat. No. 3,893,858, the heterocyclic compounds as described in Japanese Patent Application (OPI) Nos. 59644/74, 140129/75, 28426/78, 141623/78, 104232/78, and 35727/79 the thioether series compounds as described in Japanese Patent Application (OPI) Nos. 20832/77, 25064/80, and 26506/80, the quaternary amines described in Japanese Patent Application (OPI) No. 84440/73, and the thiocarbamoyl compounds as described in Japanese Patent Application (OPI) No. 42349/74.

The color photographic material is then processed by a fix solution. Fixing agents include thiosulfates, thiocyanates, thioether series compounds, thioureas, various iodides, etc., but thiosulfates are most generally used.

The blix solution and the fix solution for use in the process of this invention may further contain a preservative. Preferred examples of the preservative include sulfites, hydrogensulfites, and carbonyl hydrogensulfite addition products.

After the blix step or the fix step, a washing step is usually performed. Water for the washing step may contain various compounds for the prevention of precipitation and saving water. Examples of these additives are water softeners such as inorganic phosphoric acids, aminopolycarboxylic acids, organic phosphoric acids, etc., for preventing the occurrence of precipitation, antibacterial agents and antifungal agents for preventing the generation of bacteria, molds, and algae, hardening agents such as magnesium salts, and aluminum salts, and surface active agents for reducing drying load and preventing the occurrence of uneven drying. Furthermore, the compounds described by L. E. West in *Photographic Science and Engineering,* Vol. 9, No. 6 (1965), etc., may be added to the water used during washing. It is particularly effective to add a chelating agent or the antifungal agent to the water.

Furthermore, the amount of water necessary can be reduced by employing a multistage (2 to 5 stages) countercurrent system for the washing step.

The multistage countercurrent stabilization process as described in Japanese Patent Application (OPI) No. 8543/82 may be employed after or in place of the washing step. In such a case, 2 to 9 countercurrent tanks are necessary. The stabilization solution for use in this process may further contain various kinds of compounds for stabilizing the color images formed. Examples of these compounds are buffers for adjusting the pH of the photographic layers (e.g., borates, metaborates, borax, phosphates, carbonates, potassium hydroxide, sodium hydroxide, aqueous ammonia, monocarboxylic acids, dicarboxylic acids, polycarboxylic acids, etc.), and formalin. Still further, water softeners (e.g., inorganic phosphoric acids, aminopolycarboxylic acids, organic phosphoric acids, aminopolyphosphonic acids, phosphonocarboxylic acids, etc.), sterilizers (e.g., Proxel, isothiazolone, 4-thiazolylbenzimidazole, halogenated phenols, benzotriazole, etc.), surface active agents, brightening agents, hardening agents, etc.

Layer pH controlling agents after processing can be added to the stabilization solution, including various ammonium salts such as ammonium chloride, ammonium nitrate, ammonium sulfate, ammonium phosphate, ammonium sulfite, ammonium thiosulfate, etc.

The processing time for the wash step and/or stabilization after the blix step is less than about 2 minutes, preferably less than about 1 minute and 30 seconds. This processing time means the time required to first contact the color photographic material with wash water (or the stabilization solution) in the foremost tank up until the beginning of the drying step.

The final bath in the step may further contain 500 ppm or more salts. These salts may be based on the components in the blix solution which are carried over from the pre-bath as the result of the reduction of the replenisher for the wash solution and/or the stabilization solution, or may be based on the addition of various components to the wash solution and/or the stabilization solution for the various purposes described above. Also, the salts may be based on the components dissolved out from the color photographic materials during processing.

The amount of the replenisher used in the wash step or the stabilization step is preferably from about 0.1 to about 50 times, more preferably from 3 to 30 times, the amount of the processing solution carried over from the prebath per unit area of the color photographic material.

The temperature for the wash step or the stabilization step employed in this invention is preferably from about 20° C. to about 45° C., more preferably, from 25° C. to 40° C., and particularly preferably from 30° C. to 35° C.

It is preferred to circulate or stir the processing solution for increasing the washing-out effect for components in the photographic layers during the wash step or the stabilization step. A method comprising vigorously striking a stream of the solution onto the surface of the emulsion layers of the color photographic material (e.g., gas stirring and liquid spraying) is particularly preferred.

In a preferred embodiment of the color image forming process of the present invention, after color developing, the process comprises subjecting a silver halide color photographic material to a desilvering step followed by a wash step and/or a stabilization step for a period of up to about 1 minute 30 seconds.

The drying conditions employed in the process of the present invention are described hereinafter. For the purpose of increasing the processing speed, a shorter processing time is preferred, and the drying temperature is preferably at least about 60° C., more preferably from 60° C. to 90° C., to achieve this purpose. In this case, the drying time is preferably from about 30 seconds to about 2 minutes and 30 seconds, more preferably from 40 seconds to 2 minutes.

The silver halide emulsion which is preferably employed in photographic materials to be processed in accordance with the process of this invention is a silver chloride emulsion or a silver chlorobromide emulsion. For obtaining a silver halide emulsion having a sufficiently high sensitivity without undesirably increasing fog formation, a silver halide emulsion having a silver bromide content of at least about 20 mol% is preferred, but when particularly quick processing is desired, a silver halide emulsion having a silver bromide content of up to about 20 mol% or up to about 10 mol% is frequently employed. The silver halide emulsion which is preferably employed in photographic materials to be processed in accordance with the process of this invention is a silver halide emulsion having a silver chloride content of at least 90 mol%.

The mean grain size of the silver halide grains used in the silver halide emulsion is preferably from about 0.1 μm to about 2 μm, more preferably from 0.2 μm to 1.3 μm calculated as the diameter of a circle equivalent to the projected area of the grains. Also, the silver halide emulsion is preferably a mono-dispersed silver halide emulsion, and the grain size distribution showing the extent of the mono-dispersion is preferably up to about 0.2, more preferably up to 0.15 (measured by the ratio ($S/\bar{d}$) of the statistical standard deviation (S) to the mean grain size ($\bar{d}$)).

The silver halide grains for use in this invention may differ in phase from the internal portion to the surface thereof, or may have a multi-phase structure comprising, for example, a junction structure, or may have a uniform phase throughout the whole grain. The silver halide grains may be composed of a combination of these grains described above.

Also, the silver halide grains which may be used in this invention may have a regular crystal form such as a cube, an octahedron, a dodecahedron, a tetradecahedron, etc., an irregular crystal form such as sphere, or a composite structure based of these crystal forms.

Also, a tabular grain silver halide emulsion may be employed wherein the tabular silver halide grains having an aspect ratio, i.e., the ratio of length/thickness of at least about 5, preferably at least 8 account for at least about 50% of the total projected area of the silver halide grains.

Furthermore, the silver halide emulsion may be composed of a mixture of the aforesaid various types of emulsions.

The silver halide emulsion for use in this invention may also be a surface latent image type mainly forming latent images on the surface of the grains, or an internal latent image type mainly forming latent images in the internal portion of the grains.

The silver halide emulsion for use in this invention is preferably a surface latent image type mainly forming latent images on the surface of the grains upon exposure to light.

The silver halide photographic emulsions for use in the present invention can be prepared by the methods described, for example, in P. Glafkides, *Chimie et Physique Photographique* (published by Paul Montel Co., 1967), G. F. Duffin, *Photographic Emulsion Chemistry* (published by Focal Press, 1966), V. L. Zelikman et al, *Making and Coating Photographic Emulsion* (published by Focal Press, 1964), etc.

That is, the silver halide emulsion can be prepared by an acid method, a neutralization method, an ammonia method, etc. Suitable methods for reacting a soluble silver salt and a soluble halide include a single jet method, a double jet method, or a combination of these methods. Also, a so-called reverse mixing method of forming silver halide grains in the presence of excessive silver ions can be employed.

One type of the double jet method is a so-called controlled double jet method for keeping a constant pAg during the liquid phase of forming the silver halide. According to this method, a silver halide emulsion containing silver halide grains having a regular crystal form and almost uniform grain sizes can be obtained.

Furthermore, a silver halide emulsion prepared by a so-called conversion method including a step of converting a silver halide already formed prior to completion of the silver halide grains formation step into a silver halide having a lower solubility product, or a silver halide emulsion prepared by employing the same type of conversion as above, but after finishing the silver halide grain formation step can be also used in this invention.

The silver halide grains may be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, etc.

After the formation of silver halide grains, the silver halide emulsion is usually subjected to physical ripening, desalting, and chemical ripening before coating.

A silver halide solvent (e.g., ammonia, potassium rhodanate, and the thioethers and thione compounds described in U.S. Pat. No. 3,271,157, Japanese Patent Application (OPI) Nos. 12360/76, 82408/78, 144319/78, 100717/79, and 155828/79) can be used for the precipitation, physical ripening and chemical ripening of the silver halide emulsions for use in this invention.

A noodle washing method, a flocculation method, or an ultrafiltration method can be employed for removing soluble salts from the silver halide emulsion after physical ripening.

The silver halide emulsion for use in this invention can be chemically sensitized by a sulfur sensitization method using active gelatin or a sulfur-containing compound capable of reacting with silver (e.g., thiosulfates, thioureas, mercapto compounds, rhodanines, etc.), a reduction sensitizing method using a reducing substance (e.g., stannous salts, amines, hydrazine derivatives, formamidinesulfinic acid, silane compounds, etc.), and a noble metal sensitization method using a noble metal compound (e.g., a gold complex salt or a complex salt of a metal selected from group VIII of the periodic table, such as platinum, iridium, palladium, rhodium, iron, etc.). These sensitization methods can be employed alone or in combination.

Sulfur sensitization is especially preferred, in the absence of other methods of chemical sensitization.

To achieve the desired gradation of the formed images of the color photographic materials in this invention, two or more kinds of mono-dispersed silver halide emulsions (preferably having the same statistical standard deviation (S) noted above used to determined the mono-dispersibility) each having different silver halide mean grain sizes, may be used for an emulsion layer as a mixture of these mono-dispersed emulsions or for an emulsion layer unit having the same color sensitivity as multilayers separately containing these mono-dispersed emulsions. Furthermore, two or more kinds of poly-dispersed silver halide emulsions, or a combination of a mono-dispersed emulsion and a poly-dispersed emulsion can be used as a mixture to form a single emulsion, or may be coated separately as a multilayer photographic material.

The blue-sensitive emulsion, the green-sensitive emulsion and the red-sensitive emulsion for use in this invention are spectrally sensitized by methine dyes, etc., to impart color sensitivity thereto. Dyes which may be used for this purpose include cyanine dyes, merocyanine dyes, complex cyanine dyes, complex merocyanine dyes, holopolar cyanine dyes, hemicyanine dyes, styryl dyes, hemioxonol dyes, etc. Particularly useful dyes are cyanine dyes, merocyanine dyes, and complex merocyanine dyes.

Nuclei can be applied in conjunction with these dyes, such as those usually used for cyanine dyes as basic heterocyclic nuclei. Examples of these nuclei are pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc., as well as the nuclei formed by fusing an aliphatic hydrocarbon ring to the aforesaid nuclei, and the nuclei formed by fusing an aromatic hydrocarbon ring to the aforesaid nuclei. Examples of this type of nuclei would include indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc., and these can also be applied in conjunction with the dyes described above. These nuclei may be substituted on desired carbon atoms of the dyes.

In conjunction with the merocyanine dyes or complex merocyanine dyes may be applied 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure.

The above sensitizing dyes may be used alone or in combination. A combination of sensitizing dyes is frequently used for the purpose of supersensitization. Specific examples of this type of combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68, 12375/78, Japanese Patent Application (OPI) Nos. 110618/77, 109925/77, etc.

The silver halide emulsion for use in this invention may further contain a dye having no spectral sensitizing activity by itself or a substance which does not substantially absorb visible light and shows supersensitizing activity, together with one or more of the above sensitizing dyes.

One or more of the sensitizing dyes may be added to a silver halide emulsion during any step of the formation of the silver halide grains before coating. That is, the sensitizing dyes may be added during the formation or after completion of the formation of the silver halide grains of the silver halide emulsion, before or after chemical sensitization thereof, or during the step of incorporating additives to the emulsion during preparation of the coating composition.

Also, when the two or more kinds of mono-dispersed emulsions are used as a mixture thereof, one or more of the sensitizing dyes may be added to each mono-dispersed emulsion separately before mixing, or may be added thereto after mixing. However, the former case is more preferred.

The graininess of the resulting images in the color photographic material can be improved by using couplers which form colored dyes having a proper diffusibility together with the above-described couplers. Specific examples of these dye diffusible couplers are described in U.S. Pat. No. 4,366,237 and British Pat. No. 2,125,570 for magenta couplers, and in European Pat. No. 96,570 and West German Patent Application (OLS) No. 3,234,533 for yellow, magenta, and cyan couplers.

The dye-forming couplers and specific couplers described above each may bond together to form a dimer or higher polymer. Typical examples of such polymerized dye-forming couplers are described in U.S. Pat. Nos. 3,451,820 and 4,080,211. Also, specific examples of polymerized magenta couplers are described in British Pat. No. 2,102,173 and U.S. Pat. No. 4,367,282.

The couplers for use in this invention may be added to the same silver halide photographic emulsion layer in combination, or the same kind of coupler may be added to two or more emulsion layers for attaining the desired photographic characteristics.

A high-temperature organic solvent can be used to impregnate a latex polymer with a coupler, and specific examples of the organic solvent include phthalic acid esters (e.g., dibutyl phthalate, dicyclohexyl phthalate, di-2-ethylhexyl phthalate, decyl phthalate, etc.), esters of phosphoric acid or phosphonic acid (e.g., triphenyl phosphate, tricresyl phosphate, 2-ethylhexyldiphenyl phosphate, tricyclohexyl phosphate, tri-2-ethylhexyl phospate, tridecyl phosphate, tributoxyethyl phosphate, trichloropropyl phosphate, di-2-ethylhexylphenyl phosphonate, etc.), benzoic acid esters (e.g., 2-ethylhexyl benzoate, dodecyl benzoate, 2-ethylhexyl p-hydroxybenzoate, etc.), amides (e.g., diethyldodecane amide, N-tetradecylpyrrolidone, etc.), alcohols or phenols (e.g., isostearyl alcohol, 2,4-di-tert-amylphenol, etc.), aliphatic carboxylic acid esters (e.g., dioctyl azerate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

In this case, an auxiliary solvent can be also used, and examples thereof include an organic solvent having a boiling point of at least about 30° C., preferably at least about 50° C., and up to about 160° C. Specific examples of the auxiliary solvent are ethyl acetate, butyl acetate, ethyl propionate, methyl ethyl ketone, cyclohexanone, 2-ethoxyethyl acetate, dimethylformamide, etc.

The standard amount of the color-forming couplers is from about 0.001 to about 1 mol per mol of light-sensitive silver halide. The preferred amount thereof is from 0.01 to 0.5 mol for yellow couplers, from 0.003 to 0.3 mol for magenta couplers, and from 0.002 to 0.3 mol for cyan couplers, per mol of light-sensitive silver halide.

Fading preventing agents can be used for the color photographic materials for use in this invention. Organic fading preventing agent are suitable, and examples thereof include hydroquinones, 6-hydroxychromans, 5-hydroxycoumarans, spirochromans, p-alkoxyphenols, hindered amines such as bisphenols, gallic acid derivatives, methylenedioxybenzenes, aminophenols, hindered amines, and the ether or ester derivatives obtained by silylating or alkylating the phenolic hydroxy group of each of the aforesaid compounds. Also, metal complexes such as (bissalicylaldoxymato)nickel complex and (bis-N,N-dialkyldithiocarbamato)nickel complex can be also used as the fading preventing agent.

For the prevention of the deterioration of the yellow dye images due to heat, moisture, and light, the use of a compound comprising a hindered amine and hindered phenol in one molecule, as described in U.S. Pat. No. 4,268,593, provides good results. Also, for the prevention of the deterioration of magenta dye images particularly, for prevention of the deterioration of images by light, use of the spiroindanes described in Japanese Patent Application (OPI) No. 159644/81 and the chromans substituted by hydroquinone diether or monoether described in Japanese Patent Application (OPI) No. 89835/80 provide especially preferred results.

For improving the storability, in particular, the light fastness of cyan dye images, the use of a benzotriazole series ultraviolet absorbent together with one or more cyan couplers is preferred. In this case, the ultraviolet absorbent may be emulsified together with the cyan couplers.

The amount of the ultraviolet absorbent should be sufficient to impart light stability to cyan dye images, but if an excessive amount is added, the unexpected portions (background portions) of the color photographic material may become yellowed in some instance. The ultraviolet absorbent is preferably used in the range of from about $1\times10^{-4}$ mol/m$^2$ to about $2\times10^{-3}$ mol/m$^2$, particularly preferably from $5\times10^{-4}$ mol/m$^2$ to $1.5\times10^{-3}$ mol/m$^2$.

In the layer structure of an ordinary color photographic paper, the ultraviolet absorbent exists in one or both, preferably both, of the layers adjacent to the cyan coupler-containing red-sensitive emulsion layer. When the ultraviolet absorbent is present in the interlayer between a green-sensitive emulsion layer and a red-sensitive emulsion layer, it may be co-emulsified with a color mixing preventing agent. When the ultraviolet absorbent is incorporated in a protective layer, a further protective layer may be formed as the outermost layer. The protective layer may also contain a matting agent having various particle sizes.

One or more of the hydrophilic colloid layers of the photographic material may further contain ultraviolet absorbents other than those represented by formula (F) described above.

The color photographic materials for use in this invention may further contain in one or more of the hydrophilic colloid layers water-soluble dyes as filter dyes, which are also useful for various other purposes such as irradiation prevention, antihalation, etc.

The color photographic materials for use in this invention may further contain in one or more of the photographic emulsion layers or other hydrophilic colloid layers whitening agents such as stilbene series, triazine series, oxazole series and coumarin series whitening agents. The whitening agent may be water-soluble or water-insoluble and the water-insoluble whitening agent may be used in the form of a dispersion thereof.

The process comprising the present invention can be applied to a multilayer multicolor photographic material having at least two emulsion layers on a support wherein each emulsion layer has a different spectral sensitivity. A multilayer natural color photographic material usually comprises at least one red-sensitive emulsion layer, at least one green-sensitive emulsion layer, and at least one blue-sensitive emulsion layer on a support. The order of these layers in relation to the support may be selected according to the desired results. Also, each of the aforesaid color-sensitive emulsion layers may comprise two or more emulsion layers each having a different sensitivity, and further, a light-insensitive layer (i.e., an interlayer) may be present between two or more emulsion layers each having the same sensitivity.

The color photographic material for use in this invention preferably also comprises auxiliary layers such as one or more protective layers, interlayers, a filter layer, an antihalation layer, a backing layer, etc., in addition to the silver halide emulsion layers described above.

The binder or protective colloid which can be used for the silver halide emulsion layers and auxiliary layers such as protective layer(s), interlayers, etc., is preferably gelatin, but other hydrophilic colloids can be also used.

Such hydrophilic colloids include various synthetic hydrophilic mono- or co-polymers. Examples of such hydrophilic colloids are proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc.; saccharose derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

The gelatin includes lime-processed gelatin as well as acid-processed gelatin and the enzyme-processed gelatin as described in *Bull. Soc. Sci. Photo. Japan,* No. 16, page 30 (1966). Furthermore, the hydrolyzed products and enzyme-decomposition products of gelatin can be also used.

The color photographic materials for use in this invention may further contain, in addition to the aforesaid additives, various kinds of additives known to be useful for photographic light-sensitive materials, such as stabilizers, stain preventing agents, developing agents or the precursors thereof, development accelerators or the precursors thereof, lubricants, mordants, matting agents, antistatic agents, plasticizers, etc. Typical examples of these additives are described in *Research Disclosure,* No. 17643 (December, 1978) and *Research Disclosure,* No. 18716 (November, 1979).

Moreover, the color photographic materials for use in this invention may further contain hydroquinone derivatives, aminophenol derivatives, amines, gallic acid derivatives, catechol derivatives, ascorbic acid derivatives, colorless compound forming couplers, sulfonamidophenol derivatives, etc., as color fog preventing agents or color mixing preventing agents.

Specific examples of these additives are described in U.S. Pat. Nos. 2,360,290, 2,336,327, 2,403,721, 2,418,613, 2,675,314, 2,701,197, 2,704,713, 2,728,659, 2,732,300, 2,735,765, Japanese Patent Application (OPI) Nos. 92988/75, 92989/75, 93928/75, 110337/75, 146235/77, and Japanese Patent Publication No. 23813/75.

Examples of the layer structure of the silver halide color photographic material for use in this invention are illustrated below, but the invention is not limited to these examples.

(1) Support-BL-MC-GL-MC-RL-PC(2)-PC(1);
(2) Support-BL-MC-RL-MC-GL-PC(2)-PC(1);
(3) Support-RL-MC-GL-MC-BL-PC(2)-PC(1);
(4) Support-RL-MC-BL-MC-GL-PC(2)-PC(1);
(5) Support-BL(2)-BL(1)-MC-GL(2)-GL(1)-MC-RL(2)-RL(1)-PC(2)-PC(1);

wherein PC(1) and PC(2) represent 1st and 2nd light-insensitive layers, MC represents a interlayer, BL represents a blue-sensitive emulsion layer, GL represents a green-sensitive emulsion layer, and RL represents a red-sensitive emulsion layer.

The present invention is further illustrated by the following examples, but it will be understood that these examples are not intended to limit the scope of this invention in any manner. Unless otherwise indicated, all parts, precents, ratios and the like are by weight.

EXAMPLE 1

A color photographic material was prepared by forming layer 1 (nearest the support) to layer 7 on a paper support, both surfaces of which are coated with polyethylene. The polyethylene coating on the support at the emulsion layer-containing side contained titanium dioxide and a small amount of ultramarine blue. The compositions of layers 1 through 7 are as follows.

| | |
|---|---|
| **Layer 1: Blue-Sensitive Emulsion Layer:** | |
| Silver chlorobromide emulsion | 0.27 g/m$^2$ |
| (containing 80 mol % Br) | as silver coverage |
| Gelatin | 1.83 g/m$^2$ |
| Yellow coupler (*14) | $1.03 \times 10^{-3}$ mol/m$^2$ |
| Color image stabilizer (*15) | $2.05 \times 10^{-4}$ mol/m$^2$ |
| High-boiling organic solvent (*16) | 0.33 ml/m$^2$ |
| **Layer 2: Color Mixing Preventing Layer:** | |
| Gelatin | 0.89 g/m$^2$ |
| Color mixing preventing agent (*9) | 0.08 g/m$^2$ |
| High-boiling organic solvent (*13) | 0.17 ml/m$^2$ |
| **Layer 3: Green-Sensitive Emulsion Layer:** | |
| Silver chlorobromide emulsion | 0.19 g/m$^2$ |
| (containing 75 mol % Br) | as silver coverage |
| Gelatin | 1.78 g/m$^2$ |
| Magenta coupler (*10) | $3.87 \times 10^{-4}$ mol/m$^2$ |
| Color image stabilizer (*11) | $3.87 \times 10^{-4}$ mol/m$^2$ |
| Stain preventing agent (*12) | $5.42 \times 10^{-5}$ mol/m$^2$ |
| High-boiling organic solvent (*8) | 0.68 ml/m$^2$ |
| **Layer 4: Ultraviolet Absorptive Layer:** | |
| Gelatin | 0.50 g/m$^2$ |
| Ultraviolet absorbent (*4) | 0.62 g/m$^2$ |
| Color mixing preventing agent (*9) | 0.05 g/m$^2$ |
| High-boiling organic solvent (*5) | 0.30 ml/m$^2$ |
| **Layer 5: Red-Sensitive Emulsion Layer:** | |
| Silver chlorobromide emulsion | 0.22 g/m$^2$ |
| (containing 70 mol % Br) | as silver coverage |
| Gelatin | 0.90 g/m$^2$ |
| Cyan coupler (*6) | $6.68 \times 10^{-4}$ mol/m$^2$ |
| Color image stabilizer (*7) | $5.20 \times 10^{-4}$ mol/m$^2$ |
| High-boiling organic solvent (*8) | 0.23 ml/m$^2$ |
| **Layer 6: Ultraviolet Absorptive Layer:** | |
| Gelatin | 0.25 g/m$^2$ |
| Ultraviolet absorbent (*4) | 0.21 g/m$^2$ |
| High-boiling organic solvent (*5) | 0.15 ml/m$^2$ |
| **Layer 7: Protective Layer:** | |
| Gelatin | 1.33 g/m$^2$ |
| Slipping agent (*1) | 0.03 ml/m$^2$ |
| Antifungal agent (*2) | $1.50 \times 10^{-5}$ mol/m$^2$ |
| Acryl-modified copolymer of polyvinyl alcohol (*3) | 0.09 g/m$^2$ |

The compounds used in the formation of layers 1 to 7 are as follows:

(*1) Liquid Paraffin (*2)

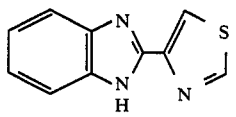

-continued
(*3) $\left(CH_2-\underset{OH}{CH}\right)_n$
(*4)
(a)
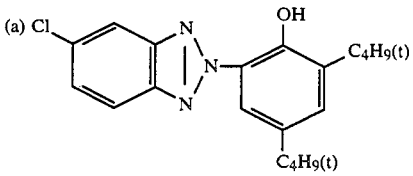
(b)
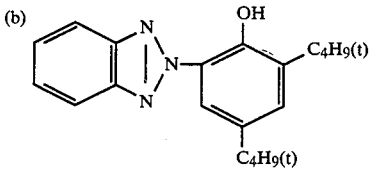
(c)
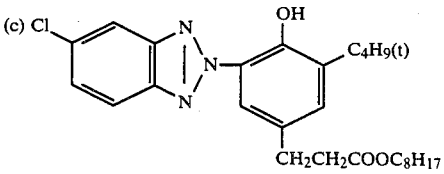
(a)/(b)/(c) = 2/9/8 (mol ratio)
(*5) $O{=}P(O\underset{CH_3}{CH}C_7H_{15})_3$
(*6)
(d)
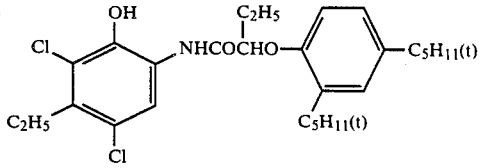
(e)
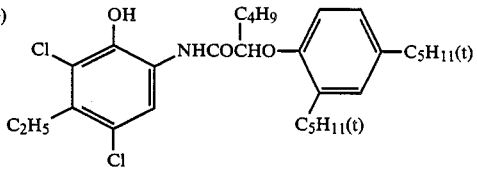
(d)/(e) = 1/1 (mol ratio)
(*7)
(f)
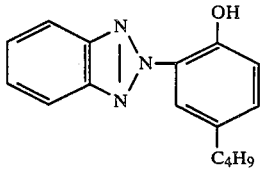
(f)/(b) of (*4)/(c) of (*4) = 20/19/7 (mol ratio)
(*8)
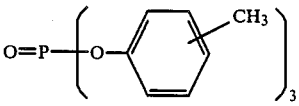
(*9)
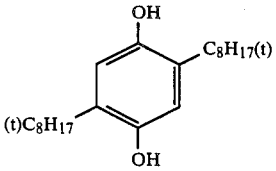
(*10)
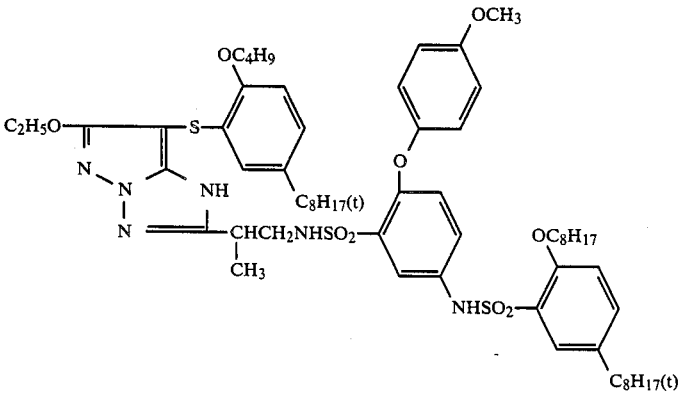
(*11)
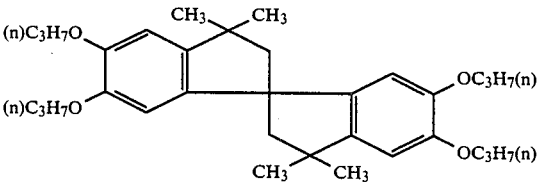

(*12)

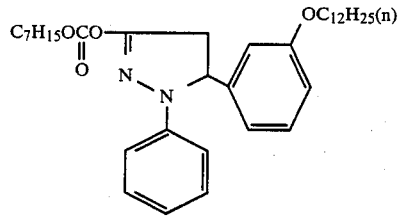

-continued (*13) (g)

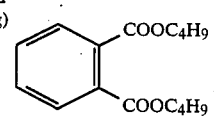

(*8)/(g) = 7/3 (volume ratio)

(*14)

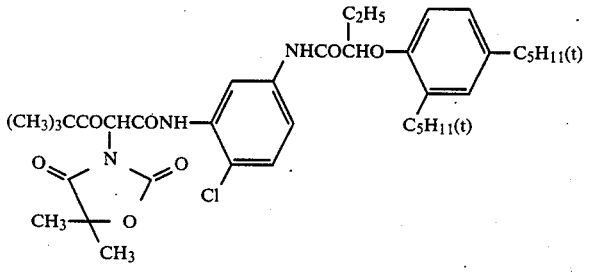

(*15)

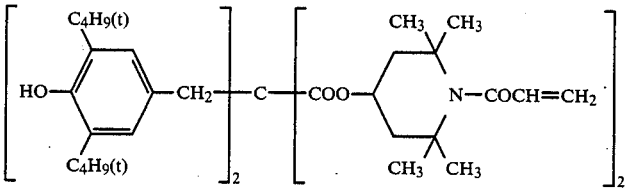

(*16) (g) of (*13)

In addition, the following dyes were also incorporated in each emulsion layer as a spectral sensitizer as follows.

Blue-Sensitive Emulsion Layer:

4-{5-Chloro-2-[5-chloro-3-(4-sulfonatobutyl)benzothiazolin-2-iridenemethyl]-3-benzothiazolio}butane sulfonate triethylammonium salt ($2\times10^{-4}$ mol per mol of silver halide)

Green-Sensitive Emulsion Layer:

3,3'-Di-(γ-sulfopropyl)-5,5'-diphenyl-9-ethyloxacarbocyanine sodium salt ($2.5\times10^{-4}$ mol per mol of silver halide)

Red-Sensitive Emulsion Layer:

3,3'-Di-(γ-sulfopropyl)-9-methyl-thiadicarbocyanine sodium salt ($2.5\times10^{-4}$ mol of silver halide).

Also, the following dyes were added to each emulsion layer as irradiation preventing dyes as follows.

Green-Sensitive Emulsion Layer:

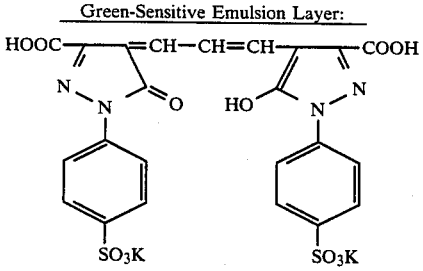

Red-Sensitive Emulsion Layer:

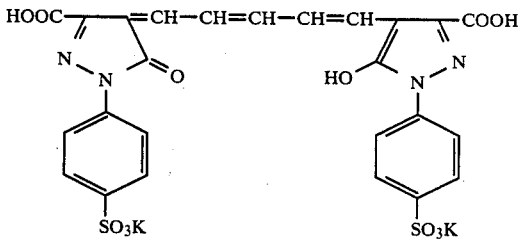

The color photographic material thus prepared was designated as Sample (A).

Samples (B) to (E) were prepared in the same manneras above except that the compositions of Layer 4 (Ultraviolet Absorptive Layer) and Layer 6 (Ultraviolet Absorptive Layer) of Sample (A) were changed as shown in Table 1 below.

TABLE 1

| Sample | Layer 6 | | | Layer 4 | | |
|---|---|---|---|---|---|---|
| (B) | (I) | Gelatin | 0.53 g/m² | (IV) | Gelatin | 1.58 g/m² |
| | (II) | (*4) | — | (V) | (*4) | — |
| | (III) | (*5) | — | (VI) | (*9) | 0.05 g/m² |
| | | | | (VII) | (*5) | — |
| (C) | (I) | Gelatin | 0.53 g/m² | (IV) | Gelatin | 1.58 g/m² |
| | (II) | (*4) | 0.21 g/m² | (V) | (*4) | 0.62 g/m² |
| | (III) | (*5) | 0.08 ml/m² | (VI) | (*9) | 0.05 g/m² |
| | | | | (VII) | (*5) | 0.24 ml/m² |
| (D) | (I) | Gelatin | 0.53 g/m² | (IV) | Gelatin | 1.58 g/m² |
| | (II) | (*4) | 0.21 g/m² | (V) | (*4) | 0.62 g/m² |
| | (III) | (*5) | 0.02 ml/m² | (VI) | (*9) | 0.05 g/m² |
| | | | | (VII) | (*5) | 0.06 ml/m² |
| (E) | (I) | Gelatin | 0.53 g/m² | (IV) | Gelatin | 1.58 g/m² |
| | (II) | (*4) | 0.21 g/m² | (V) | (*4) | 0.62 g/m² |
| | (III) | (*5) | — | (VI) | (*9) | 0.05 g/m² |

TABLE 1-continued

| Sample | Layer 6 | Layer 4 |
|---|---|---|
| | (VII) | (*5) — |

Sample (B): Comparison Sample
Samples (C) to (E): Samples of the present invention
(II) and (V): Ultraviolet Absorbent (*4)
(III) and (VII): High-boiling Organic Solvent (*5)
(VI): Color Mixing Preventing Agent (*9)

In Samples (B) to (E), however, when the solubility was reduced with the reduction of the solvent during the preparation of each sample, ethyl acetate was used as an auxiliary solvent in an amount necessary for dissolving the additive(s).

Also, the following compound was used as the gelatin hardening agent for each layer:

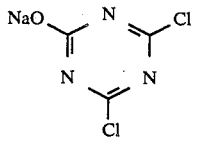

After exposing each of the thus-obtained samples through an optical wedge, the samples were processed in the following manner, using either processing step A (using Color Developer I) or processing step B (using Color Developer II) shown below.

Evaluation of the photographic properties of the resulting images was performed as the relative sensitivity and the maximum density (Dmax) for each sample.

The relative sensitivity is the relative value of each sample when the sensitivity of each light-sensitive emulsion layer of Sample (A), after being color developed for 2 minutes according to processing step A, is defined as 100.

Each sample was developed and processed as outlined below.

| Processing Step | Temperature | Time |
|---|---|---|
| Color development | 37° C. | 2 min. 00 sec. |
| Blix | 33° C. | 1 min. 00 sec. |
| Wash 1 | 30° C. | 20 sec. |
| Wash 2 | 30° C. | 20 sec. |
| Wash 3 | 30° C. | 20 sec. |
| Drying | 80° C. | 1 min. 00 sec. |

The compositions of the processing solutions used in the above processing steps were as follows.

| | |
|---|---|
| **Color Developer I: (Processing Step A)** | |
| Water | 800 ml |
| Diethylenetriaminepentaacetic Acid | 3.0 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30.0 g |
| N—Ethyl-N—(β-methanesulfonamidoethyl)-3-methyl-4-aminoaniline Sulfate | 5.5 g |
| Hydroxylamine Sulfate | 4.0 g |
| Brightening Agent (Stilbene series) | 1.0 g |
| Water to make | 1,000 ml |
| pH adjusted to | 10.25 |
| **Color Developer II: (Processing Step B)** | |
| Water | 800 ml |
| Diethylenetriaminepentaacetic Acid | 3.0 g |
| Sodium Sulfite | 2.0 g |
| Potassium Bromide | 0.5 g |
| Potassium Carbonate | 30.0 g |
| N—Ethyl-N—(β-methanesulfonamidoethyl)-3-methyl-4-aminoaniline Sulfate | 5.5 g |
| Hydroxylamine Sulfate | 4.0 g |
| Brightening Agent (Stilbene series) | 1.0 g |
| Water to make | 1,000 ml |
| pH adjusted to | 10.25 |
| **Blix Solution (Common to Processing Steps A and B)** | |
| Ammonium Thiosulfate (70% solution) | 200 ml |
| Sodium Sulfite | 18 g |
| Ammonium Ethylenediaminetetraacetato Ferrate | 65 g |
| Ethylenediaminetetraacetic acid Di-Sodium Salt | 5 g |
| Color Developer as shown above | 350 ml |
| Water to make | 1,000 ml |
| pH adjusted to | 7.00 |

The test results are shown in Table 2 below.

TABLE 2

| Sample | Oil content/Gelatin* (volume ratio) Layer 6 | Layer 4 | Emulsion Layer | Processing Step A Dmax | Relative Sensitivity | Processing Step B Dmax | Relative Sensitivity |
|---|---|---|---|---|---|---|---|
| (A) | 0.80 | 0.80 | B | 2.11 | 100 | 1.69 | 58 |
| | | | G | 2.70 | 100 | 2.16 | 72 |
| | | | R | 2.82 | 100 | 2.25 | 68 |
| (B) | 0 | 0 | B | 2.17 | 104 | 1.95 | 99 |
| [(E)] | | | G | 2.68 | 105 | 2.41 | 100 |
| | | | R | 2.90 | 106 | 2.61 | 98 |
| (C) | 0.2 | 0.2 | B | 2.15 | 102 | 2.00 | 101 |
| | | | G | 2.67 | 102 | 2.50 | 100 |
| | | | R | 2.90 | 105 | 2.73 | 103 |
| (D) | 0.05 | 0.05 | B | 2.16 | 103 | 2.07 | 102 |
| | | | G | 2.70 | 103 | 2.64 | 103 |
| | | | R | 2.89 | 106 | 2.83 | 105 |

*Gelatin: d = 1.34

As is clear from the results shown in Table 2 above, it can be seen that while the results of Samples (B) to (E) are almost the same as the relative sensitivity and Dmax values both when processed using the color developer II containing not benzyl alcohol and when processed using the color developer I containing benzyl alcohol, the coloring properties of Comparative Sample (A) are greatly reduced when processed with color developer II without benzyl alcohol. This is considered to be due to the fact that the volume ratio of oil component/gelatin in Layer 4 and Layer 6 of Sample (A) is high and hence the permeability of the developing agent during color development is reduced. On the other hand, it is considered that in Samples (B) to (E), because the ratio of oil component/gelatin in Layer 4 and Layer 6 is low, the coating amount of the solvent is reduced to increase the permeability of the color developing agent.

EXAMPLE 2

After processing the samples prepared as in Example 1 by the same procedures as described in Example 1, a light fastness test was performed on each sample.

The light fastness value is measured by the percentage of a color density after the light fastness test in a portion having color density of 2.0 before the light fastness test to the color density of 2.0.

The light fastness test was performed by the irradiating each sample with a xenon fade-o-meter (85,000 lux) for 200 hours.

The results obtained are shown in Table 3 below.

TABLE 3

| | Oil content/Gelatin* (volume ratio) | | Processing Step A | | | | Processing Step B | | | |
|---|---|---|---|---|---|---|---|---|---|---|
| | | | Color Image Fastness to Light (%) | | | Stain at the Background | Color Image Fastness to Light (%) | | | Stain at the Background |
| Sample | Layer 6 | Layer 4 | Cyan | Magenta | Yellow | Portion | Cyan | Magenta | Yellow | Portion |
| (A) | 0.80 | 0.80 | 78 | 77 | 74 | 0.22 | 81 | 80 | 76 | 0.20 |
| (B) | 0 | 0 | 52 | 50 | 45 | 0.30 | 56 | 55 | 50 | 0.27 |
| (C) | 0.2 | 0.2 | 83 | 82 | 79 | 0.17 | 87 | 86 | 84 | 0.10 |
| (D) | 0.05 | 0.05 | 85 | 84 | 82 | 0.15 | 90 | 90 | 88 | 0.08 |
| (E) | 0 | 0 | 87 | 87 | 85 | 0.14 | 92 | 93 | 91 | 0.07 |

As is clear from the results shown in Table 3, it can be seen that Samples (C) to (E) of this invention having a low ratio of oil component/gelatin to reduce the amount of the components of the processing solutions which may be picked up by the color photographic material during processing show good light fastness of the cyan, magenta, and yellow colors as well as exhibiting an excellent reduction effect as to the formation of stains in the background portion.

Furthermore, Samples (A) to (E) prepared as described above were processed as above and the samples thus processed were allowed to stand for 2 weeks under the conditions of 70° C. and 80% RH. The densities of the samples were measured and the results thus obtained are shown in Table 4 below, wherein the percentage of cyan, magenta, and yellow densities after allowing the color photographic material to stand for 2 weeks at 70° C. and 80% RH in each portion having the cyan, magenta, and yellow densities of 2.0 before the test to the cyan, magenta, and yellow densities of 2.0 is shown. Furthermore, the so-called stain at the background portion measured on the blue density is also shown in the same table.

TABLE 4

| | Processing Step A | | | | Processing Step B | | | |
|---|---|---|---|---|---|---|---|---|
| | Color Image Fastness (%) | | | | Color Image Fastness (%) | | | |
| Sample | Cyan | Magenta | Yellow | Stain | Cyan | Magenta | Yellow | Stain |
| (A) | 94 | 98 | 97 | 0.24 | 96 | 100 | 97 | 0.16 |
| (B) | 96 | 99 | 98 | 0.20 | 98 | 100 | 99 | 0.14 |
| (C) | 96 | 99 | 98 | 0.20 | 98 | 100 | 99 | 0.12 |
| (D) | 96 | 99 | 99 | 0.18 | 99 | 100 | 100 | 0.11 |
| (E) | 95 | 99 | 99 | 0.17 | 98 | 100 | 100 | 0.09 |

The results of testing the color image fastness under the aforesaid high temperature and high humidity conditions shown in Table 4 above clearly demonstrate that the use of the ultraviolet absorbents of the present invention result in excellent color image stability. This effect is particularly remarkable as to prevention of stains, and it is considered as due to a reduction of the amount of the developing agent remaining in the material after processing.

EXAMPLE 3

Color photographic materials (Samples (F) to (J) and Samples (K) to (O)) were prepared by changing the compositions of the blue-sensitive emulsion layer of Layer 1, the green-sensitive emulsion layer of Layer 3, and the red-sensitive emulsion layer of Layer 5 in the layer structure described in Example 1 as shown in Table 5. Other layers of each of these Samples were the same as those described in Example 1, and also the gelatin hardening agent and the irradiation preventing agent were the same as those used in Example 1. Samples (F) to (J) and Samples (K) to (O) each corresponds to Samples (A) ti (E) of Example 1.

TABLE 5

| Layer | Main Components | Samples (F)-(J) Coated Amount | Samples (K)-(O) Coated Amount |
|---|---|---|---|
| Layer 1 (Blue-Sensitive Emulsion Layer) | Silver Chlorobromide Emulsion (Cl 90 mol %) | 0.27 g/m$^2$ | 0.27 g/m$^2$ |
| | Gelatin | 1.83 g/m$^2$ | 1.83 g/m$^2$ |
| | Yellow Coupler | *17 1.03 × 10$^{-3}$ mol/m$^2$ | *14 1.03 × 10$^{-3}$ mol/m$^2$ |
| | Color Image Stabilizer | *15 2.05 × 10$^{-4}$ mol/m$^2$ | *15 2.05 × 10$^{-4}$ mol/m$^2$ |
| | Solvent | *16 0.33 ml/m$^2$ | *16 0.33 ml/m$^2$ |
| Layer 3 (Green-Sensitive Emulsion Layer) | Silver Chlorobromide Emulsion (Cl 90 mol %) | 0.19 g/m$^2$ | 0.38 g/m$^2$ |
| | Gelatin | 1.78 g/m$^2$ | 2.00 g/m$^2$ |
| | Magenta Coupler | *18 3.87 × 10$^{-4}$ mol/m$^2$ | *20 3.87 × 10$^{-4}$ mol/m$^2$ |
| | Color Image Stabilizer | *9 1.16 × 10$^{-5}$ mol/m$^2$ | *9 1.16 × 10$^{-5}$ mol/m$^2$ |
| | Color Image Stabilizer | *11 3.87 × 10$^{-4}$ mol/m$^2$ | *11 3.87 × 10$^{-4}$ mol/m$^2$ |
| | Stain Preventing Agent | — | — |
| | Solvent | *8 0.68 ml/m$^2$ | *8 0.68 ml/m$^2$ |
| Layer 5 (Red-Sensitive Emulsion Layer) | Silver Chlorobromide Emulsion (Cl 90 mol %) | 0.22 g/m$^2$ | 0.22 g/m$^2$ |
| | Gelatin | 0.90 g/m$^2$ | 0.90 g/m$^2$ |
| | Cyan Coupler | *19 6.68 × 10$^{-4}$ mol/m$^2$ | *19 6.68 × 10$^{-4}$ mol/m$^2$ |
| | Color Image Stabilizer | *7 5.20 × 10$^{-4}$ mol/m$^2$ | *7 5.20 × 10$^{-4}$ mol/m$^2$ |
| | Solvent | *8 0.23 ml/m$^2$ | *8 0.23 ml/m$^2$ |

The compounds described in Table 5 are as follows. In addition, the compounds represented by (*7), (*8), (*9), (*11), (*14), (*15), and (*16) are the same as in Example 1.

tin in the ultraviolet absorptive layers, and thus demonstrate the effectiveness of this invention.

EXAMPLE 4

(*17)

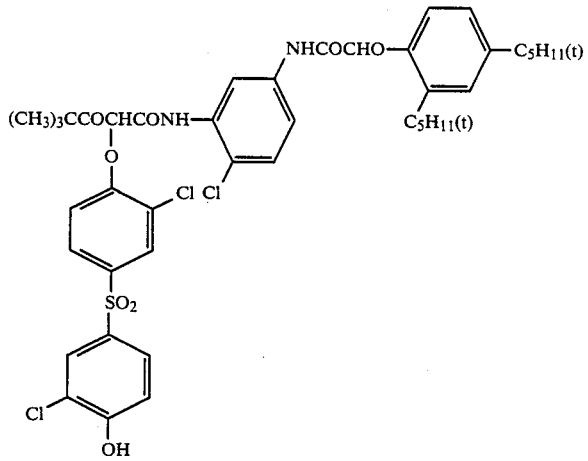

(*18)

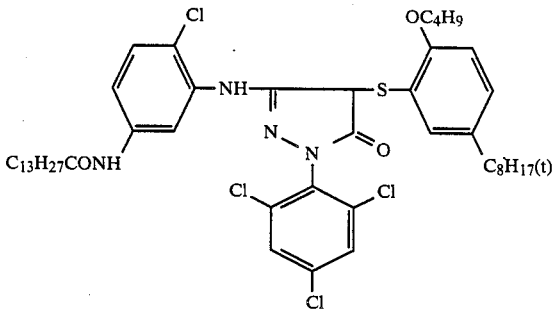

(*19)

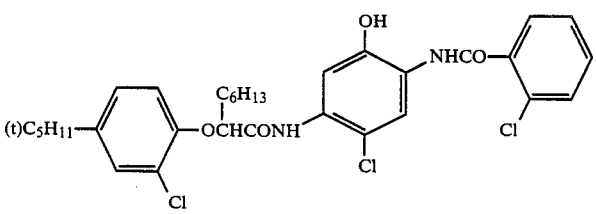

(*20)

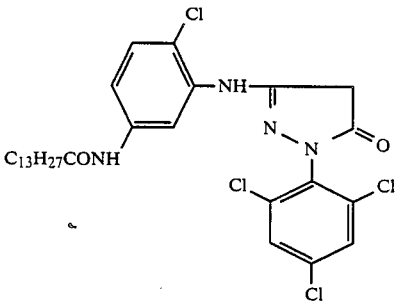

(*19)/(d) of (*6) = 1/1 (mol ratio)

When Processing Steps A and B as in Example 1 were applied to each of the samples thus prepared and the photographic properties of the resulting images were compared, similar results to those shown in Table 2 were obtained. Furthermore, the these samples were processed as above followed by the light fastness test as in Example 2, similar results to those shown in Table 3 above were obtained.

That is, the results are as follows:

Samples (F) to (J):

Light Fastness and Stain Preventing Effect:

(good) Processing Step B>Processing Step A (good) (J)>(I)>(H)>(F)>>(G)

Samples (K) to (O)

Light Fastness and Stain Preventing Effect:

(good) Processing Step B>Processing Step A (good) (O)>(N)>(M)>(K)>>(L)

The above shown excellent results are clearly due to a reduction of the volume ratio of oil component/gelatin in the ultraviolet absorptive layers, and thus demonstrate the effectiveness of this invention.

A color photographic material [Sample (P)] was prepared by forming Layer 1 (lower layer, i.e., closest to the support) to Layer 7 (uppermost layer) on a paper support having a polyethylene coating on both surfaces thereof which has been subjected to a corona discharging treatment.

The coating composition for Layer 1 was prepared as follows. After heating a mixture of 200 g of the yellow coupler shown below, 93.9 g of the fading preventing agent, 10 g of the high-boiling organic solvent (c), 5 g of the high-boiling organic solvent (d), and 600 ml of ethyl acetate as an auxiliary solvent of 60° C. to dissolve the additives, the mixture was mixed with 3,300 ml of an aqueous 5% gelatin solution containing 330 ml of an aqueous solution of 5% Alkanol B (a trade name for alkylnaphthalene sulfonate, made by Du Pont Co.) and the resultant mixture was emulsified using a colloid mil to provide a coupler dispersion. Ethyl acetate was distilled off from the dispersion under reduced pressure, the dispersion was added to 1,400 g of a silver halide emulsion (containing 96.7 g of silver halide as Ag and 170 g of gelatin) containing a sensitizing dye for the blue-sensitive emulsion layer, i.e., 1-methyl-2-mercapto-5-acetylamino-1,3,4-triazole, and further, 2,600 g of an aqueous 10% gelatin solution was added thereto to provide the coating composition.

Coating compositions for Layers 2to 7 were also prepared according to the procedure described above. The compositions for each layer are as follows:

| | |
|---|---|
| Layer 1: Blue-Sensitive Emulsion Layer | |
| Silver Chlorobromide Emulsion (silver bromide 90 mol %) | 290 mg/m$^2$ as silver coverage |
| Yellow Coupler (*l) | 600 mg/m$^2$ |
| Fading Preventing Agent (*g) | 280 mg/m$^2$ |
| Solvent (*c) | 0.03 ml/m$^2$ |
| Solvent (*d) | 0.015 ml/m$^2$ |
| Gelatin | 1800 mg/m$^2$ |
| Layer 2: Color Mixing Preventing Layer | |
| Silver Bromide Emulsion | 10 mg/m$^2$ as silver coverage |
| Color Mixing Preventing Agent (*h) | 55 mg/m$^2$ |
| Solvent (*c) | 0.30 ml/m$^2$ |
| Solvent (*d) | 0.10 ml/m$^2$ |
| Gelatin | 800 mg/m$^2$ |
| Layer 3: Green-Sensitive Emulsion Layer | |
| Silver Chlorobromide Emulsion (silver bromide 74 mol %) | 305 mg/m$^2$ as silver coverage |
| Magenta Coupler (*i) | 670 mg/m$^2$ |
| Fading Preventing Agent (*j) | 150 mg/m$^2$ |
| Fading Preventing Agent (*k) | 10 mg/m$^2$ |
| Solvent (*c) | 0.20 ml/m$^2$ |
| Solvent (*d) | 0.01 ml/m$^2$ |
| Gelatin | 1400 mg/m$^2$ |
| Layer 4: Color Mixing Preventing Layer | |
| Color Mixing Preventing Agent (*h) | 65 mg/m$^2$ |
| Ultraviolet Absorbent (*a) | 450 mg/m$^2$ |
| Ultraviolet Absorbent (*b) | 230 mg/m$^2$ |
| Solvent (*c) | 0.75 ml/m$^2$ |
| Solvent (*d) | 0.25 ml/m$^2$ |
| Gelatin | 1700 mg/m$^2$ |
| Layer 5: Red-Sensitive Emulsion Layer | |
| Silver Chlorobromide Emulsion (silver bromide 74 mol %) | 210 mg/m$^2$ as silver coverage |
| Cyan Coupler (*e) | 260 mg/m$^2$ |
| Cyan Coupler (*f) | 120 mg/m$^2$ |
| Fading Preventing Agent (*g) | 250 mg/m$^2$ |
| Solvent (*c) | 0.16 ml/m$^2$ |
| Solvent (*d) | 0.10 ml/m$^2$ |
| Gelatin | 1800 mg/m$^2$ |
| Layer 6: Ultraviolet Absorbent Layer | |
| Ultraviolet Absorbent (*a) | 260 mg/m$^2$ |
| Ultraviolet Absorbent (*b) | 70 mg/m$^2$ |
| Solvent (*c) | 0.30 ml/m$^2$ |
| Solvent (*d) | 0.10 ml/m$^2$ |
| Gelatin | 700 mg/m$^2$ |
| Layer 7: Protective Layer | |
| Gelatin | 600 mg/m$^2$ |

The following sensitizing dyes were used for the emulsion layers:

Blue-Sensitive Emulsion Layer:

Anhydro-5-methoxy-5'-methyl-3,3'-disulfopropylselenacyanine hydroxide

Green-Sensitive Emulsion Layer:

Anhydro-9-ethyl-5,5'-diphenyl-3,3'-disulfoethyloxacarbocyanine hydroxide

Red-Sensitive Emulsion Layer:

3,3'-Diethyl-5-methoxy-9,9'-(2,2-dimethyl-1,3-propano)thiadicarbocyanine iodide

Also, the following compound was used for each emulsion layer as a stabilizer:

1-Methyl-2-mercapto-5-acetylamino-1,3,4-triazole.

Furthermore, the following compounds were used as irradiation preventing dyes:

(a) 4-{3-Carboxy-5-hydroxy-4-[3-(3-carboxy-5-oxo-1-(4-sulfonaphthophenyl)-2-pyrazolin-4-iridene)-1-propenyl]-1-pyrazolyl}benzene sulfonate di-potassium salt;

(b) N,N'-(4,8-Dihydroxy-9,10-dioxo-3,7-disulfonatoanthrane-1,5-diyl)bis(aminomethanesulfonato)-tetrasodium salt.

Also, 1,2-bis(vinylsulfonyl)ethane was used as a hardener for each layer.

The compounds used in the various layers of the color photographic materials described above are as follows.

*a: 2-(2-Hydroxy-3,5-di-tert-amylphenyl)benzotriazole
*b: 2-(2-Hydroxy-3,5-di-tert-butylphenyl)benzotriazole
*c: Di(2-ethylhexyl) phthalate
*d: Dibutyl phthalate
*e: 2-Pentafluorobenzamido-4-chloro-5-[2-(2,4-di-tert-amylphenoxy)-3-methylbutylamido]phenol
*f: 2,4-Dichloro-3-methyl-6-[α-(2,4-di-tert-amylphenoxy)butylamido]phenol
*g: 2,5-Di-Tert-amylphenyl-3,5-di-tert-butylhydroxybenzoate
*h: 2,5-Di-tert-octylhydroquinone
*i: 1-(2,4,6-Trichlorophenyl-3-[2-chloro-5-(3-octenylsuccinimido)anilino]-5-pyrazolone
*j: 1,4-Di-tert-amyl-2,5-dioctyloxybenzene
*k: 2,2'-Methylenebis(4-methyl-6-tert-butylphenol)
*l: α-Pivalyl-α-(3-benzyl-1-hydantoinyl)-{2-chloro-5-[γ-(2,4-di-tert-amylphenoxy)butyl]amido}acetoaniline Also, Samples (Q), (R) and (S) were prepared by the same procedure as above except that the amount of the oil component in Layer 2, Layer 4, and Layer 6 of Sample (P) was changed as shown in Table 6 below.

TABLE 6

| | Sample No. | (P) | (Q) | (R) | (S) |
|---|---|---|---|---|---|
| Layer 2 | Solvent (*c) | 0.30 ml/m$^2$ | " | " | 0.06 |
| | Solvent (*d) | 0.10 ml/m$^2$ | " | " | 0.02 |
| | Oil component/Gelatin | 0.68 ml/m$^2$ | " | " | 0.14 |
| Layer 4 | Solvent (*c) | 0.75 ml/m$^2$ | " | 0.15 | " |
| | Solvent (*d) | 0.25 ml/m$^2$ | " | 0.05 | " |
| | Oil component/Gelatin | 0.79 ml/m$^2$ | " | 0.16 | " |
| Layer 6 | Solvent (*c) | 0.30 ml/m$^2$ | 0.06 | " | " |
| | Solvent (*d) | 0.10 ml/m$^2$ | 0.02 | " | " |
| | Oil component/Gelatin | 0.77 ml/m$^2$ | 0.15 | " | " |

Note:
"/" in the Table refers to the same values as those shown to the left.

After imagewise exposure, each of Samples (P) to (S) thus prepared was processed as follows:

| Processing Step | Temperature | Time |
|---|---|---|
| Color Development | 36° C. | 45 sec. |
| Blix | 36° C. | 45 sec. |
| Wash | 30° C. | 60 sec. |
| Drying | 70° C. | 60 sec. |

The compositions for these processing solutions were as follows.

In addition, for Processing Steps A and B, Color Developers I and II were used, respectively.

| Color Developer: | I | II |
|---|---|---|
| Benzyl Alcohol | 15 ml | — |
| Diethylene Glycol | 15 ml | — |
| Potassium Sulfite | 2.0 g | 2.0 g |
| Potassium Bromide | 1.1 g | 1.1 g |
| Sodium Chloride | 0.2 g | 0.2 g |
| Potassium Carbonate | 30.0 g | 30.0 g |
| Hydroxylamine Sulfate | 3.0 g | 3.0 g |
| Hydroxyethoxyiminodiacetic Acid | 4.0 g | 4.0 g |
| 1-Hydroxyethylidene-1,1'-disulfonic Acid | 1.0 g | 1.0 g |
| Magnesium Chloride | 0.8 g | 0.8 g |
| 3-Methyl-4-amino-N—ethyl-N—(β-methanesulfonamidoethyl)aniline Sulfate | 5.5 g | 5.5 g |
| Brightening Agent (4,4'-diamino-stilbenedisulfonic Acid Derivatives) | 1.0 g | 1.0 g |
| Potassium Hydroxide | 2.0 g | 2.0 g |
| Water to make | 1 liter | 1 liter |
| pH | 10.25 | 10.25 |

| Blix Solution: | |
|---|---|
| Ammonium Ethylenediaminetetraacetato Ferrate Di-hydrate | 60 g |
| Ethylenediaminetetraacetic Acid | 3 g |
| Ammonium Thiosulfate (70% solution) | 100 ml |
| Ammonium Sulfite (40% solution) | 27.5 ml |
| Water to make | 1 liter |
| pH adjusted to 7.1 with potassium carbonate of glacial acetic acid | |

The maximum values (Dmax) of the red light, green light, and blue light reflection densities of images obtained after undergoing Processing Steps A and B, respectively, are shown in Table 7 below.

TABLE 7

| | Processing Step A Dmax | | | Processing Step B Dmax | | |
|---|---|---|---|---|---|---|
| Sample No. | R | G | B | R | G | B |
| (P) | 2.90 | 2.68 | 2.24 | 2.36 | 2.21 | 1.86 |
| (Q) | 2.93 | 2.69 | 2.24 | 2.83 | 2.66 | 2.14 |
| (R) | 2.98 | 2.70 | 2.25 | 2.90 | 2.69 | 2.21 |
| (S) | 2.94 | 2.71 | 2.24 | 2.92 | 2.72 | 2.23 |

From the results shown in Table 7, it can be seen that in Processing Step A (containing benzyl alcohol in the color developer), all the samples shown sufficient coloring ability, but in Processing Step B (containing no benzyl alcohol in the color developer), Dmax of Comparative Sample (P) is too low to use for practical purposes, whereas Samples (Q), (R), and (S) show excellent coloring ability necessary for practical usage. In particular, Sample (S) of the present invention shows almost the same coloring ability as that obtained when processed by Processing Step A.

Each sample was then subjected to a light irradiation test by a xenon fade-o-meter as in Example 2, and the results obtained are shown in Table 8 below.

TABLE 8

| | Processing Step A | | | | Processing Step B | | | |
|---|---|---|---|---|---|---|---|---|
| | Color Image Fastness to Light (%) | | | Stain at the Background | Color Image Fastness to Light (%) | | | Stain at the Background |
| Sample | Cyan | Magenta | Yellow | Portion | Cyan | Magenta | Yellow | Portion |
| (P) | 76 | 75 | 72 | 0.31 | 78 | 77 | 75 | 0.28 |
| (Q) | 75 | 74 | 73 | 0.28 | 83 | 82 | 80 | 0.14 |
| (R) | 77 | 78 | 75 | 0.27 | 85 | 86 | 82 | 0.12 |
| (S) | 78 | 76 | 76 | 0.26 | 89 | 91 | 89 | 0.12 |

From the results shown in Table 8, it can be seen that in Samples (Q), (R), and (S) processed by Processing Step B of this invention, the light fastness value is higher, the formation of stain at the background portions is remarkably lower, and the images have excellent light fastness as compared with the case of processing all samples with Processing Step A and processing Sample (P) with Processing Step B. In particular, this effect is remarkable in Sample (V) processed by Processing Step B.

EXAMPLE 5

A color photographic material was prepared by forming layer 1 (nearest the support) to layer 7 on a paper support, both surfaces of which were coated with polyethylene. The polyethylene coating on the support at the emulsion layer-containing side contained titanium dioxide and a small amount of ultramarine blue. The compositions of layers 1 through 7 are as follows.

| | |
|---|---|
| Layer 1: Blue-Sensitive Emulsion Layer: | |
| Silver chloride emulsion | 0.27 g/m$^2$ |
| (containing 1 mol % Br) | as silver coverage |
| Gelatin | 1.83 g/m$^2$ |
| Yellow coupler (*14) | 1.03 × 10$^{-3}$ mol/m$^2$ |
| Color image stabilizer (*15) | 2.05 × 10$^{-4}$ mol/m$^2$ |
| High-boiling organic solvent (*16) | 0.38 ml/m$^2$ |
| Layer 2: Color Mixing Preventing Layer: | |
| Gelatin | 1.14 g/m$^2$ |
| Color mixing preventing agent (*9) | 0.08 g/m$^2$ |
| High-boiling organic solvent (*13) | 0.17 ml/m$^2$ |
| Layer 3: Green-Sensitive Emulsion Layer: | |
| Silver chloride emulsion | 0.21 g/m$^2$ |
| (containing 1 mol % Br) | as silver coverage |
| Gelatin | 1.97 g/m$^2$ |
| Magenta coupler (*10) | 3.87 × 10$^{-4}$ mol/m$^2$ |
| Color image stabilizer (*11) | 3.87 × 10$^{-4}$ mol/m$^2$ |
| Stain preventing agent (*12) | 5.42 × 10$^{-5}$ mol/m$^2$ |
| High-boiling organic solvent (*8) | 0.64 ml/m$^2$ |
| Layer 4: Ultraviolet Absorptive Layer: | |
| Gelatin | 0.50 g/m$^2$ |
| Ultraviolet absorbent (*4) | 0.62 g/m$^2$ |
| Color mixing preventing agent (*9) | 0.05 g/m$^2$ |
| High-boiling organic solvent (*5) | 0.30 ml/m$^2$ |
| Layer 5: Red-Sensitive Emulsion Layer: | |
| Silver chloride emulsion | 0.22 g/m$^2$ |
| (containing 1 mol % Br) | as silver coverage |
| Gelatin | 0.90 g/m$^2$ |
| Cyan coupler (*6) | 6.68 × 10$^{-4}$ mol/m$^2$ |
| Color image stabilizer (*7) | 5.20 × 10$^{-4}$ mol/m$^2$ |
| High-boiling organic solvent (*8) | 0.25 ml/m$^2$ |
| Layer 6: Ultraviolet Absorptive Layer: | |
| Gelatin | 0.25 g/m$^2$ |
| Ultraviolet absorbent (*4) | 0.21 g/m$^2$ |
| High-boiling organic solvent (*5) | 0.15 ml/m$^2$ |
| Layer 7: Protective Layer: | |
| Gelatin | 1.33 g/m$^2$ |
| Slipping agent (*1) | 0.03.ml/m$^2$ |
| Antifungal agent (*2) | 1.50 × 10$^{-5}$ mol/m$^2$ |

-continued
| | |
|---|---|
| Acryl-modified copolymer of polyvinyl alcohol (*3) | 0.09 g/m$^2$ |
The compounds used in the formation of layers 1 to 7 are as follows:
Liquid Paraffin
(*1)
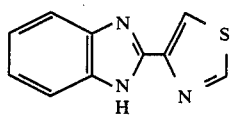
(*2)
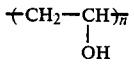
(*3)
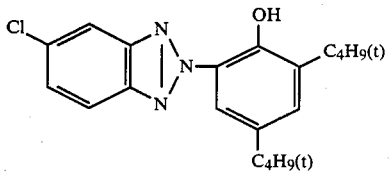
(*4) (a)
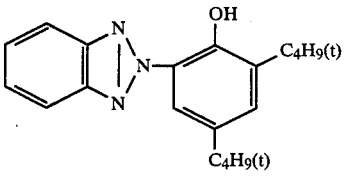
(b)
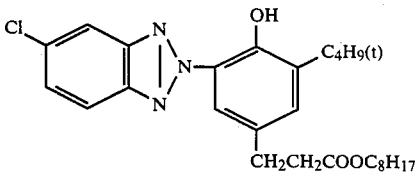
(c)
(a)/(b)/(c) = 2/9/8 (mol ratio)
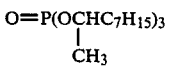
(*5)
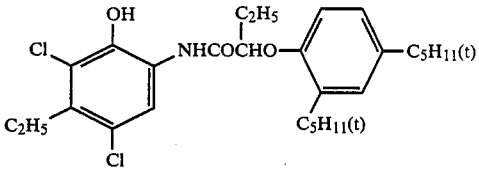
(*6) (d)
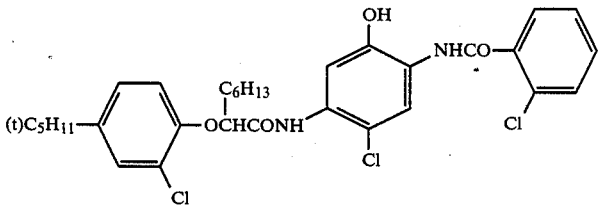
(e)
(d)/(e) = 1/1 (mol ratio)
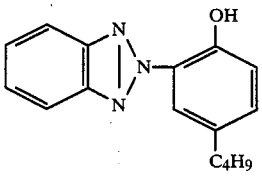
(*7) (f)
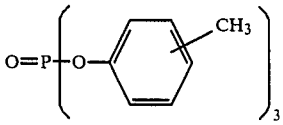
(*8)
(f)/(b) of (*4)/(c) of (*4) = 20/19/7 (mol ratio)
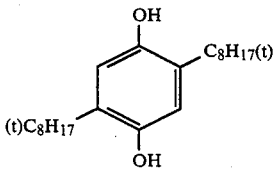
(*9)

-continued
(II-46) (*10)
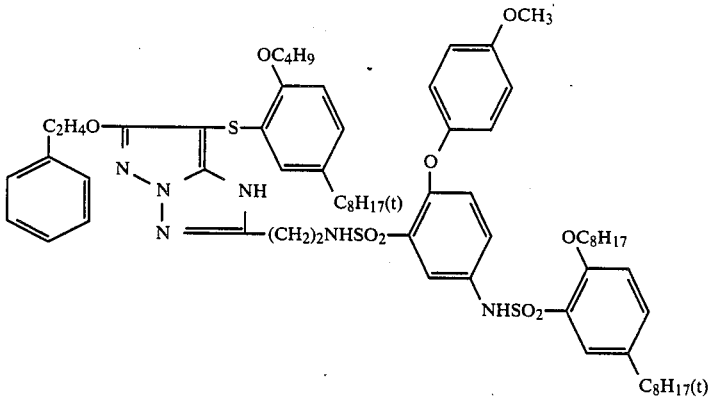
(*11)
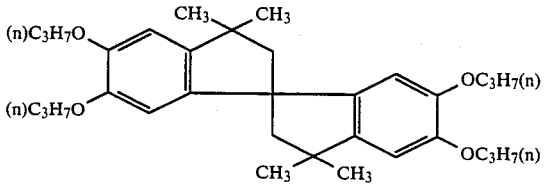
(*12)
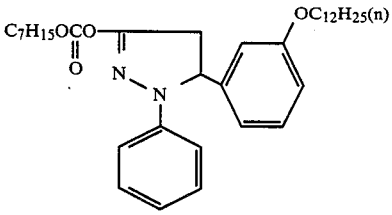
(*13) (g)
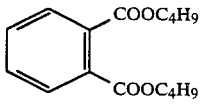
*8/(g) = 7/3 (volume ratio)
(*14)
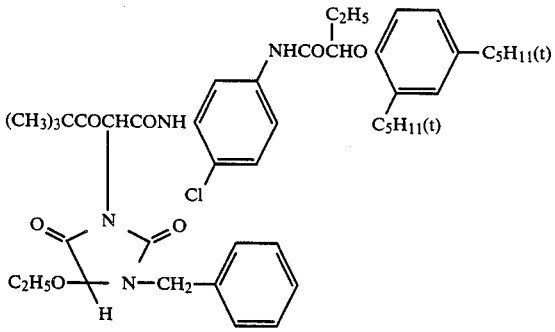
(*15)
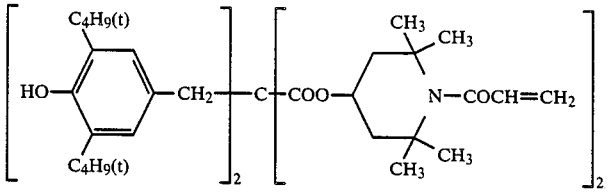
(g) of (*13) (*16)
In addition, the following dyes were also incorporated in each emulsion layer as a spectral sensitizer as follows.

Blue-Sensitive Emulsion Layer:

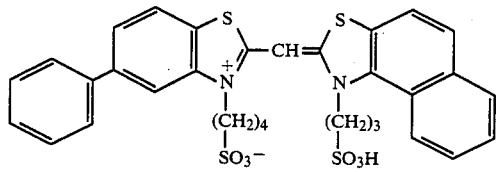

($5.0 \times 10^{-4}$ mol per mol of silver halide)

Green-Sensitive Emulsion Layer:

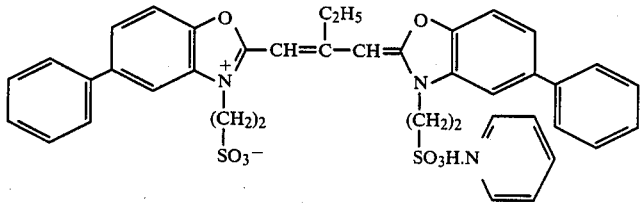

($4.0 \times 10^{-4}$ mol per mol of silver halide) and

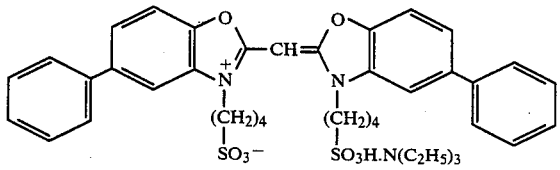

($7.0 \times 10^{-5}$ mol per mol of silver halide)

Red-Sensitive Emulsion Layer:

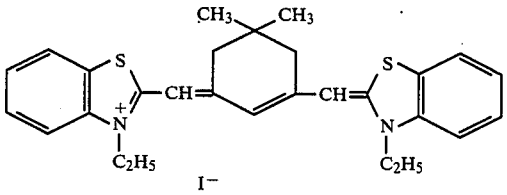

($0.9 \times 10^{-4}$ mol per mol of silver halide).

Also, the following compound was added to the red-sensitive emulsion layer in an amount of $2.6 \times 10^{-3}$ mol per mol of silver halide.

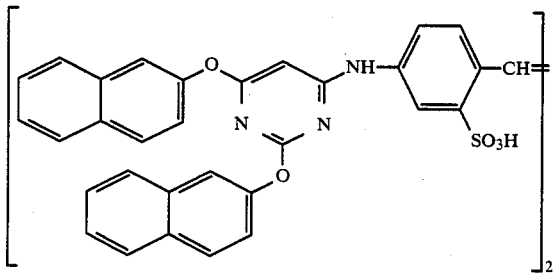

Furthermore, 1-(5-methylureidophenyl)-5-mercaptotetrazole was added to the blue-sensitive emulsion layer in an amount of $8.5 \times 10^{-5}$ mol per mol of silver halide, to the green-sensitive emulsion layer in an amount of $7.7 \times 10^{-4}$ mol per mol of silver halide, and to the red-sensitive emulsion layer in an amount of $2.5 \times 10^{-4}$ mol per mol of silver halide.

Also, the following dyes were added to each emulsion layer as irradiation preventing dyes as follows.

Green-Sensitive Emulsion Layer:

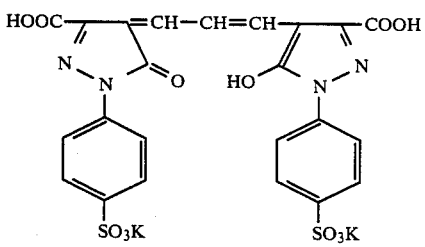

-continued

Red-Sensitive Emulsion Layer:

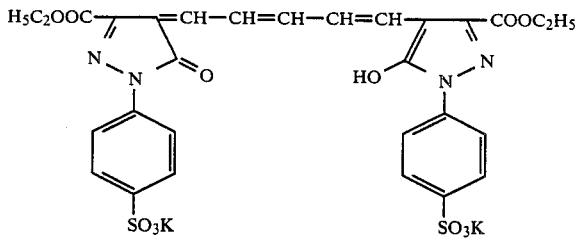

The color photographic material thus prepared was designated as Sample (T).

Samples (U) to (Y) were prepared in the same manner as above except that the compositions of Layer 4 (Ultraviolet Absorptive Layer) and Layer 6 (Ultraviolet Absorptive Layer) of Sample (T) were changed as shown in Table 9 below.

TABLE 9

| Sample | Layer 6 | | | Layer 4 | | |
|---|---|---|---|---|---|---|
| (U) | (I) | Gelatin | 0.53 g/m² | (IV) | Gelatin | 1.58 g/m² |
| | (II) | (*4) | — | (V) | (*4) | — |
| | (III) | (*5) | — | (VI) | (*9) | 0.05 g/m² |
| | | | | (VII) | (*5) | — |
| (V) | (I) | Gelatin | 0.53 g/m² | (IV) | Gelatin | 1.58 g/m² |
| | (II) | (*4) | 0.21 g/m² | (V) | (*4) | 0.62 g/m² |
| | (III) | (*5) | 0.08 ml/m² | (VI) | (*9) | 0.05 g/m² |
| | | | | (VII) | (*5) | 0.24 ml/m² |
| (W) | (I) | Gelatin | 0.53 g/m² | (IV) | Gelatin | 1.58 g/m² |
| | (II) | (*4) | 0.21 g/m² | (V) | (*4) | 0.62 g/m² |
| | (III) | (*5) | 0.04 ml/m² | (VI) | (*9) | 0.05 g/m² |
| | | | | (VII) | (*5) | 0.12 ml/m² |
| (X) | (I) | Gelatin | 0.53 g/m² | (IV) | Gelatin | 1.58 g/m² |
| | (II) | (*4) | 0.21 g/m² | (V) | (*4) | 0.62 g/m² |
| | (III) | (*5) | 0.02 ml/m² | (VI) | (*9) | 0.05 g/m² |
| | | | | (VII) | (*5) | 0.06 ml/m² |
| (Y) | (I) | Gelatin | 0.53 g/m² | (IV) | Gelatin | 1.58 g/m² |
| | (II) | (*4) | 0.21 g/m² | (V) | (*4) | 0.62 g/m² |
| | (III) | (*5) | — | (VI) | (*9) | 0.05 g/m² |
| | | | | (VII) | (*5) | — |

Sample (U): Comparison Sample
Samples (V) to (Y): Samples of the present invention
(II) and (V): Ultraviolet Absorbent (*4)
(III) and (VII): High-boiling Organic Solvent (*5)
(VI): Color Mixing Preventing Agent (*9)

In Samples (U) to (Y), however, when the solubility was reduced with the reduction of the solvent during the preparation of each sample, ethyl acetate was used as an auxiliary solvent in an amount necessary for dissolving the additive(s).

Also, the following compound was used as the gelatin hardening agent for each layer:

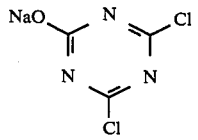

After exposing each of the thus-obtained samples through an optical wedge, the samples were processed in the following manner, using either processing step A (using Color Developer I) or processing step B (using Color Developer II) shown below.

Evaluation of the photographic properties of the resulting images was performed as to relative sensitivity and the maximum density (Dmax) for each sample.

The relative sensitivity is the relative value of each sample when the sensitivity of each light-sensitive emulsion layer of sample (T), after being color developed for 2 minutes according to processing step A, is defined as 100.

Each sample was developed and processed as outlined below.

| Processing Step | Temperature | Time |
|---|---|---|
| Color development | 35° C. | 45 sec. |
| Blix | 33-35° C. | 45 sec. |
| Rinsing 1 | 30-35° C. | 20 sec. |
| Rinsing 2 | 30-35° C. | 20 sec. |
| Rinsing 3 | 30-35° C. | 20 sec. |
| Rinsing 4 | 30-35° C. | 30 sec. |
| Drying | 70-80° C. | 60 sec. |

[Rinsing was conducted by a countercurrent rinsing step with four tanks (Rinsing 4 → Rinsing 1).]

The compositions of the processing solutions used in the above processing steps were as follows.

| | |
|---|---|
| **Color Developer I: (Processing Step A)** | |
| Water | 800 ml |
| Ethylenediamine-N,N,N,N—tetramethylene-phosphonic Acid | 1.5 g |
| Benzyl Alcohol | 15 ml |
| Diethylene Glycol | 10 ml |
| Triethylenediamine(1,4-diazabicyclo-12,2,2]octane) | 5.0 g |
| Sodium Chloride | 1.4 g |
| Potassium Carbonate | 25 g |
| N—Ethyl-N—(β-methanesulfonamidoethyl)-3-methyl-4-aminoaniline Sulfate | 5.0 g |
| N,N—diethylhydroxylamine | 4.2 g |
| Brightening Agent (UVITEX CK manufactured by Ciba-Geigy Aktiengesellschaft) | 2.0 g |
| Water to make | 1,000 ml |
| pH adjusted to 10.10 (at 25° C.) | |
| **Color Developer II: (Processing Step B)** | |
| Water | 800 ml |
| Ethylenediamine-N,N,N,N—tetramethylene-phosphonic Acid | 1.5 g |
| Trietylenediamine(1,4-diazabicyclo-[2,2,2]octane) | 5.0 g |
| Sodium Chloride | 1.4 g |
| Potassium Carbonate | 25 g |
| N—Ethyl-N—(β-methanesulfonamidoethyl)-3-methyl-4-aminoaniline Sulfate | 5.0 g |
| N,N—diethylhydroxylamine | 4.2 g |
| Brightening Agent (UVITEX CK manufactured by Ciba-Geigy Aktiengesellschaft) | 2.0 g |
| Water to make | 1,000 ml |
| pH adjusted to 10.10 (at 25° C.) | |
| **Blix Solution (Common to Processing Steps A and B)** | |
| Water | 400 ml |
| Ammonium Thiosulfate (70% solution) | 100 ml |
| Sodium Sulfite | 18 g |
| Ammonium Ethylenediaminetetraacetato Ferrate | 55 g |
| Ethylenediaminetetraacetic Acid Di-Sodium Salt | 3 g |
| Ammonium Bromide | 40 g |
| Glacial Acetic Acid | 8 g |
| Water to make | 1,000 ml |
| pH adjusted to 5.5 (at 25° C.) | |
| **Rinsing Solution (common to Processing Steps A and B)** | |

-continued

| |
|---|
| Ion-exchange Water (calcium content therein and magnesium content therein each being up to 3 ppm). |

The test results are shown in Table 10 below.

TABLE 10

| Sample | Oil content/Gelatin* (volume ratio) Layer 6 | Layer 4 | Emulsion Layer | Processing Step A Dmax | Relative Sensitivity | Processing Step B Dmax | Relative Sensitivity |
|---|---|---|---|---|---|---|---|
| (T) | 0.80 | 0.80 | B | 2.05 | 100 | 1.45 | 58 |
| | | | G | 2.63 | 100 | 2.07 | 72 |
| | | | R | 2.74 | 100 | 2.12 | 68 |
| (U) | 0 | 0 | B | 2.15 | 104 | 2.03 | 102 |
| [(Y)] | | | G | 2.67 | 104 | 2.58 | 103 |
| | | | R | 2.80 | 105 | 2.75 | 103 |
| (V) | 0.2 | 0.2 | B | 2.09 | 101 | 1.99 | 100 |
| | | | G | 2.64 | 102 | 2.55 | 100 |
| | | | R | 2.77 | 103 | 2.70 | 100 |
| (W) | 0.1 | 0.1 | B | 2.12 | 102 | 2.01 | 101 |
| | | | G | 2.64 | 102 | 2.57 | 102 |
| | | | R | 2.76 | 104 | 2.73 | 102 |
| (X) | 0.05 | 0.05 | B | 2.14 | 103 | 2.03 | 102 |
| | | | G | 2.66 | 103 | 2.58 | 102 |
| | | | R | 2.78 | 105 | 2.74 | 103 |

*Gelatin: d = 1.34

As is clear from the results shown in Table 10 above, it can be seen that while the results of Samples (U) to (Y) are almost the same as to relative sensitivity and Dmax values both when processed using the color developer II containing no benzyl alcohol and when processed using the color developer I containing benzyl alcohol, the coloring properties of Comparative Sample (T) are greatly reduced when processed with color developer II without benzyl alcohol. This is considered to be due to the fact that the volume ratio of oil component/gelatin in Layer 4 and Layer 6 of Sample (T) is high and hence the permeability of the developing agent during color development is reduced. On the other hand, it is considered that in Samples (U) to (Y), because the ratio of oil component/gelatin in Layer 4 and Layer 6 is low, the coating amount of the solvent is reduced to increase the permeability of the color developing agent.

EXAMPLE 6

After processing the samples prepared as in Example 5 by the same procedures as described in Example 5, a light fastness test was performed on each sample.

The light fastness value is measured by the percentage of a color density after the light fastness test in a portion having color density of 2.0 before the light fastness test to the color density of 2.0.

The light fastness test was performed by the irradiating each sample with a xenon fade-o-meter (85,000 lux) for 200 hours.

The results obtained are shown in Table 11 below.

TABLE 11

| Sample | Oil content/Gelatin* (volume ratio) Layer 6 | Layer 4 | Processing Step A Color Image Fastness to Light (%) Cyan | Magenta | Yellow | Stain at the Background Portion | Processing Step B Color Image Fastness to Light (%) Cyan | Magenta | Yellow | Stain at the Background Portion |
|---|---|---|---|---|---|---|---|---|---|---|
| (T) | 0.80 | 0.80 | 74 | 77 | 75 | 0.22 | 78 | 81 | 78 | 0.20 |
| (U) | 0 | 0 | 48 | 51 | 46 | 0.30 | 53 | 56 | 52 | 0.27 |
| (V) | 0.2 | 0.2 | 81 | 82 | 79 | 0.17 | 86 | 86 | 84 | 0.10 |
| (W) | 0.1 | 0.1 | 83 | 83 | 80 | 0.16 | 88 | 88 | 86 | 0.09 |
| (X) | 0.05 | 0.05 | 84 | 84 | 82 | 0.15 | 89 | 91 | 88 | 0.08 |
| (Y) | 0 | 0 | 86 | 86 | 85 | 0.14 | 90 | 93 | 90 | 0.07 |

As is clear from the results shown in Table 11, it can be seen that Samples (V) to (Y) of this invention having a low ratio of oil component/gelatin to reduce the amount of the components of the processing solutions which may be picked up by the color photographic material during processing show good light fastness of the cyan, magenta, and yellow colors as well as exhibiting an excellent reduction effect as to the formation of stains in the background portion.

Furthermore, Samples (T) to (Y) prepared as described above were processed as above and the samples thus processed were allows to stand for 2 weeks under the conditions of 70° C. and 80% RH. The densities of the samples were measured and the results thus obtained are shown in Table 12 below, wherein the percentage of cyan, magenta, and yellow densities after allowing the color photographic material to stand for 2 weeks at 70° C. and 80% RH in each portion having the cyan, magenta, and yellow densities of 2.0 before the test to the cyan, magenta, and yellow densities of 2.0 is shown. Furthermore, the so-called stain at the background portion measured on the blue density is also shown in the same table.

TABLE 12

| Sample | Processing Step A Color Image Fastness (%) Cyan | Magenta | Yellow | Stain | Processing Step B Color Image Fastness (%) Cyan | Magenta | Yellow | Stain |
|---|---|---|---|---|---|---|---|---|
| (T) | 95 | 98 | 97 | 0.24 | 96 | 100 | 97 | 0.16 |
| (U) | 97 | 99 | 98 | 0.20 | 98 | 100 | 99 | 0.13 |
| (V) | 97 | 99 | 98 | 0.20 | 98 | 100 | 99 | 0.12 |
| (W) | 98 | 99 | 98 | 0.19 | 99 | 100 | 99 | 0.11 |
| (X) | 98 | 99 | 99 | 0.18 | 99 | 100 | 100 | 0.10 |

TABLE 12-continued

| Sample | Processing Step A Color Image Fastness (%) Cyan | Magenta | Yellow | Stain | Processing Step B Color Image Fastness (%) Cyan | Magenta | Yellow | Stain |
|---|---|---|---|---|---|---|---|---|
| (Y) | 98 | 99 | 99 | 0.17 | 99 | 100 | 100 | 0.09 |

The results of testing the color image fastness under the aforesaid high temperature and high humidity conditions shown in Table 12 above clearly demonstrate that the use of the ultraviolet absorbents of the present invention result in excellent color image stability. This effect is particularly remarkable as to prevention of stains, and it is considered as due to a reduction of the amount of the developing agent remaining in the material after processing.

The color image-forming process of the present invention is thus seen to have the advantages described above. That is, by processing a color photographic material wherein the volume ratio of the oil components to a hydrophilic colloid in the light-insensitive layer thereof is at most about 0.5, and at least one of the light-insensitive layers contains the compound of formula (F) described above and is developed with a color developer substantially free of benzyl alcohol for a period of up to about 2 minutes 30 seconds, and washed for a period of up to about 1 minute 30 seconds, the resulting color density can be maintained at significantly higher levels than when using a conventional color image-forming process, the storability of color images by improved, and further, the formation of stains at the background portions can be greatly reduced.

While the invention has been described in detail and with reference to specific embodiments thereof, it will be apparent to one skilled in the art that various changes and modifications can be made therein without departing from the spirit and scope thereof.

What is claimed is:

1. A color image forming process comprising developing an imagewise exposed silver halide color photographic material with a color developer containing an aromatic primary amine developing agent and benzyl alcohol in an amount of 0.5 ml/or less for a period of up to about 2 minutes and 30 seconds, wherein said silver halide color photographic material comprises a reflective support having thereon a blue-sensitive silver halide emulsion layer containing a yellow color-forming coupler, a green-sensitive silver halide emulsion layer containing a magenta color-forming coupler, and a red-sensitive silver halide emulsion layer containing a cyan color-forming coupler in this order said material further containing light-insensitive hydrophilic colloid layers between the blue-sensitive silver halide emulsion layer and the green-sensitive silver halide emulsion layer and between the green-sensitive silver halide emulsion layer and the red-sensitive silver halide emulsion layer and at least one light-insensitive hydrophilic colloid layer on the red-sensitive silver halide emulsion layer, the volume ratio of an oil component to the hydrophilic colloid in each of the light-insensitive layers being at most about 0.2 and both the light-insensitive layer between the green-sensitive silver halide emulsion layer and the red-sensitive silver halide emulsion layer and the light-insensitive layer on the red-sensitive silver halide emulsion layer each contains at least one ultraviolet absorbent compound represented by formula (F):

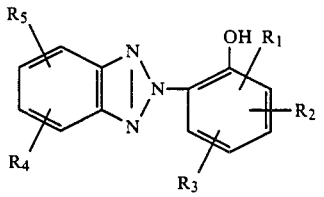

(F)

wherein $R_1$, $R_2$, $R_3$, $R_4$ and $R_5$, which may be the same or different, each represents a hydrogen atom or a substituent, and said $R_4$ and $R_5$ may bond together to form a 5-membered or 6-membered aromatic ring.

2. The color image forming process as claimed in claim 1, wherein after color developing, said process comprises subjecting said color photographic material to a desilvering step followed by at least one of a wash step and a stabilization step for a period of up to about 1 minute and 30 seconds.

3. The color image forming process as claimed in claim 1, wherein said magenta color-forming coupler is a pyrazolotriazole type or 3-anilino-5-pyrazolone type 2-equivalent coupler having a coupling releasing group containing a sulfur atom as the releasing atom.

4. The color image forming process as claimed in claim 3, wherein said pyrazolotriazole type 2-equivalent coupler further has a substituted or unsubstituted alkoxy group, a substituted or unsubstituted aryloxy group or a substituted or unsubstituted heterocyclic ring oxy group at the 6-position of the pyrazolotriazole ring.

5. The color image forming process as claimed in claim 1, wherein said oil component comprises at least one high boiling organic solvent.

6. The color image forming process as claimed in claim 5, wherein said high boiling organic solvent is selected from the organic solvents represented by the following formulae (A) to (E) having a boiling point of at least about 175° C. at atmospheric pressure:

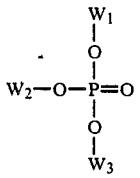

(A)

$W_1-COO-W_2$ (B)

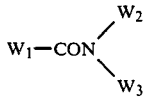

(C)

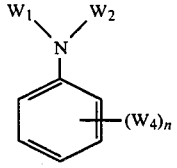

(D)

$W_1-O-W_2$ (E)

wherein $W_1$, $W_2$ and $W_3$, each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group;

$W_4$ has the same definition as $W_1$, but may also represent O-$W_1$ or S-$W_1$; n represents an integer of from 1 to 5; when n is from 2 to 5, $W_4$ may be the same or different, and in formula (E), $W_1$ and $W_2$ may bond together to form a condensed ring.

7. The color image forming process as claimed in claim 5, wherein said oil component comprises at least one high boiling organic solvent selected from the organic solvents represented by the following formula (A) to (E) having a boiling point of at least about 175° C. at atmospheric pressure:

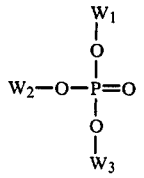

(A)

$W_1—COO—W_2$ (B)

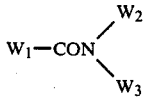

(C)

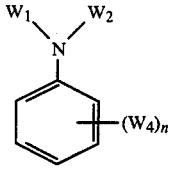

(D)

$W_1—O—W_2$ (E)

wherein $W_1$, $W_2$ and $W_3$, each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ has the same definition as $W_1$, but may also represent O-$W_1$ or S-$W_1$; n represents an integer of from 1 to 5; when n is from 2 to 5, $W_4$ may be the same or different, and in formula (E), $W_1$ and $W_2$ may bond together to form a condensed ring, said organic solvents being co-present with at least one high boiling organic solvent selected from the group consisting of phenol series solvents, carbonic acid ester series solvents, phosphorous acid ester series solvents, phosphorous-containing series solvents, paraffinic solvents, alcohol series solvents, and nitrogen-containing solvents.

8. The color image forming process as claimed in claim 7, wherein the total sum of the carbon atoms of $W_1$, $W_2$, $W_3$ and $W_4$ is at least 8.

9. The color image forming process as claimed in claim 7, wherein said oil component comprises the high boiling organic solvent represented by the formula (A).

10. The color image forming process as claimed in claim 1, wherein said hydrophilic colloid is gelatin.

11. The color image forming process as claimed in claim 1, wherein said substituent of said ultraviolet absorbent compound represented by formula (F) is an alkyl group, an aromatic group, a cyclic alkyl group, a halogen atom, a nitro group, an amino group, a cyano group, an alkoxy group, or a heterocyclic group, and each of these groups may be further substituted.

12. The color image forming process as claimed in claim 1, wherein each of the yellow, magenta and cyan color-forming couplers are present in an amount of from 0.001 to 1 mol per mol of silver halide.

13. The color image forming process as claimed in claim 1, wherein said yellow color-forming coupler is present from 0.01 to 0.5 mol per mol of silver halide, said magenta color-forming coupler is present from 0.003 to 0.3 mol per mol of silver halide, and said cyan color-forming coupler is present from 0.002 to 0.3 mol per mol of silver halide.

14. The color image forming process as claimed in claim 1, wherein said reflective support include a support coated with a hydrophobic resin containing a light-reflective substance selected from the group consisting of titanium oxide, zinc oxide, calcium carbonate, or calcium sulfate, a support composed of a hydrophobic resin containing said light-reflective substance, or a baryta-coated paper.

15. The color image forming process as claimed in claim 1, wherein the developing step is from 0.5 minute to 2 minutes.

16. The color image forming process as claimed in claim 1, wherein the ultraviolet absorbent is used in the range of from $1\times10^{-4}$ mol/m$^2$ to $2\times10^{-3}$ mol/m$^2$.

17. The color image forming process as claimed in claim 16, wherein the ultraviolet absorbent is used in the range of from $5\times10^{-4}$ mol/m$^2$ to $1.5\times10^{-3}$ mol/m$^2$.

18. The color image forming process as claimed in claim 1, wherein the color developer is completely free of benzyl alcohol.

19. The color image forming process as claimed in claim 1, wherein the aromatic primary amine developing agent is 3-methyl-4-amino-N-ethyl-N-$\beta$-methanesulfonamido ethylaniline.

20. The color image forming process as claimed in claim 1, wherein said silver halide emulsion layers each contains silver halide grains mainly forming a latent image on the surface thereof upon exposure to light.

21. The color image forming process as claimed in claim 1, wherein said silver halide emulsion layers each contains silver halide grains having at least 90 mol% of silver chloride content.

22. The color image forming process as claimed in claim 1, wherein the volume ratio of the oil component to the hydrophilic colloid in at least one of the light-insensitive layers is at most about 0.1.

* * * * *